US009717340B2

(12) United States Patent
Rivera

(10) Patent No.: US 9,717,340 B2
(45) Date of Patent: Aug. 1, 2017

(54) ADJUSTABLE SEATING AND FURNITURE

(71) Applicant: TROPITONE FURNITURE CO., INC., Irvine, CA (US)

(72) Inventor: Richard Rivera, Corona, CA (US)

(73) Assignee: TROPITONE FURNITURE CO., INC., Irvine, CA (US)

( * ) Notice: Subject to any disclaimer, the term of this patent is extended or adjusted under 35 U.S.C. 154(b) by 138 days.

(21) Appl. No.: 14/601,027

(22) Filed: Jan. 20, 2015

(65) Prior Publication Data

US 2015/0130241 A1 May 14, 2015

Related U.S. Application Data

(63) Continuation-in-part of application No. 14/247,109, filed on Apr. 7, 2014, now Pat. No. 9,084,488, which is a continuation of application No. 13/942,347, filed on Jul. 15, 2013, now Pat. No. 8,690,247, which is a continuation of application No. 12/881,012, filed on Sep. 13, 2010, now Pat. No. 8,534,758.

(51) Int. Cl.

| | |
|---|---|
| ***A47C 1/03*** | (2006.01) |
| ***A47C 16/02*** | (2006.01) |
| ***A47C 1/032*** | (2006.01) |

(52) U.S. Cl.

CPC ..... *A47C 1/03294* (2013.01); *A47C 16/025* (2013.01)

(58) Field of Classification Search

CPC .... A47C 1/03294; A47C 1/032; A47C 16/025
USPC ..... 297/342, 423.46
See application file for complete search history.

(56) References Cited

U.S. PATENT DOCUMENTS

| | | | | |
|---|---|---|---|---|
| 269,780 | A * | 12/1882 | Fenny | A47C 16/025 297/423.46 |
| 2,151,729 | A | 3/1939 | Baker | |
| 2,288,775 | A * | 7/1942 | Bell | A47C 1/03294 5/47 |
| 2,313,023 | A | 3/1943 | Ruegger | |
| 2,529,451 | A | 11/1950 | Hoven et al. | |
| 2,627,898 | A | 2/1953 | McStay | |
| 2,807,310 | A | 9/1957 | Sellner | |
| 3,305,264 | A | 2/1967 | Gunn | |

(Continued)

FOREIGN PATENT DOCUMENTS

DE 19938485 A1 * 3/2001 ..... A47C 1/032

*Primary Examiner* — Milton Nelson, Jr.
(74) *Attorney, Agent, or Firm* — Knobbe, Martens, Olson & Bear, LLP

(57) ABSTRACT

Self-adjusting furniture, seating, and accessories disclosed. When the user applies a force to the seating by shifting his or her center of gravity, the backrest and/or seat/bed portions of the seating/furniture move in response to the force to recline or adjust the seating/furniture or accessories. The user can return the seating to an upright position by again shifting his or her center of gravity. The angle of the backrest and/or seat/bed portions can vary relative to the ground as the user moves. Continuously varying the angle of both the backrest and seat/bed portions of the seating/furniture or accessories relative to the ground may improve a user's seating comfort, for example, by decreasing or negating the user's need to shift position on the seat when reclined or continuously responding the user's shift in position.

22 Claims, 35 Drawing Sheets

(56) References Cited

U.S. PATENT DOCUMENTS

| | | | |
|---|---|---|---|
| 3,773,383 | A | 11/1973 | Ekornes |
| 3,806,193 | A | 4/1974 | Faiks |
| 3,870,365 | A | 3/1975 | Knutsen |
| 3,934,492 | A | 1/1976 | Timbs |
| 3,947,069 | A | 3/1976 | Lusch |
| 4,126,355 | A | 11/1978 | Rosenheck |
| 4,359,245 | A | 11/1982 | Franke |
| 4,364,606 | A | 12/1982 | Eknes |
| 4,387,876 | A | 6/1983 | Nathan |
| 4,580,834 | A | 4/1986 | de la Sota Martinez |
| 4,660,884 | A | 4/1987 | Terui et al. |
| 4,753,482 | A | 6/1988 | Warren |
| 4,768,829 | A | 9/1988 | Goldman |
| 4,925,228 | A | 5/1990 | Pipon et al. |
| 4,941,709 | A | 7/1990 | Möller |
| 5,082,324 | A | 1/1992 | Harada et al. |
| 5,137,330 | A | 8/1992 | Lie et al. |
| 5,215,352 | A | 6/1993 | Yeh et al. |
| 5,356,172 | A | 10/1994 | Levy et al. |
| 5,944,385 | A | 8/1999 | Pearce |
| 5,967,609 | A | 10/1999 | Potter |
| 6,012,774 | A | 1/2000 | Potter |
| 6,050,642 | A | 4/2000 | Erb |
| 6,126,186 | A | 10/2000 | Mascari |
| 6,161,898 | A | 12/2000 | Brevi |
| 6,206,393 | B1 | 3/2001 | Mascari et al. |
| 6,238,001 | B1 | 5/2001 | Yoran |
| 6,315,358 | B1 | 11/2001 | Baru |
| 6,375,261 | B1 | 4/2002 | Link |
| 6,511,128 | B2 | 1/2003 | Piretti |
| 6,698,833 | B2 | 3/2004 | Ball et al. |
| 6,736,457 | B2 | 5/2004 | Elio et al. |
| 6,805,406 | B1 | 10/2004 | Jansen |
| 6,827,650 | B1 | 12/2004 | Tseng |
| 6,913,315 | B2 | 7/2005 | Ball et al. |
| 6,951,371 | B2 | 10/2005 | Wang |
| 7,000,988 | B2 | 2/2006 | Bressler et al. |
| 7,125,077 | B2 | 10/2006 | Frank |
| 7,188,900 | B1 | 3/2007 | Raftery |
| 7,273,255 | B2 | 9/2007 | Nylander et al. |
| 7,407,229 | B1 | 8/2008 | Chen |
| 7,735,924 | B2 | 6/2010 | Lin |
| 7,735,925 | B2 | 6/2010 | Lin |
| 8,534,758 | B2 | 9/2013 | Rivera |
| 8,690,247 | B2 | 4/2014 | Rivera |
| 9,084,488 | B2 | 7/2015 | Rivera |
| 9,226,581 | B2 | 1/2016 | Rivera |
| 2004/0256899 | A1 | 12/2004 | Moore et al. |
| 2005/0140183 | A1 | 6/2005 | Conte |
| 2006/0238006 | A1 | 10/2006 | Baranov et al. |
| 2008/0061615 | A1 | 3/2008 | McBride et al. |
| 2008/0231099 | A1 | 9/2008 | Szczepkowski et al. |
| 2014/0217795 | A1 | 8/2014 | Rivera |
| 2016/0206097 | A1 | 7/2016 | Rivera |
| 2016/0206098 | A1 | 7/2016 | Rivera |

* cited by examiner

ADJUSTABLE SEATING AND FURNITURE

CROSS-REFERENCE TO RELATED APPLICATION

This application is a continuation-in-part of U.S. application Ser. No. 14/247,109, filed Apr. 7, 2014, which is a continuation of U.S. patent application Ser. No. 13/942,347, filed Jul. 15, 2013, now U.S. Pat. No. 8,690,247, which is a continuation of U.S. patent application Ser. No. 12/881,012, filed Sep. 13, 2010, now U.S. Pat. No. 8,534,758, the entire contents of each of which are incorporated herein by reference and made a part of this specification.

BACKGROUND

Field

The present disclosure relates to adjustable seating and furniture, and more particularly to self-adjusting seating and furniture.

Description of the Related Art

Reclinable seating has been known for many years. Early solutions to devising seating with a reclining backrest used manual recline controls with prefixed reclining positions, for example, employing notches in the hinged connection between the backrest and the seat or by using notches in the armrests of the seating. Some reclinable seatings, such as chaises, employ a notch mechanism between the frame and the backrest (e.g., a head rest ratchet system). These early solutions, although still widely used, are deficient because of their very limited reclined positions and because many do not permit the seat to move in relation to the backrest. For example, with a head rest ratchet system, a user has to either get up or reach behind the backrest to adjust the position of backrest of the chaise.

The related art has attempted to solve the deficiencies of manual recline controls with self-adjusting reclinable seating. Self-adjusting reclinable seating does not rely upon prefixed reclining positions. This allows the seating to be positioned anywhere along a range of movement. However, a user may find the positioning of the seat and backrest in the reclining positions in the seating solutions offered by the prior art to be uncomfortable and difficult to get into the seating. Consequently, the user may shift his or her position on the seat to accommodate for the backrest's angle of recline or not be able to get into the seating comfortably. Accordingly, a need remains for seating that improves user comfort and ease of use as well as decreases or eliminates the user's need to shift position on the seat when reclined.

SUMMARY

In some embodiments, adjustable furniture and seating, including reclinable seating, is disclosed that continuously moves the seat/bed/resting and/or backrest portions relative to the ground as the user in the seating moves. When the user applies a force to the seating by shifting his or her center of gravity and/or by applying or reducing body weight to the backrest, the seat/bed and/or backrest portions of the seating move in response to the increased or reduced force to adjust and/or recline the seating.

In some embodiments, the adjustable furniture or seating can provide near infinite or continuous levels of adjustment and positions. For example, a slight shift in body weight (center of gravity) may slightly move the backrest and/or seat/bed relative to each other or the frame of seating as a guide correspondingly moves slightly along a continuous tracks as discussed herein to provide another position of comfort or desired position. The seating balances the user's weight to support the user's weight at the comfort and/or desired position. The seating substantially does not change this comfort and/or desired position until the user shifts the user's center of gravity and/or applies or reduces body weight to the backrest.

In some embodiments, the seating (e.g., reclinable seating) is configured to compensate for the tendency of the seat/bed portion to tilt downwards as the backrest portion reclines. In some embodiments, and in particular for reclinable seating, the seating can include a frame structure to which the backrest portion is pivotably coupled. The backrest can recline from an upright position. The backrest can be hingeably connected to a seat/bed hingeably at a rear portion of the seat/bed. The seat/bed can move in relation to the backrest. The front portion of the seat/bed can incline upwards as the backrest reclines (e.g., pivots relative to the frame structure). In some embodiments, the position of the seat relative to the ground (e.g., resting surface) forms an acute angle, and the angle of the seat relative to the ground is substantially maintained as the seat moves forward and the backrest reclines. Alternatively, the angle of the seat/bed relative to the ground can decrease as the backrest reclines. In some embodiments, however, the vertical distance of the front of the seat/bed relative to the ground increases. The user can return the seating to an upright position by again shifting his or her center of gravity. Such a configuration reduces or eliminates the need for manual recline controls, including mechanisms to temporarily fix the position of the seating on a track. The adjustable seating may improve a user's seating comfort, for example, by decreasing or eliminating the user's need to shift position on the seat/bed when a desired and/or reclined position. The seating can also accommodate a shift in the user's position when the user desires to rest in a different position.

The rear portion or end of the seat/bed, in some embodiments, is not lifted during the reclining of the seating. Some embodiments enhance comfort of and convenience of use for the user by configuring the seating such that, in use, the front of the seat/bed portion will rise. The plane or angle of the seat/bed portion may decrease with respect to the floor or ground as the seating is reclined from the perspective of the backrest, or the plane or angle may remain relatively constant.

In some embodiments, the rear of the seat/bed is lifted or rises during the reclining of the seating, while the front of the seat/bed portion will rise less than the rear portion, stay at about the same level, or lower. In some embodiments, the angle relative to the floor may change from a positive slope (upwards) to a negative slope (downwards) with respect to the rear of the seat/bed portion. For example, a chaise bed may be inclined upwards from the rear relative to the ground in the upright position and may be flat or declined downwards from the rear relative to the ground in the reclined position. The flat or decline/negative slope of the bed may accommodate a more flat orientation of the bed relative to the backrest to provide a relatively flat configuration for a user to lie fully stretched out in the reclined position (e.g., prone position).

In some embodiments, a guide assembly and a track are configured to lift the front portion of the seat/bed as the guide assembly is moved along the track while the backrest may recline. For example, the track can be configured such that at least a portion of the track slopes downward from the direction of the front portion of the seat/bed to the direction of the rear portion of the seat/bed. Alternatively, the track can be considered to slope upwards from the direction of the rear portion to the front portion of the seat/bed. The guide assembly can be engaged with the track such that the guide assembly is higher on the slope of the track when the backrest is reclined than when the backrest is upright. The guide assembly can be engaged with the track such that the guide assembly is higher on the slope of the track when the bed/seat moves toward a front portion of the seating. In some embodiments, the guide assembly and track are configured to substantially maintain the front portion of the seat/bed at a same level (e.g., same vertical distance) as the backrest reclines. In some embodiments, the guide assembly and track are configured to substantially maintain the front portion of the seat/bed level (e.g., same vertical distance) as the bed/seat moves toward a front portion of the seating. In some embodiment, an immediate front section of the seat/bed front portion may lower while other sections of the front portion or adjacent the front portion the seat/bed rise. Such an arrangement and movement can occur when the front portion pivots about the guide assembly, and/or the seat/bed cantilevers about the tracks.

In some embodiments of adjustable seating or furniture, the seat/bed portion or footrest of an ottoman is not itself pivotally coupled or directly pivotally coupled to the frame structure. Rather, the seat/bed portion or footrest of an ottoman can be connected to guide assemblies that support and/or pivot the seat/bed as discussed herein. For example, the seat/bed may full supported in a desired position and moved along a desired path by being connected to the guide assemblies at four points on the seat/bed without a direct connection to a frame of the seating.

An ottoman employing self-adjusting concepts disclosed herein can be used with the reclinable seating. For example, in embodiments where the front portion of the seat/bed stays level (e.g., same height) or lowers, an ottoman may be desirable to support a user's feet. The ottoman may have a rest or support surface (e.g., foot rest surface) that shifts with the user's weight as legs of the user push on the support surface. When the seating is in an upright position, the user's leg can be positioned on the ottoman such that the support surface is substantially level (e.g., flat) relative to the ground. The support surface may be supported on tracks and guide assemblies as discussed herein to allow the support surface to move forward and/or pivot to slope downwardly from the perspective of the seating. When the user reclines the seating, the user's legs can push or move forward the support surface of the ottoman. The resting surface may move from a flat/level position to a downwardly sloping position from the perspective of the seating to accommodate a more flat position of the user in the reclined position of the seating.

In some embodiments, the backrest can be fixed relative to frame. Thus, in some embodiments, the seat can be adjustable or moveable while the backrest is not. For example, the seat may shift its position in response to the user's weight, but the backrest remains fixed. These embodiments can have application in barstools or other similarly higher seating having backrests. Barstools generally have a greater height relative to a resting surface in comparison to other chair, such as lounge chairs. Accordingly, it may be difficult for users to get into the barstool, particularly for shorter users. More particularly, such embodiments have application to assist users in sitting down in, and/or getting up from, seating, which users are handicapped, infirm or otherwise benefit from some assistance in getting into or out of the seating.

Adjustable seating, as disclosed herein, can have a seat that tilts towards the front of the seating (e.g. the seat tilts downward toward the ground from the perspective of backrest or back of the seating) to assist a user getting into the seat. As the user gets into the seat, and shifts his/her weight back toward the backrest, the seat can move in response the weight shift toward the backrest. Thus, to further accommodate the user's comfort, the seat can change inclination relative to its normal resting position as the user gets into the seating. For example, the seat may be inclined downwards (e.g., sloping downwardly) toward the resting surface relative to or from the perspective of the backrest when the seating is unoccupied. The downward inclination can help a user position his/her body against the seat while still standing on the ground (e.g., resting surface). As the user presses his/her weight into the seat and backwards toward the backrest while getting into the seating, the seat can shift or move toward the backrest and change inclination to be inclined upwards (e.g., sloping upwardly) from relative to from the perspective of the backrest. Such a configuration can help retain the seat in a desired position once the seating is occupied and further help secure the user's position in the seating. Such seating can be used for orthopedic applications, where a user may have limited mobility to comfortably get into seating. Some embodiments can have the seat located higher than conventional seating so that the user can more easily get into the seating without having to bend their knees to the extent that is normally required. The seat can present itself with its front portion inclined downwardly, so that the user can sit more easily and then tilt back to the normal seating position. Exiting the seating is similarly facilitated in reverse. In some embodiments, sitting is so facilitated that the user does not have to use their hands to sit and armrests can be dispensed with.

In some embodiments, the seating includes a frame. The frame can include a front member disposed near the front portion of the seat and/or a rear member disposed near the rear of the seat/bed. In some embodiments, the frame can include a middle member disposed between the front and rear members. A track as discussed herein can extend between the front member and the rear member of the frame. In some embodiments, the track adjoins the front member and the rear member of the frame. The track can be connected to either the front member or the back member. In some embodiments, the track can be connected other members (e.g., cross members) of the frame and extend therebetween.

When present, the front member can be upwardly extending or it can be laterally extending. Like the front member, the rear member can be upwardly or laterally extending. The middle member can be upwardly extending. In some embodiments, a second rear member extends perpendicularly from the rear member and provides support for the backrest. The second rear member can be pivotally connected to the backrest. In some embodiments, the second rear member can include a pivot, and the backrest is attached to the pivot. The second rear member could also include a generally horizontally-extending bar, and the backrest contacts the bar or nearly contacts the bar when in the fully reclined position.

In seating that includes side or lateral frame structures generally on either side of the seat/bed portion to provide support against the ground or support a frame of the seating relative to the ground in a desired position or elevation, those structures can be formed from at least front and rear upright members, typically joined at their upper portions by a member at least some of which forms an arm rest. In some embodiments, other upright members can be formed, such a middle upright member to provide further support against the ground or support the frame relative to the ground in a desired position or elevation. Such seating can also include at least one cross member joining either, some, or all of the front, middle, and rear upright members. In some embodiments, the track upon which the seat/bed portion rides is not on or part of the upright members or armrest, but is an additional member.

The track can extend generally from the front to the rear portions of the seating between either the front and rear upright members and/or the front and rear cross members. In some embodiments, the track can extend between cross members and/or other features of the frame. The track can extend generally alongside the seat/bed portion and/or underneath it or in planes lower than that of the seat/bed portion. The track can extend substantially parallel to the sides of the seat/bed. The track can be a fixed track that does not move with the seat/bed as discussed herein. The track can be a straight, a curved track, or a combination of both. In some embodiments, there can be two tracks associated with each seating portion. In some embodiments, four or more tracks can be associated with each seating portion. In some embodiments, the seating can include a single guide assembly per track or two or more guide assemblies per track.

In some embodiments, a straight track can provide the continuous levels of adjustment with the slope of the straight track determining, for example, the angle of the seat portion at a desired position as discussed herein. In some embodiments, an arced track as discussed herein can provide varying vertical support (e.g., weight support of a user) to a guide traveling on the arced track to facilitate adjustment of the seating with a center of gravity shift or weight shift of the user. For example, the vertical support decreases from the upright position to the reclined position of the seating as the guide moves from a substantially horizontal portion to a substantially vertical portion of the arced track to provide smooth and continuous adjustment of the positions of the seating as discussed herein.

In some embodiments, the track can be inclined or declined relative the rear portion/end of the seat/bed. The track can be straight or a combination of various shapes such as straight, curved, arcuate, circular, oval, and/or elliptical. A guide assembly is fixedly attached to the seat/bed and slideably engaged with the track, such that the guide assembly supports the seat/bed on the track. The guide assembly can extend laterally from a side of the seat/bed and/or extend downwardly from the bottom of the seat/bed. The guide assembly can be connected directly the seat/bed or be spaced by other members from the seat/bed. The connection to the seat/bed can be provided by vertical or horizontal extensions. The extensions can elevate or space the seat/bed from guide assembly and/or frame to provide more sliding clearance between the seat/bed and other components of the seating. The greater clearance provides room to accommodate, for example, upholstery, cushions, and other features attached to the backrest, seat/bed, and/or frame of the seating. The guide assembly is configured to slide along the track upon application of a force to the backrest and/or seat/bed. Such seating can be incorporated into furniture, such as a chair, couch, barstool, or chaise lounge.

In some embodiments, the guide assembly can include a frictional control, such as a friction member or a knob, for adjusting the amount of friction between the guide assembly and the lower portion of the track. Such frictional control can be used as a tightening mechanism to prevent the guide assembly from sliding on the track, thereby maintaining the seat and backrest in a fixed position.

In some embodiments, the seat or seat portion can have a certain width and the track does not extend beyond the width of the seat or seat portion. Track having fittings, controls, or the like can also have such fittings, controls, or the like not extending beyond such width. With such features, the seating disclosed herein can have all track, track fittings and components, and any controls and adjustment mechanisms not extending beyond such width, such that they are entirely under or covered by the seat or seat portion from the perspective of a user in the seating.

The track can optionally include at least one stop configured to limit the range of motion of the guide relative to the track. In certain embodiments, the track includes an upper portion and a lower portion separated by one or more generally upward-extending member, such as a bend in the track. The guide assembly can be engaged with the lower portion of the track, which slopes downward from the direction of the front portion of the seat to the direction of the first portion of the seat. The extent of slide of the guide assembly can be limited by the upward-extending member(s) on the track.

In some embodiments, the seating can have more than one type of track. The tracks can, for example, be located near the front and rear portions/ends of the bed (and/or front and rear portions of the frame). One of the tracks can be curved. The track can also include straight portions to facilitate various configurations and movements of the seating, including stopping the guide from moving beyond a desired point. For example, when using a chaise, a user may desire to bring the backrest and the bed substantially flat (180°) relative to each other (by, for example, shifting his or her center of gravity toward a prone position). As the user approaches the fully reclined position or prone position, the backrest and bed separate from each other to a further degree. The more flat or separated the backrest and bed become, the more distributed the weight of the user is on the backrest and bed. An arc or curved portion of the track can facilitate vertical movement of the bed as the bed comes up to meet the pivotal movement of the backrest about the pivot member connected to the frame. In the flat or fully reclined position, the guide is located on an upper part of the curved/arcuate portion and is substantially suspended relative to a travel path that is substantially parallel to a weight vector of the user (substantially parallel to the pull of gravity). Stated differently, the curved/arcuate/arced track can be configured to not provide significant vertical support or resistance to the guide in the reclined position; thus, providing relatively less (or negligible) support for the weight of the user at that particular point on the bed. The friction between the guide and the track can be adjusted such that when the user focuses the user's weight toward the rear of the bed (shifts center of gravity to get up or move into the upright position), the increased weight at the rear of the bed causes the suspended guide to drop with ease to bring the bed down and the seating into the upright position.

Accordingly, when the user desires to get up from the prone position in the seating (e.g., from the fully reclined position), the guide is located on a substantially vertical portion of the track that does not provide or minimally provides vertical support to work or push against the user concentrating his or weight onto the guide to move the seating into the upright position. The arrangement of the guide being on a substantially vertical portion of a curved/arcuate/arced track in the fully reclined position facilitates pushing the seating into the upright position by allowing a shift in the user's center of gravity toward the guides on the track to move the guides downward along with the force of gravity (e.g., the substantially vertical track portion providing minimal or no resistance to movement of the guide in a substantially vertical direction).

As the seating moves toward the upright position, the weight of the user becomes more concentrated toward the rear of the bed as the user's center of gravity shifts toward the rear of the bed toward the guide (e.g., the user is getting/sitting up). With the concentration of the weight increasing toward rear as the guide moves downwardly along the curved track, the curved track can be shaped to become more level (e.g., horizontal) along the travel path or direction of the track to accommodate and support the increased weight on the guide. In some embodiments, the curved track becomes substantially level (e.g., horizontal) at a point where the guide rests on the track in the upright position of the seating. In the upright position, the curved track at that point on the track may provide similar functionality as that of a straight track. Stated differently, as the user's center of gravity is shifted toward the rear of the seat/bed onto the guide, the guide moves along a track that becomes progressively more horizontal. Accordingly, vertical movement of guide is inhibited or restricted as the track becomes more horizontal to provide more weight support in the vertical direction. For example, when track is substantially horizontal or level, vertical movement of the guide is substantially inhibited to support the weight of the user in, for example, the upright position of the seating.

In some embodiments, a curved/arcuate/arced track near the rear portion of the bed can be complemented with a straight track near the front portion of the bed. A straight track can be declined downwardly relative to a path from the front portion to the rear portion of the bed. The declined straight track can facilitate returning from the prone position to the upright position. For example, when the user moves from the reclined position to the upright position by concentrating the user's weight more toward the rear portion of the bed (shifting center of gravity), the declined slope of the straight track along the travel path of the guide can facilitate the movement of the guide downward along the downward track, working with gravity and the efforts of the user to move himself/herself and the bed more upright.

In some embodiments, similar functionality as discussed above may be achieved with the most of the tracks being substantially straight. For example, a straight track located near the rear portion of the bed can be relatively more inclined upwards (from the rear to the front) to facilitate the upward vertical movement of the rear portion of the bed as the user reclines. Concomitantly, the relatively more vertical straight track can provide at least some suspension of the guide to facilitate the downward movement of the guide as the user moves into the upright position.

Any combination of curved and straight tracks placed at various angles relative to the ground can be used to achieve the varying functionality of a seating that adjusts based on the movement of the user, and in particular the weight distribution and location of the center of gravity of the user. For example, a horizontal track would facilitate the user to get into the prone position more easily, but may make it harder to get vertical (upright) again. Conversely, a more vertical track would make it easier to release from the prone (reclined) position, but may make it hard for the user to get into that prone position. Various combinations of tracks, locations of track, and shapes of tracks as discussed herein can be utilized to achieve the desired functionality of the seating that self-adjusts based on the user's center gravity as discussed herein.

In some embodiments, adjustable seating, and in particular reclinable seating, includes a backrest configured to recline from an upright position; a seat including a front portion and a rear portion and hingeably connected to the backrest at the rear portion of the seat, the seat being configured to move in relation to the backrest; a frame including: an upwardly-extending front member disposed near the front portion of the seat, an upwardly-extending rear member disposed near the rear portion of the seat, a pivot member extending generally horizontally from the rear member and connected to the backrest so that the backrest can pivot about the pivot member, and a track extending between the front member and the rear member. The track has an upper portion, a lower portion, and two generally upward-extending bends connecting the upper portion to the lower portion, at least the lower portion of the track sloping downward from the direction of the front member to the direction of the rear member; and a guide configured to support the seat on the track. The guide is fixedly attached to the seat and slideably engaged with the downward-sloping lower portion of the track, such that the guide is configured to slide along the track upon application of a force to the backrest and/or seat, and the guide being configured to be higher on the slope of the track when the backrest is reclined than when the backrest is upright, the extent of slide being limited by the two generally upward-extending bends on the track.

In some embodiments, there is provided adjustable seating, and in particular reclinable seating, including: a backrest configured to recline from an upright position; a seat including a front portion and a rear portion and hingeably connected to the backrest at the rear portion of the seat, the seat being configured to move in relation to the backrest and a frame. The frame includes a front member being disposed near the front portion of the seat, a rear member being generally upright and disposed near the rear portion of the seat, a pivot member extending generally horizontally from the rear member and contacting the backrest so that the backrest can pivot about the pivot member. The seating further includes track extending from the front member toward the rear member, at least a portion of the track sloping downward from the direction of the front member to the direction of the rear member; and a guide configured to support the seat on the track, the guide being fixedly attached to the seat and slideably engaged with the downward-sloping portion of the track, such that the guide is configured to slide along the track upon application of a force to the backrest and/or seat, and the guide being configured to be higher on the slope of the track when the backrest is reclined than when the backrest is upright.

In some embodiments, there is provided adjustable seating, in particular reclinable seating, including: a backrest configured to recline from an upright position; and a seat including a front portion and a rear portion and hingeably connected to the backrest at the rear portion of the seat; and a guide fixedly engaged with the seat and slidingly engaged with a track disposed proximate the seat, the guide and track being configured to incline the front portion of the seat as the backrest reclines.

Various embodiments of this disclosure relate to a reclinable seating having an upright position (e.g. a first position) and a reclined position (e.g., a second position). The reclinable seating can include the following: a frame including a front portion, a rear portion, and members to support the reclinable seating relative to a surface on which the seating rests; a backrest connected to the frame via a pivot member, the backrest configured to pivot about the pivot member relative to the frame; a seat connected to the backrest via a pivot connection, the seat configured to pivot at the pivot connection relative to the backrest; a track connected to the frame, the track including a support rail, a hanger rail connected to the support rail, and a guiding rail connected to the hanger rail, the support rail extending from the frame generally upwardly relative to the surface and generally toward the front portion of the frame, the hanger rail extending from the support rail generally downwardly relative to the surface and generally toward the front portion of the frame, and the guide rail extending from the hanger rail generally upwardly and generally toward the front portion of the frame; and a guide connected to the seat and slideably engaging the track, the guide configured to move along the guiding rail up to the hanger rail, the guide configured to support the seat on the track. The reclinable seating is continuously moveable between an upright position and a reclined position, the backrest pivoting about the pivot member from being more vertical to less vertical relative to the surface from the upright position to the reclined position, the seat moving with the guide along the track toward the front portion of the frame from the upright position to the reclined position.

In some embodiments, the reclinable seating can include one or more of the following: the track further includes a stay connected to the guiding rail, the stay extending from the guiding rail generally downwardly and generally toward the front portion of the frame; the stay forms a discontinuous path with the guiding rail, the discontinuous path configured to inhibit movement of the guide from the guiding rail to the stay; the stay includes a generally L-shaped support; the stay is connected to the guiding rail away from a corner of the generally L-shaped support to form the discontinuous path; the frame further includes a cross member, the cross member providing a connection between the support rail and the frame, the cross member extending between sides of the frame and proximate to the surface relative to the track; the cross member curves downwardly toward the surface to form a generally U-shaped member, the generally U-shaped member elevating the seating to a desired height above the surface; the seating further including an extension providing the connection between the guide and the seat, the extension having a vertical length to elevate the seat above the guide and provide sliding clearance between the seat and the frame; the seating further including a bracket providing a connection between the guide and the extension; the guide is pivotally connected to the bracket to allow the guide to pivot relative to the bracket as the guide moves along the guiding rail; the bracket engages the guide with a bolt and nut assembly; tension formed by tightening the bolt and nut assembly can be adjusted to change friction between the guide and the track to adjust ease with which the seating moves between the upright and reclined positions; friction caused by the guide engaging the track can be adjusted based on a weight of a user to adjust ease with which shifting the weight of the user moves the seating between the upright and reclined positions; the seating further including an other track connected to the frame, the other track including an other support rail, an other hanger rail connected to the other support rail, and an other guiding rail connected to the other hanger rail, the other support rail extending from the frame generally upwardly relative to the surface and generally toward the front portion of the frame, the other hanger rail extending from the other support rail generally downwardly relative to the surface and generally toward the front portion of the frame, and the other guide rail extending from the other hanger rail generally upwardly and generally toward the front portion of the frame; the seating further including an other guide connected to the seat and slideably engaging the other track, the other guide configured to move along the other guiding rail up to the other hanger rail, the other guide configured to support the seat on the track; the track further includes a stay connected to the guiding rail, the stay extending from the guiding rail generally downwardly and generally toward the front portion of the frame; the other track further includes an other stay connected to the other guiding rail, the other stay extending from the other guiding rail generally downwardly and generally toward the front portion of the frame; the stay forms a discontinuous path with the guiding rail, the discontinuous path configured to inhibit movement of the guide from the guiding rail to the stay; the other stay forms an other discontinuous path with the other guiding rail, the other discontinuous path configured to inhibit movement of the other guide from the other guiding rail to the other stay; the stay and the other stay are connected by a crossbar to form a generally U-shaped support, the guiding rail and the other guiding rail connected to the generally U-shaped support away from corners of the generally U-shaped support to form the discontinuous path and the other discontinuous path, respectively; the guiding rail and the other guiding rail are connected to the crossbar of the generally U-shaped support to form the discontinuous and the other discontinuous path, respectively; the seat remains at substantially a same angle relative to the surface in the upright and reclined positions; the seat is angled upwards from the pivot connection relative to the surface in the upright position; the upward angle from the pivot connection relative to the surface decreases while the seating is moved into the reclined position as the seat pivots about the pivot connection relative to the backrest; the seat is substantially level with the surface in the reclined position; the guide includes a first sliding shoe and a second sliding shoe, the first and second sliding shoes, when assembled, forming an opening to slideably engage the track; and/or a chair including the seating.

Various embodiments of this disclosure relate to a reclinable seating having an upright position (e.g. a first position) and a reclined position (e.g., a second position). The reclinable seating can include the following: a frame including a front portion and a rear portion, the frame configured to support the reclinable seating relative to a surface on which the seating rests; a backrest connected to the frame, the backrest configured to pivot about relative to the frame; a seat connected to the backrest, the seat configured to pivot relative to the backrest; a rail bracket including two arms and a crossbar, the two arms connected to the frame, the two arms extending from the frame generally upwardly relative to the surface and generally toward the rear portion of the frame, and the crossbar extending generally horizontally between the two arms to connect the two arms away from the frame; a guiderail connected to the rail bracket, the guiderail including a guiding rail extending from the rail bracket generally downwardly relative to the surface; and a guide connected to the seat and engaging the guiderail, the guide configured to move along the guiding rail up to the rail bracket, the guide configured to support the seat on the track. The reclinable seating is continuously moveable between an upright position and a reclined position, the backrest pivoting about the frame from being more vertical to less vertical relative to the surface from the upright position to the reclined position, the seat moving with the guide along the guiderail toward the front portion of the frame from the upright position to the reclined position.

In some embodiments, the reclinable seating can include one or more of the following: the guiding rail is connected to the crossbar, away from the two arms; the guiderail further includes a hanger rail connected to the guiding rail, the hanger rail extending from the guiding rail generally upwardly and generally toward the rear portion of the frame, the guide configured to stop at the hanger rail when moving along the guiding rail toward the rear portion of the rail as the seating is moved into the upright position; the guiderail further includes a support rail connected to the hanger rail, the support rail extending from the hanger rail generally downwardly and generally toward the rear portion of the frame; the frame further includes a cross member, the cross member providing a connection between the support rail and the frame, the cross member extending between sides of the frame and proximate to the surface relative to the guiderail; the cross member extends downwardly toward the surface to form a generally U-shaped member, the generally U-shaped member elevating the seating to a desired height above the surface; the seating further including an extension providing the connection between the guide and the seat, the extension having a vertical length to elevate the seat above the guide and provide sliding clearance between the seat and the frame; the seating further including a guide bracket providing a connection between the guide and the extension; the guide is pivotally connected to the guide bracket to allow the guide to pivot relative to the guide bracket as the guide moves along the guiding rail; the guide bracket engages the guide with a bolt and nut assembly; tension formed by tightening the bolt and nut assembly can be adjusted to change friction between the guide and the guiderail to adjust ease with which the seating moves between the upright and reclined positions; friction caused by the guide engaging the guiderail can be adjusted based on a weight of a user to adjust ease with which shifting the weight of the user moves the seating between the upright and reclined positions; the seating further including an other guiderail connected to the bracket, the other guiderail including an other guiding rail extending generally downwardly relative to the surface; an other guide connected to the seat and engaging the other guiderail, the other guide configured to move along the other guiding rail up to the bracket, the other guide configured to support the seat against the track; the other guiding rail is connected to the crossbar, away from the two arms; the other guiderail further includes an other hanger rail connected to the other guiding rail, the other hanger rail extending from the other guiding rail generally upwardly and generally toward the rear portion of the frame, the other guide configured to stop at the other hanger rail when moving along the other guiding rail toward the rear portion of the frame as the seating is moved into the upright position; the other guiderail further includes an other support rail connected to the other hanger rail, the other support rail extending from the other hanger rail generally downwardly and generally toward the rear portion of the frame; the frame further includes a cross member, the cross member providing a connection between the support rail and the frame, and the other support rail and the frame; the cross member extends between sides of the frame and proximate to the surface relative to the guiderail; the seat remains at substantially a same angle relative to the surface in the upright and reclined positions; the seat is angled upwards from the rear portion of the frame relative to the surface in the upright position; the upward angle from rear portion of the frame relative to the surface decreases as the seating is moved into the reclined position as the seat pivots relative to the backrest; and/or the seat is substantially level with the surface in the reclined position.

Various embodiments of this disclosure relate to a reclinable seating having an upright position (e.g. a first position) and a reclined position (e.g., a second position). The reclinable seating can include the following: a frame including a front portion and a rear portion; a backrest connected to the frame via a pivot member, the backrest configured to pivot about the pivot member relative to the frame; a seat connected to the backrest via a pivot connection, the seat configured to pivot at the pivot connection relative to the backrest; a track connected to the frame, the track including a support rail, a hanger rail connected to the support rail, and a guiding rail connected to the hanger rail, the support rail extending from the frame in a first direction generally toward the front portion of the frame, the hanger rail extending from the support rail in a second direction toward the front portion of the frame, and the guide rail extending from the hanger in the first direction toward the front portion of the frame; and a guide connected to the seat and slideably engaging the track, the guide configured to move along the guiding rail up to the hanger rail, the guide configured to support the seat on the track. The reclinable seating is continuously moveable between an upright position and a reclined position, the backrest pivoting about the pivot member between the upright position and the reclined position, the seat moving with the guide along the track toward the front portion of the frame from the upright position to the reclined position.

Various embodiments of this disclosure relate to a reclinable seating having an upright position (e.g. a first position) and a reclined position (e.g., a second position). The reclinable seating can include the following: a frame including a front portion, a rear portion, and members to support the reclinable seating relative to a surface on which the seating rests; a backrest connected to the frame via a pivot member, the backrest configured to pivot about the pivot member relative to the frame; a seat connected to the backrest via a pivot connection, the seat configured to pivot at the pivot connection relative to the backrest; a track connected to the frame, the track including an arcuate portion upwardly rising along a guide path moving generally in a direction from the rear portion to the front portion of the frame, the guide path being substantially vertical at an upper portion of the arcuate portion of the track proximal to the front portion of the frame; and a guide connected to the seat and slideably engaging the track, the guide configured to move along the arcuate portion and to remain engaged with track along the guide path, the guide configured to support the seat against the track. The reclinable seating is continuously moveable between an upright position and a reclined position, the backrest pivoting about the pivot member from being more vertical to less vertical relative to the surface from the upright position to the reclined position. The guide moves along the arcuate portion of the track as the seat travels forward toward the front portion of the frame while the seating is moved into the reclined position, the guide substantially suspended at the upper portion of the arcuate portion in the reclined position and supporting relatively less weight than when the guide is on other portions of the track.

In some embodiments, the reclinable seating can include one or more of the following: the track further includes a hanger connected to the arcuate portion of the track and connected to the frame proximal to the front portion of the frame relative to the arcuate portion, the hanger configured to inhibit movement of the guide beyond the arcuate portion of the track when the seating is being reclined; the hanger is substantially horizontal to form a discontinuous path where the hanger connects to the arcuate portion at the substantially vertical upper portion of the track, the discontinuous path inhibiting movement of the guide from the arcuate portion of the track to the hanger; the track further includes a horizontal portion proximal to the rear portion of the frame relative to the arcuate portion of the track, the horizontal portion configured to vertically support the guide in order to support a weight of a user when the seating is in the upright position; the frame further includes a cross member, the cross member at least in part providing the connection between the track and the frame, the cross member positioned proximal to the rear portion of the frame relative to the track, the cross member configured to inhibit movement of the guide off the track as the guide moves toward the rear portion of the frame along the track when the seating is being moved into the upright position; the seating further including a support member providing the connection between the guide and the seat, the support member having a vertical length to elevate the seat above the guide and provide sliding clearance between the seat and the frame; the seating further including a bracket providing a connection between the guide and the support member; the guide is pivotally connected to the bracket to allow the guide to pivot relative to the bracket as the guide moves along the arcuate portion of the track; the bracket engages the guide with a bolt and nut assembly; tension formed by tightening the bolt and nut assembly can be adjusted to change friction between the guide and the track to adjust ease with which the seating moves between the upright and reclined positions; friction caused by the guide engaging the track can be adjusted based on a weight of a user to adjust ease with which shifting the weight of the user moves the seating between the upright and reclined positions; the seating further including an other track connected to the frame, the other track including a straight portion upwardly rising along an other guide path moving generally in the direction from the rear portion to the front portion of the frame, the other track more proximate to the front portion of the frame than the track; an other guide connected to the seat and slideably engaged with the other track, the other guide configured to move along the straight portion of the other track and to remain engaged with other track along the other guide path; as the seating is moved from the upright position to the reclined position and the other guide moves forward along the other track, the seat moves toward the front portion of the frame and rises vertically relative to the frame; and/or the chaise has a length sufficient to support a body of a user entirely off the surface when the user is in a prone position.

Various embodiments of this disclosure relate to a reclinable seating having an upright position (e.g. a first position) and a reclined position (e.g., a second position). The reclinable seating can include the following: a frame including a rear portion and a front portion, the frame configured to support the reclinable seating relative to a surface on which the seating rests; a backrest connected to the frame, the backrest configured to pivot relative to the frame; a first guiderail connected to the frame, the first guiderail including a curved portion ascending along a first path moving generally in a direction from the rear portion to the front portion of the frame; the curved portion is concave from a perspective of the pivot member to provide an increasing vertical rise of the first guiderail over a predetermined length along the first path when the reclinable seating is being reclined; a bed connected to the backrest, the bed configured to pivot relative to the backrest; and a first guide assembly connected to the bed and engaging the first guiderail, the first guide assembly configured to move along the curved portion and to remain engaged with the first guiderail along the first path. The reclinable seating is continuously movable between an upright position and a reclined position, the backrest pivoting from being more vertical to less vertical relative to the surface from the upright position to the reclined position.

In some embodiments, the reclinable seating can include one or more of the following: the first guide assembly vertically rises along the curved portion of the first guiderail as the bed travels forward toward the front portion of the frame while the seating is moved into the reclined position, the first guide assembly substantially suspended on the curved portion in the reclined position and supporting relatively less weight than when the first guide assembly is on other portions of the first guiderail; the seating further including a second guiderail connected to the frame, the second guiderail including a straight portion rising along a second path moving generally in the direction from the rear portion to the front portion of the frame, the second guiderail proximate to the front portion of the frame relative to the first guiderail; the seating further including a second guide assembly connected to the bed and engaged with the second guiderail, the second guide assembly configured to move along the straight portion of the second guiderail and to remain engaged with the second guiderail along the second path; as the seating is moved from the upright position to the reclined position, the bed pivots about the second guide assembly as the first guide assembly vertically rises along the curved portion the first guiderail for the bed; the seating further including a bracket providing the connection between the second guide assembly and the bed; the second guide assembly is pivotally connected to the bracket; the first guiderail further includes a hanger connected to the curved portion of the first guiderail and connected to the frame proximal to the front portion of the frame relative to the curved portion, the hanger configured to limit movement of the first guide assembly beyond a vertical level of the hanger when the seating is being reclined; the hanger is substantially horizontal to form a discontinuous path where the hanger connects to the curved portion; the first guide assembly includes shoes substantially enclosing the first guiderail such that the shoes are inhibited from traveling over the discontinuous path from the curved portion of the first guiderail to the hanger; the first guiderail further includes a horizontal portion proximal to the rear portion of the frame, the horizontal portion configured to vertically support the first guide assembly in order to support a weight of a user when the seating is in the upright position; the frame further includes a cross member, the cross member providing the connection between the first guiderail and the frame, the cross member positioned proximal to the rear portion of the frame relative to the first guiderail, the cross member configured to inhibit movement of the first guide assembly off the first guiderail as the first guide assembly moves toward the rear portion of the frame along the first guiderail when the seating is being moved into the upright position; the seating further including an extension providing at least in part a connection between the first guide assembly and the bed, the extension having a vertical length sufficient to elevate the bed above the first guide assembly; the seating further including a back rail, the back rail connected to the frame proximal the rear portion of the frame and positioned to abut the backrest and inhibit further pivoting of the backrest when the backrest pivots beyond a desired angle as the seating is moved into the reclined position; the bed includes an elevation rail providing at least in part a connection between the bed and the first guide assembly, the elevation rail being generally U-shaped to vertically elevate the bed above from the first guide assembly and provide sliding clearance between the bed and the frame as the seating is moved between the upright and reclined positions; a chaise including the seating; and/or the chaise has a length sufficient to support a body of a user entirely off the surface when the user is in a prone position.

Various embodiments of this disclosure relate to a reclinable chaise having an upright position (e.g. a first position) and a reclined position (e.g., a second position). The reclinable chaise can include the following: a frame including a front portion and a rear portion, the frame configured to support the reclinable chaise relative to a surface on which the chaise rests; a backrest connected to the frame via a pivot member, the backrest configured to pivot about the pivot member relative to the frame; a guiderail connected to the frame, the guiderail including an arcuate portion rising along a path moving generally in a direction from the rear portion to the front portion of the frame; a bed connected to the backrest via a pivot connection proximal to the rear portion of the frame relative to the guiderail, the bed configured to pivot at the pivot connection relative to the backrest; and a guide assembly connected to the bed and engaging the guiderail, the guide assembly configured to move along the arcuate portion and to remain engaged with the guiderail along the path. The reclinable chaise is continuously adjustable between an upright position and a reclined position, the backrest pivoting about the pivot member from being more vertical to less vertical relative to the surface from the upright position to the reclined position. The guide assembly vertically rises along the arcuate portion of the guiderail along the path as the bed travels forward toward the front portion of the frame while moving into the reclined position. The bed is angled upwards from the pivot connection relative to the surface in the upright position; the upward angle from the pivot connection relative to the surface decreases as the chaise is moved into the reclined position due to the guide assembly rising on the arcuate portion of the guiderail.

In some embodiments, the reclinable chaise can include one or more of the following: the bed is angled downwards from the pivot connection relative to the surface in the reclined position due to the guide assembly rising on the arcuate portion of the guiderail; the chaise further including a second guiderail connected to the frame, the second guiderail including a straight portion rising along a second path moving generally in the direction from the rear portion to the front portion of the frame, the second guiderail proximate to the front portion of the frame relative to the guiderail; the chaise further including a second guide assembly connected to the bed and engaged with the second guiderail, the second guide assembly configured to move along the straight portion of the second guiderail and to remain engaged with the second guiderail along the second path; as the chaise is moved from the upright position to the reclined position, the bed pivots about the second guide assembly as the guide assembly vertically rises along the arcuate portion the guiderail for the bed to become angled downwards from the pivot connection relative to the surface when the chaise is in the reclined position; the chaise further including a bracket providing the connection between the second guide assembly and the bed; the second guide assembly is pivotally connected to the bracket to allow the bed to be angled downwards from the pivot connection relative to the surface; the guiderail further includes a hanger connected to the arcuate portion of the guiderail and connected to the frame proximal to the front portion of the frame relative to the arcuate portion, the hanger configured to limit a degree the bed is angled downwards from the pivot connection relative to the surface in the reclined position by preventing movement of the guide assembly beyond a vertical level of the hanger when the chaise is being reclined; and/or the chaise further including an extension providing at least in part a connection between the guide assembly and the bed, the extension having a vertical length sufficient to elevate the bed above the guide assembly and angle the bed downwards from the pivot connection relative to the surface in the reclined position.

Various embodiments of this disclosure relate to a reclinable seating having an upright position (e.g. a first position) and a reclined position (e.g., a second position). The reclinable seating can include the following: a frame including a front portion and a rear portion, the frame configured to support the reclinable seating relative to a surface on which the seating rests; a backrest connected to the frame, the backrest configured to pivot relative to the frame; a seating section connected to the backrest, the seating section configured to pivot relative to the backrest; a track connected to the frame, the track positioned within an outer perimeter of the seating section and underneath the seating section, proximate to the ground relative to the seating section, when the seating rests on the surface; and a guide connected to the seating section and slideably engaging the track, the guide configured to move along the along the track and support the seating section against the track. The reclinable seating is continuously moveable between an upright position and a reclined position, the backrest pivoting from being more vertical to less vertical relative to the surface from the upright position to the reclined position. The track directs the guide upwardly away from the surface and simultaneously forward toward the front portion of the frame while the seating is moved into the reclined position.

In some embodiments, the reclinable seating can include one or more of the following: the track includes an uprising portion that has an upward slope relative to the surface from the rear portion to the front portion of the frame; the track includes an arcuate portion that the guide vertically rises and moves forward on as the seating section travels forward toward the front portion of the frame while the seating is moved into the reclined position; the arcuate portion is substantially vertical proximate to the front portion of the frame such that the guide is substantially suspended on the arcuate portion in the reclined position and supports relatively less weight than when the guide is on other portions of the arcuate portion; the track further includes a hanger connected to the arcuate portion of the track and connected to the frame proximal to the front portion of the frame relative to the arcuate portion, the hanger configured to inhibit movement of the guide beyond the arcuate portion of the track when the seating is being reclined; the hanger is substantially horizontal to form a discontinuous path where the hanger connects to the arcuate portion, the discontinuous path inhibiting movement of the guide from the arcuate portion of the track to the hanger; the track includes a horizontal portion proximate to the rear portion of the frame, the horizontal portion configured to vertically support the guide in order to support a weight of a user when the seating is in the upright position; the frame further includes a cross member, the cross member at least in part providing the connection between the track and the frame, the cross member positioned proximate to the rear portion of the frame relative to the track, the cross member configured to inhibit movement of the guide off the track as the guide moves toward the rear portion of the frame along the track when the seating is being moved into the upright position; the cross member is positioned the within an outer perimeter of the seating section and underneath the seating section when the seating rests on the surface; the seating further including an extension providing the connection between the guide and the seating section, the extension having a vertical length to elevate the seating section above the guide and provide sliding clearance between the seating section and the frame; the seating further including a bracket providing a connection between the guide and the extension; the guide is pivotally connected to the bracket to allow the guide to pivot relative to the bracket as the guide moves along the track; the bracket engages the guide with a bolt and nut assembly; tension formed by tightening the bolt and nut assembly can be adjusted to change friction between the guide and the track to adjust ease with which the seating moves between the upright and reclined positions; friction caused by the guide engaging the track can be adjusted based on a weight of a user to adjust ease with which shifting the weight of the user moves the seating between the upright and reclined positions; the seating further including an other track connected to the frame, the other track including a straight portion upwardly rising along an other guide path moving generally in the direction from the rear portion to the front portion of the frame, the other track more proximate to the front portion of the frame than the track; the seating further including an other guide connected to the seating section and slideably engaged with the other track, the other guide configured to move along the straight portion of the other track and to remain engaged with other track along the other guide path; as the seating is moved from the upright position to the reclined position and the other guide moves forward along the other track, the seating section moves toward the front portion of the frame and rises vertically relative to the frame; the other track is positioned within the outer perimeter of the seating section and underneath the seating section, proximate to the ground relative to the seating section, when the reclinable seating rests on the surface; and/or the chaise has a length sufficient to support a body of a user entirely off the surface when the user is in a prone position.

Various embodiments of this disclosure relate to a reclinable seating having an upright position (e.g. a first position) and a reclined position (e.g., a second position). The reclinable seating can include the following: a frame including a front portion and a rear portion, the frame configured to support the reclinable seating relative to a surface on which the seating rests; a backrest connected to the frame, the backrest configured to pivot relative to the frame; a seating section connected to the backrest, the seating section configured to pivot relative to the backrest; a track connected to the frame, the track positioned within an outer perimeter of the seating section and underneath the seating section, proximate to the ground relative to the seating section, when the seating rests on the surface; and a guide connected to the seating section and slideably engaging the track, the guide configured to move along the along the track and support the seating section against the track. The reclinable seating is moveable between an upright position and a reclined position, the backrest pivoting from being more vertical to less vertical relative to the surface from the upright position to the reclined position. The track pushes at least a portion of the seating section away from the surface while the seating is moved into the reclined position.

In some embodiments, the reclinable seating can include one or more of the following: while the track pushes the at least a portion of the seating section away from surface, the backrest pivots relative to seating section to be less vertical; the track includes an uprising portion that has an upward slope relative to the surface from the rear portion to the front portion of the frame; the track includes an arcuate portion that the guide vertically rises and moves forward on as the seating section travels forward toward the front portion of the frame while the seating is moved into the reclined position; the arcuate portion is substantially vertical proximate to the front portion of the frame such that the guide is substantially suspended on the arcuate portion in the reclined position and supports relatively less weight than when the guide is on other portions of the arcuate portion; the track further includes a hanger connected to the arcuate portion of the track and connected to the frame proximal to the front portion of the frame relative to the arcuate portion, the hanger configured to inhibit movement of the guide beyond the arcuate portion of the track when the seating is being reclined; the hanger is substantially horizontal to form a discontinuous path where the hanger connects to the arcuate portion, the discontinuous path inhibiting movement of the guide from the arcuate portion of the track to the hanger; the track includes a horizontal portion proximate to the rear portion of the frame, the horizontal portion configured to vertically support the guide in order to support a weight of a user when the seating is in the upright position; the frame further includes a cross member, the cross member at least in part providing the connection between the track and the frame, the cross member positioned proximate to the rear portion of the frame relative to the track, the cross member configured to inhibit movement of the guide off the track as the guide moves toward the rear portion of the frame along the track when the seating is being moved into the upright position; the cross member is positioned the within an outer perimeter of the seating section and underneath the seating section when the seating rests on the surface; the seating further includes an extension providing the connection between the guide and the seating section, the extension having a vertical length to elevate the seating section above the guide and provide sliding clearance between the seating section and the frame; the seating further includes a bracket providing a connection between the guide and the extension; the guide is pivotally connected to the bracket to allow the guide to pivot relative to the bracket as the guide moves along the track; the bracket engages the guide with a bolt and nut assembly; tension formed by tightening the bolt and nut assembly can be adjusted to change friction between the guide and the track to adjust ease with which the seating moves between the upright and reclined positions; friction caused by the guide engaging the track can be adjusted based on a weight of a user to adjust ease with which shifting the weight of the user moves the seating between the upright and reclined positions; the seating further includes an other track connected to the frame, the other track including a straight portion upwardly rising along an other guide path moving generally in the direction from the rear portion to the front portion of the frame, the other track more proximate to the front portion of the frame than the track; the seating further includes an other guide connected to the seating section and slideably engaged with the other track, the other guide configured to move along the straight portion of the other track and to remain engaged with other track along the other guide path; as the seating is moved from the upright position to the reclined position and the other guide moves forward along the other track, the seating section moves toward the front portion of the frame and rises vertically relative to the frame; the other track is positioned within the outer perimeter of the seating section and underneath the seating section, proximate to the ground relative to the seating section, when the reclinable seating rests on the surface; and/or the chaise has a length sufficient to support a body of a user entirely off the surface when the user is in a prone position.

Various embodiments of this disclosure relate to adjustable furniture with a support surface having a first resting position and a second resting position. The adjustable furniture can include the following: a frame including a front portion and a rear portion, the frame configured to support the adjustable furniture relative to a surface on which the furniture rests; a track connected to the frame, the track including an arcuate portion descending at a radius along at least a part of a guide path moving generally in a direction from the rear portion to the front portion of the frame; a guide engaging the track, the guide configured to move along the arcuate portion and to remain engaged with the track along the at least a part of the guide path; and a support surface connected to the guide, the support surface configured to move with guide as the guide moves along the guide path on the arcuate portion. The support surface is continuously moveable between a first resting position and a second resting position as the guide moves along the guide path on the arcuate portion. The support surface is in the first resting position when the guide is proximate to the rear portion of the frame. The support surface is in the second resting position when the guide is proximate to the front portion of the frame; the support surface in the second resting position is angled downwardly relative to the surface moving generally in the direction from the rear portion to the front portion of the frame.

In some embodiments, the adjustable furniture can include one or more of the following: a degree of downward angle between the support surface and the surface increases along the at least a part of the guide path as the support surface is moved from first resting position to the second resting position; the radius of descent of the arcuate portion is substantially constant along the at least a part of the guide path to increase a degree of downward angle between the support surface and the surface at an increasing rate as the support surface is moved from first resting position to the second resting position; the radius of descent decreases along the at least a part of the guide path moving generally in the direction from the rear portion to the front portion to increase a degree of downward angle between the support surface and the surface at an increasing rate moving in the direction along the at least a part of the guide path moving generally along the direction from the rear portion to the front portion; the support surface is angled relative to the surface when the support surface is in the first resting position; inclination of the support surface in the first resting position is opposite to inclination of the support surface in the second resting position; the support surface is substantially level with the surface when the support surface is in the first resting position; the support surface is inhibited from moving further generally in a direction from the front portion to the rear portion of the frame beyond the first resting position; the arcuate portion ascends at an other radius along at least another part of the guide path moving generally in the direction from the rear portion to the front portion of the frame; the at least a part of the guide path is proximate to the front portion of the frame, and the at least another part of the guide path is proximate to the rear portion of the frame; the radius and other radius are substantially equal; the radius decreases from the other radius along the guide path generally in the direction from the rear portion to the front portion of the frame; the adjustable furniture further including an other guide engaging the track that is engaged by the guide; the other guide is configured to move along the arcuate portion and to remain engaged with the track along the at least another part of the guide path; the track further includes a hanger connected to the arcuate portion of the track and connected to the frame proximal to the rear portion of the frame relative to the arcuate portion, the hanger configured to inhibit movement of the other guide beyond the arcuate portion of the track toward the rear portion of the frame when the support surface is in the first resting position; the hanger vertically ascends from the arcuate portion to the rear portion of the frame to form a discontinuous path where the hanger connects to the arcuate portion, the discontinuous path inhibiting movement of the guide from the arcuate portion to the hanger; the frame further includes a cross member, the cross member providing the connection between the track and the frame, the cross member positioned proximal to the front portion of the frame relative to the track, the cross member configured to inhibit movement of the guide off the track as the guide moves toward the front portion of the frame on the track when the support surface is being moved into the second resting position; the adjustable furniture further including an extension providing the connection between the guide and the support surface, the extension having a vertical length to elevate the support surface above the track to provide sliding clearance between the support surface and the track; the adjustable furniture further including a bracket providing a connection between the guide and the extension; the guide is pivotally connected to the bracket to allow the guide to pivot relative to the bracket as the guide moves along the arcuate portion of the track; the bracket engages the guide with a bolt and nut assembly; tension formed by tightening the bolt and nut assembly can be adjusted to change friction between the guide and the track to adjust ease with which the support surface moves between the first and second resting positions; friction caused by the guide engaging the track can be adjusted based on a weight of a user to adjust ease with which shifting the weight of the user moves the support surface between the first and second resting positions; an ottoman including the adjustable furniture; the support surface includes a foot rest; a seating including the adjustable furniture; the support surface includes a seat; the seating includes a backrest connected to frame, the backrest fixed relative to the frame while the support surface is continuously adjustable between the first resting position and the second resting position; the backrest and the support surface in the first resting position are substantially at a 90 degree angle to each other; the support surface is angled relative to the surface when the support surface is in the first resting position; and/or inclination of the support surface in the first resting position is opposite to inclination of the support surface in the second resting position Various embodiments of this disclosure relate to adjustable furniture with a rest having a first position and a second position. The adjustable furniture can include the following: a frame including a front portion and a rear portion, the frame configured to support the adjustable furniture relative to a surface on which the furniture rests; a guiderail connected to the frame, the guiderail including a curved portion that is convex from a perspective of the surface, the curved portion first ascending then descending along a guide path moving generally in a direction from the rear portion to the front portion of the frame; a guide assembly engaging the guiderail, the guide assembly configured to move along the curved portion and to remain engaged with the guiderail along the guide path; and a rest including a front part proximate to the front portion of the portion and a rear part proximate to the rear portion of the frame, the rest connected to the guide assembly, the rest configured to move with the guide assembly as the guide assembly moves along the guide path on the curved portion. The rest is continuously moveable between a first position and a second position as the guide assembly moves along the guide path on the curved portion. The rest is in the second position when the guide assembly is proximate to the front portion of the frame; the front part of the rest is vertically lower than the rear part of the rest when the rest is in the second position.

In some embodiments, the adjustable furniture can include one or more of the following: the front part of the rest lowers and rear part of the rest rises as the rest is moved to the second position and the guide moves along at least a part of the guide path; the curved portion has substantially a same convex shape along the guide path to impart an increasing rate of descent to the front portion of the rest as the guide assembly moves along the guide path on the curved portion; the curved portion has a generally convex shape with a decreasing radius along at least a part of the guide path moving generally in the direction from the rear portion to the front portion of the frame to impart an increasing rate of descent to the front portion of the rest as the guide assembly moves along the at least a part of the guide path on the curved portion; the rest is angled relative to the surface when the rest is in the first position; inclination of the rest in the first position is opposite to inclination of the rest in the second position; the rest is substantially level with the surface when the rest is in the first position; the rest is inhibited from moving further generally in a direction from the front portion to the rear portion of the frame beyond the first position; the adjustable furniture an other guide assembly engaging the guiderail that is engaged by the guide assembly; the guide descends on the curved portion of the guiderail along the guide path while the other guide ascends on the curved portion of the guiderail along the guide path when the rest is moved from the first position to the second position; the guiderail further includes a hanger connected to the curved portion of the track and connected to the frame proximal to the rear portion of the frame relative to the curved portion, the hanger configured to inhibit movement of the other guide assembly beyond the curved portion of the guiderail toward the rear portion of the frame when the rest is in the first position; the hanger is connected to the curved portion at an angle relative to the guide path to form a discontinuous path inhibiting movement of the guide assembly from the curved portion to the hanger; the frame further includes a cross member, the cross member providing the connection between the guiderail and the frame, the cross member positioned proximal to the front portion of the frame relative to the track, the cross member configured to inhibit movement of the guide assembly off the guiderail as the guide assembly moves toward the front portion of the frame along the guide path on the curved portion when the rest is being moved into the second position; the adjustable furniture further including an extension providing the connection between the guide assembly and the rest, the extension having a vertical length to elevate the rest above the guiderail to provide sliding clearance between the rest and the guiderail; the adjustable furniture further including a bracket providing a connection between the guide assembly and the extension; the guide assembly is pivotally connected to the bracket to allow the guide assembly to pivot relative to the bracket as the guide assembly moves along the curved portion of the guiderail; the bracket engages the guide assembly with a bolt and nut assembly; tension formed by tightening the bolt and nut assembly can be adjusted to change friction between the guide assembly and the guiderail to adjust ease with which the rest moves between the first and second positions; friction caused by the guide assembly engaging the guiderail can be adjusted based on a weight of a user to adjust ease with which shifting the weight of the user moves the rest between the first and second positions; the guide assembly includes a first sliding shoe and a second sliding shoe, the first and second sliding shoes, when assembled, forming an opening to slideably engage the guiderail; an ottoman including the adjustable furniture; the rest includes a foot rest; a seating including the adjustable furniture; the rest includes a seat; the seating includes a backrest connected to frame, the backrest fixed relative to the frame while the rest is continuously adjustable between the first position and the second position; the backrest and the rest in the first position are substantially at a 90 degree angle to each other; the rest is angled relative to the surface when the rest is in the first position; and/or inclination of the rest in the first position is opposite to inclination of the rest in the second position.

Various embodiments of this disclosure relate to adjustable furniture with a rest having a first resting position and a second resting position. The adjustable furniture can include the following: a frame including a front portion and a rear portion, the frame configured to support the adjustable furniture relative to a surface on which the furniture rests; a first guiderail connected to the frame, the first guiderail including a first curved portion that is convex from a perspective of the surface, the first curved portion ascending then descending along a first guide path moving generally in a direction from the rear portion to the front portion of the frame; a first guide assembly engaging the first guiderail, the first guide assembly configured to move along the first curved portion and to remain engaged with the first guiderail along the first guide path; a second guide assembly engaging the first guiderail, the second guide assembly configured to move along the first curved portion and to remain engaged with the first guiderail along the first guide path, the second guide assembly proximate to the rear portion of the frame relative to the first guide assembly; a second guiderail connected to the frame, the second guiderail including a second curved portion that is convex from the perspective of the surface, the second curved portion ascending then descending along a second guide path moving generally in the direction from the rear portion to the front portion of the frame; a third guide assembly engaging the second guiderail, the third guide assembly configured to move along the second curved portion and to remain engaged with the second guiderail along the second guide path; a fourth guide assembly engaging the second guiderail, the fourth guide assembly configured to move along the second curved portion and to remain engaged with the second guiderail along the second guide path, the fourth guide assembly proximate to the rear portion of the frame relative to the third guide assembly; and a rest connected to the first, second, third, and fourth guide assemblies, the rest configured to move with the first, second, third, and fourth guide assemblies as the first, second, third, and fourth guide assemblies move along the first and second guide paths on the first and second curved portions. The rest is continuously moveable between a first resting position and a second resting position as the first, second, third, and fourth guide assemblies move along the first and second guide paths on the first and second curved portions. The rest is fully supported by the first, second, third, and fourth guide assemblies. For example, the rest does not contact any other portions or parts of the adjustable furniture. As another example of an embodiment, the rest is fully supported by only the first, second, third, and fourth guide assemblies without a connection or contact with, for example, a backrest.

In some embodiments, the adjustable furniture can include one or more of the following: a front part of the rest lowers and a rear part of the rest raises as the rest is moved into the second resting position; the rest includes a front portion proximate to the front portion of the frame and a rear part proximate to the rear portion of the frame; the first and second curved portions have substantially a same convex shape along the first and second guide paths to impart an increasing rate of descent to the front portion of the rest as the first and third guide assemblies move along the first and second guide paths on the first and second curved portions; the rest includes a front portion proximate to the front portion of the frame and a rear part proximate to the rear portion of the frame; the first and second curved portions have a generally convex shape with a decreasing radius along at least a part of the first guide path and at least a part of the second guide path moving generally in the direction from the rear portion to the front portion of the frame to impart an increasing rate of descent to the front portion of the rest as the first and third guide assemblies move along the at least parts of the first and second guide paths on the first and second curved portions; the rest is angled relative to the surface when the rest is in the first resting position; inclination of the support surface in the first resting position is opposite to inclination of the support surface in the second resting position; the rest is substantially level with the surface when the support surface is in the first resting position; the rest is inhibited from moving further generally in a direction from the front portion to the rear portion of the frame beyond the first resting position; the first and second guiderails further include first and second hangers, respectively, connected to the first and second curved portions, respectively, and connected to the frame proximal to the rear portion of the frame relative to the first and second curved portion, the first and second hangers configured to inhibit movement of the second and fourth guide assemblies beyond the first and second curved portions toward the rear portion of the frame when the rest is in the first resting position; the first and second hangers are connected to the first and second curved portions at an angle relative to the first and second guide paths to form discontinuous paths inhibiting movement of the second and fourth guide assemblies from the first and second curved portions to the first and second hangers; the frame further includes a cross member, the cross member providing the connection between the first and second guiderails and the frame, the cross member positioned proximal to the front portion of the frame relative to the first and second guiderails, the cross member configured to inhibit movement of the first and third guide assemblies off the track as the first and second guide assemblies move toward the front portion of the frame along the first and second guide paths on the curved portion when the rest is being moved into the second resting position; the adjustable furniture further including including first, second, third, and fourth extensions providing the connections between the first, second, third, and fourth guide assemblies and the rest, respectively, the first, second, third, and fourth extensions having a vertical length to elevate the rest above the first and second guiderails to provide sliding clearance between the rest and the first and second guiderails; the adjustable furniture further including first, second, third, and fourth brackets providing a connection between the first, second, third, and fourth guide assemblies and the extension, respectively; the first, second, third, and fourth guide assemblies are pivotally connected to the first, second, third, and fourth brackets to allow the first, second, third, and fourth guide assemblies to pivot relative to the first, second, third, and fourth brackets, respectively, as the first, second, third, and fourth guide assemblies move along the first and second curved portions of the first and second guiderails; at least one of the first, second, third, and fourth brackets engages the first, second, third, and fourth guide assemblies, respectively, with a bolt and nut assembly; tension formed by tightening the bolt and nut assembly can be adjusted to change friction between at least one of the first, second, third, and fourth guide assemblies and at least one of the first and second guiderails to adjust ease with which the rest moves between the first and second resting positions; friction caused by at least one of the first, second, third, and fourth guide assemblies engaging at least one of the first and second guiderails can be adjusted based on a weight of a user to adjust ease with which shifting the weight of the user moves the rest between the first and second resting positions; at least one of the first, second, third, and fourth guide assemblies includes a first sliding shoe and a second sliding shoe, the first and second sliding shoes, when assembled, forming an opening to engage at least one of the first and second guiderails; an ottoman including the adjustable furniture; the rest includes a foot rest; a seating including the adjustable furniture; the rest includes a seat; the seating includes a backrest connected to frame, the backrest fixed relative to the frame while the rest is continuously adjustable between the first resting position and the second resting position; the backrest and the rest in the first resting position are substantially at a 90 degree angle to each other; the rest is angled relative to the surface when the rest is in the first resting position or the second resting position; and/or inclination of the rest in the first resting position is opposite to inclination of the rest in the second resting position.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings. The associated descriptions are provided to illustrate embodiments and not to limit the scope of the disclosure.

DETAILED DESCRIPTION

Figure 1A:
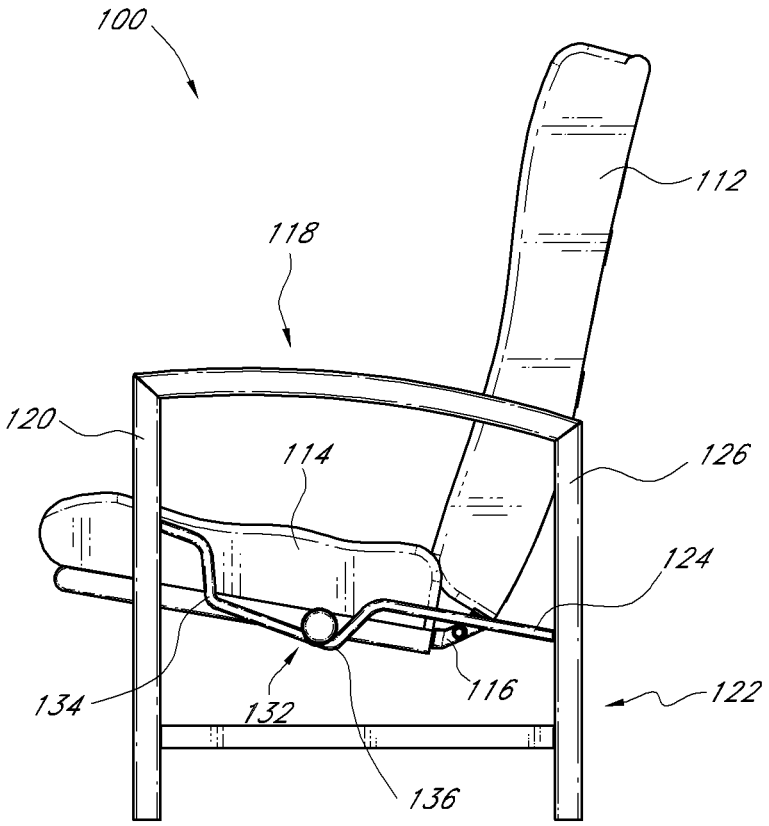
FIG. 1A is a side view of reclinable seating in an upright position.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and made a part of this disclosure.

Example Embodiment of a Chair

Figure 1B:
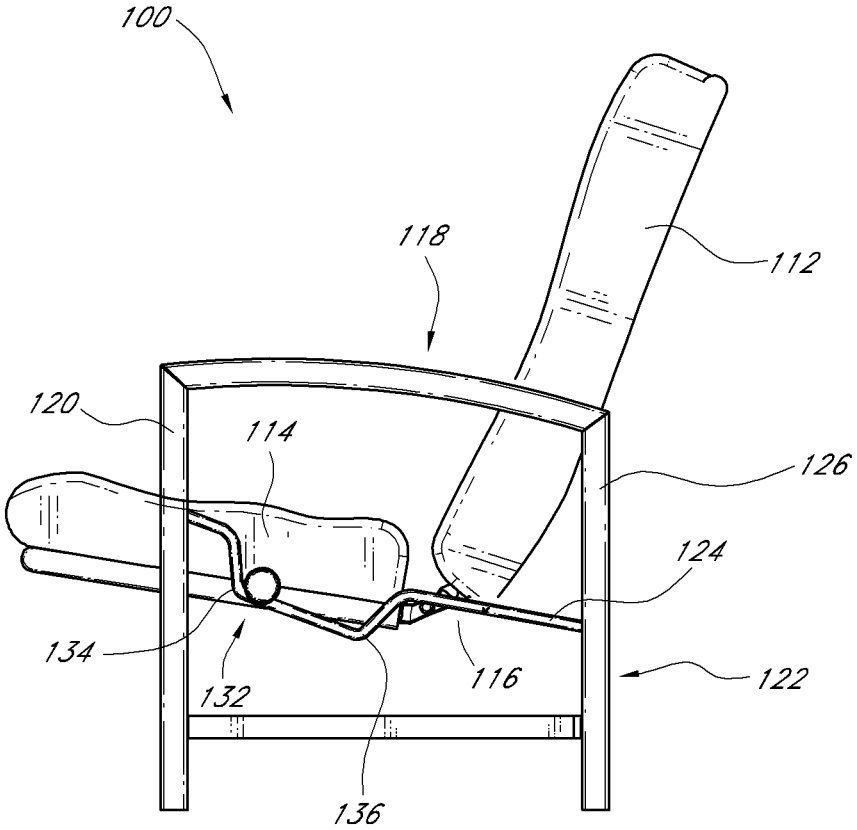
FIG. 1B is a side view of the reclinable seating in a fully reclined position.

An example embodiment of reclinable seating 100 is shown in FIG. 1A and FIG. 1B. In this example, the seating 100 is a chair. However, the seating 100 can be integrated into a variety of formal and casual, indoor and outdoor seating options, such stationary or swivel rockers or chairs, lounge chairs, action loungers or swivel action loungers, chaise loungers, settees, love seats, couches, and the like.

The seating 100 includes a backrest 112 portion that is configured to recline from an "upright" position, as shown in FIG. 1A, to a "fully reclined" position, as shown in FIG. 1B. For more formal dining-type seating, the backrest 112 can be in the range of about 102° to 122° (e.g., around 110°) relative to the ground in the upright position and in the range of about 123° to 143° (e.g., around 133°) relative to the ground in the fully reclined position. For lounge-type seating, the backrest 112 can in the range of about 104° to 124° (e.g., around 113°) relative to the ground in the upright position and in the range of 135° to 155° (e.g., around 145°) relative to the ground in the fully reclined position. The seat 114 is generally in the range of 9° to 16° relative to the ground in the upright position for dining- and deep-type seating. The seat angle for the fully reclined position will be discussed in more detail below.

Figure 2:
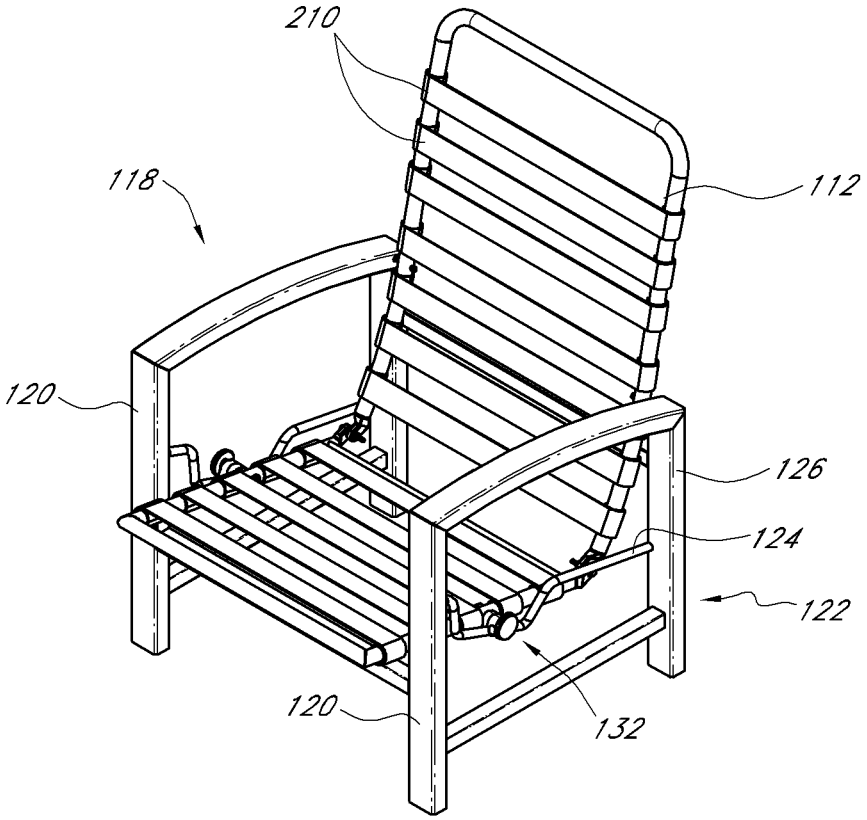
FIG. 2 is a front-perspective view of the reclinable seating including supportive straps on the seat and backrest.

The seating 100 is continuously adjustable, in that a user can position the backrest 112 at any point between upright and fully reclined. The seating 100 also includes a seat 114 portion. Cushioning can be provided on the seat 114 and/or backrest 112. However, such cushioning is optional. As shown in FIG. 2, for instance, the seat 114 and backrest 112 can include transverse straps 210 engaged around supportive tubing. As additional examples, the seat and backrest can include a fabric or mesh sling, woven straps, or a solid cast material. Sling, strap, and cast seating are known in the art, and the seating disclosed herein can be integrated with each.

With reference to FIG. 1A, the seat 114 can be connected to the backrest 112 at the rear of the seat 114, for example, using a hinge, pin, rod, or other suitable pivot 116, so that the seat 114 can move relative to the backrest 112.

Figure 3A:
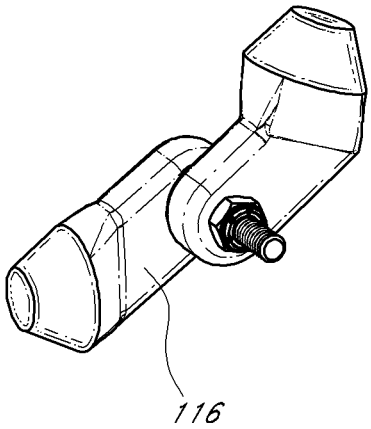
FIGS. 3A and 3B are front-perspective views of the inner and outer surfaces of the pivot connection between the backrest and seat in the reclinable seating.
Figure 3B:
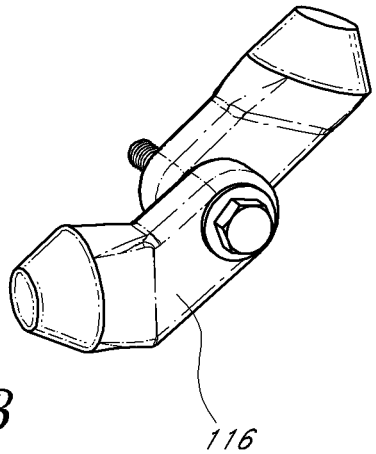

An example pivot 116 is shown in greater detail in FIG. 3A, which shows the pivot 116 from the inside-out, and FIG. 3B, which shows the pivot 116 from the outside-in.

With reference to FIG. 1A, a frame 118 is disposed around the backrest 112 and seat 114. The example frame 118 includes a front member 120, rear members 122, and a track 124.

Figure 4:
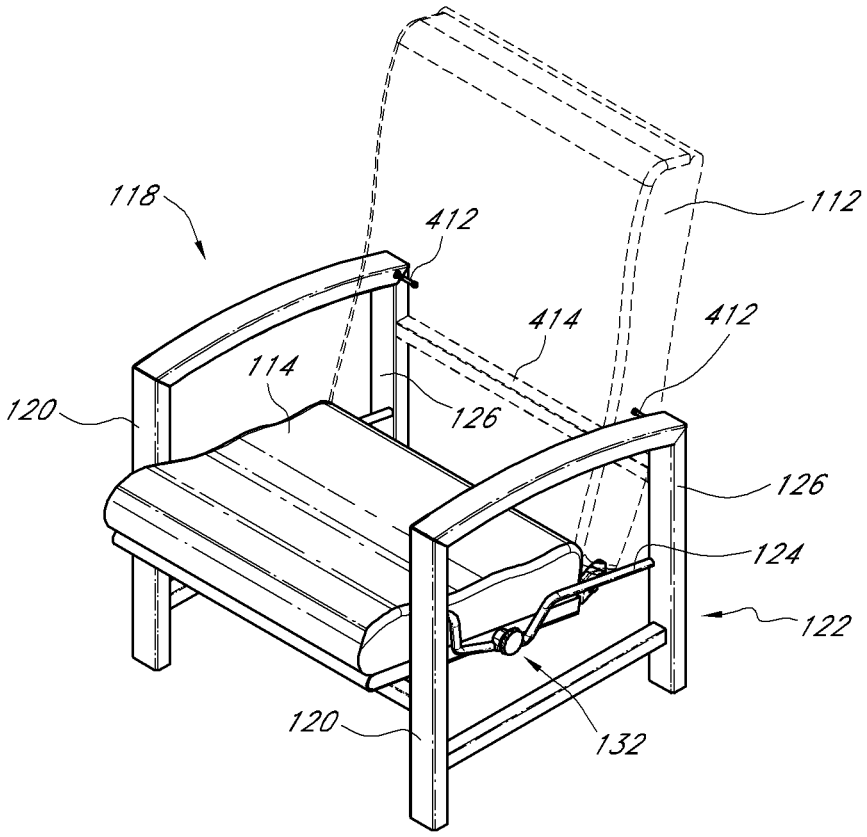
FIG. 4 is a front-perspective view of the reclinable seating in an upright position.
Figure 8:
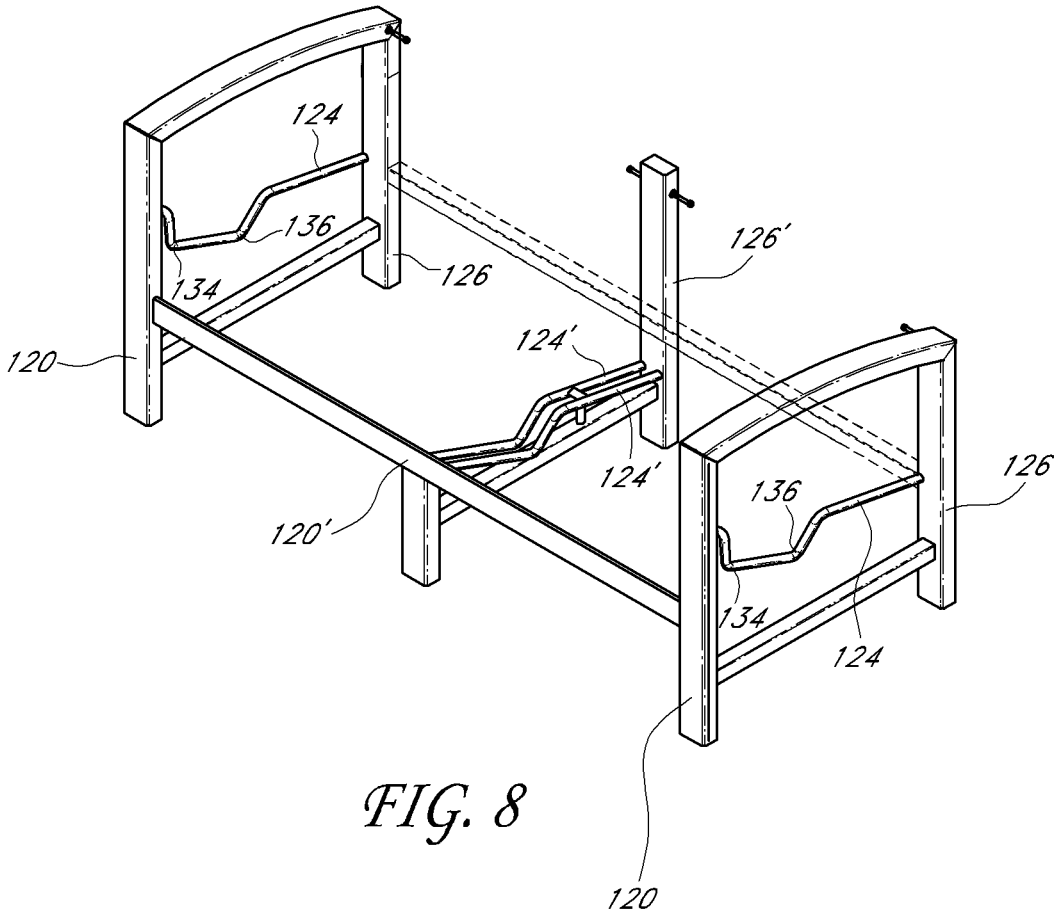
FIG. 8 shows a front-perspective view of an example frame for a love seat including the reclinable seating.

The front member 120 is located near the front of the seat 114. Conventional framing components known in the art can be used for the front member 120. For instance, a front arm post or other suitable generally upright framing component can be used, as shown in FIG. 1A. As shown in FIG. 4, two front members 120 can extend upward at a 90° angle relative to the ground. However, any generally upright angle is suitable for use herein. For instance, two front members can be generally trapezoidal relative to each other. Alternatively, a generally horizontal front rail or other non-upright framing component can be used. A front rail 120' is shown in FIG. 8, which is discussed in more detail below. Materials commonly used for framing are woods, such as teak, cedar, oak, or the like, metals, such as aluminum, steel, iron, or the like, or synthetic polymers, such as heavy-duty plastics and composites. These materials are suitable for use in the embodiments disclosed herein.

Referring again to FIG. 1A, the rear members 122 are located near the rear of the seat 114. In this example, the rear members 122 include a first rear member 126 and a second rear member 412, which is omitted from FIG. 1A, but shown in the perspective view of FIG. 4. Again, conventional framing components can be used for the rear members 122, and the first rear member can be positioned at any suitable angle. For example, the first rear member 126 can include a generally upright member, such as a back upright slat, or a back arm post, as shown in FIG. 1A. A back rail, crest rail, or other generally horizontal framing component, such as the back rail 414 in FIG. 4, is also suitable. Other irregular angles, such as trapezoidal angles, are also suitable for use.

In the example embodiment of FIG. 4, a second rear member 412 extends substantially horizontally, e.g., generally perpendicularly, from the first rear member 126. The second rear member 412 is configured to provide support for the backrest 112, and to provide a pivot connection to the frame 118 that allows the backrest 112 to move in relation to the seat 114. The second rear member 412 can include a hinge, pin, rod, ball and socket, or other suitable pivot connection adjoined to or passing through the backrest 112.

As explained above, the second rear member 412 provides a pivotal connection to the backrest 112. However, the second rear member 412 could be removed, and the back rail 414 or crest rail extending perpendicularly from the first rear member 126 could serve a similar function. In such an embodiment, the backrest 112 does not pivot about a connection to the frame 118. Rather, the backrest 112 would abut the frame 118 at the back rail 414, and pivot about the abutment.

Returning again to FIG. 1A, a track 124 extends from the front member 120 toward (that is, in the direction of) the rear members 122. Preferably, the track 124 adjoins both the front member 120 and the first rear member 126, but it need not do so. For instance, the track 124 could contact the front member 120 and the ground.

Figure 5:
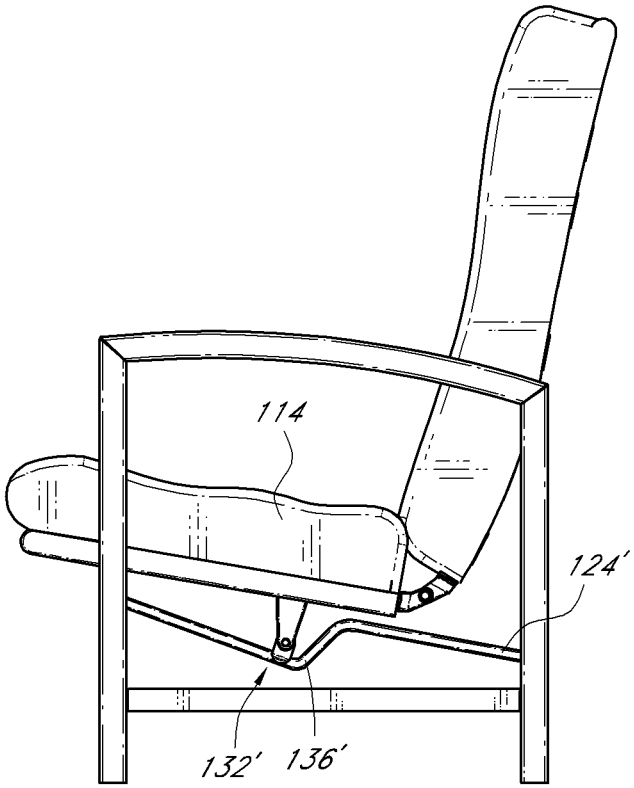
FIG. 5 is a side view of the reclinable seating showing an alternative position for the guide assembly.

A guide assembly 132 is configured to support the seat 114 on the track 124. In FIG. 1A, the guide assembly 132 extends laterally from the side of the seat 114 and engages a portion of the track to the side of the seat 114. An alternative configuration for the guide assembly 132' is shown in FIG. 5. In that example, the guide assembly 132' extends downwardly from the seat 114 and engages a portion of track 124' underneath the seat 114. Such a track-and-guide assembly configuration can be advantageously incorporated into seating lacking one or more armrests, as explained in detail below.

Figure 6:
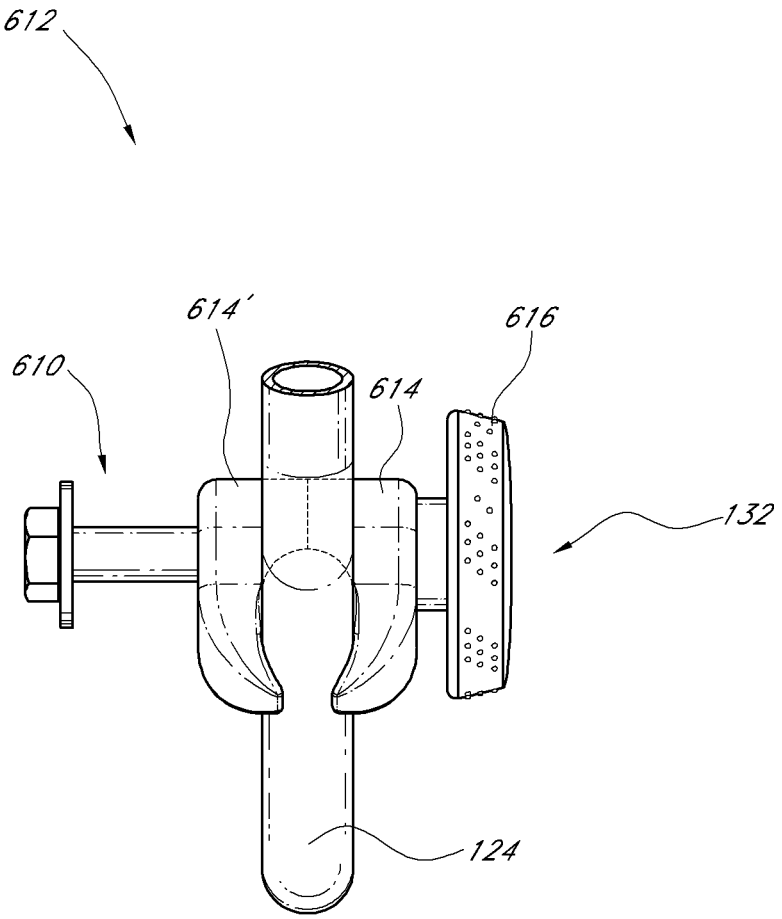
FIG. 6 is a bottom-perspective view of a track and guide assembly used in the reclinable seating.
Figure 7:
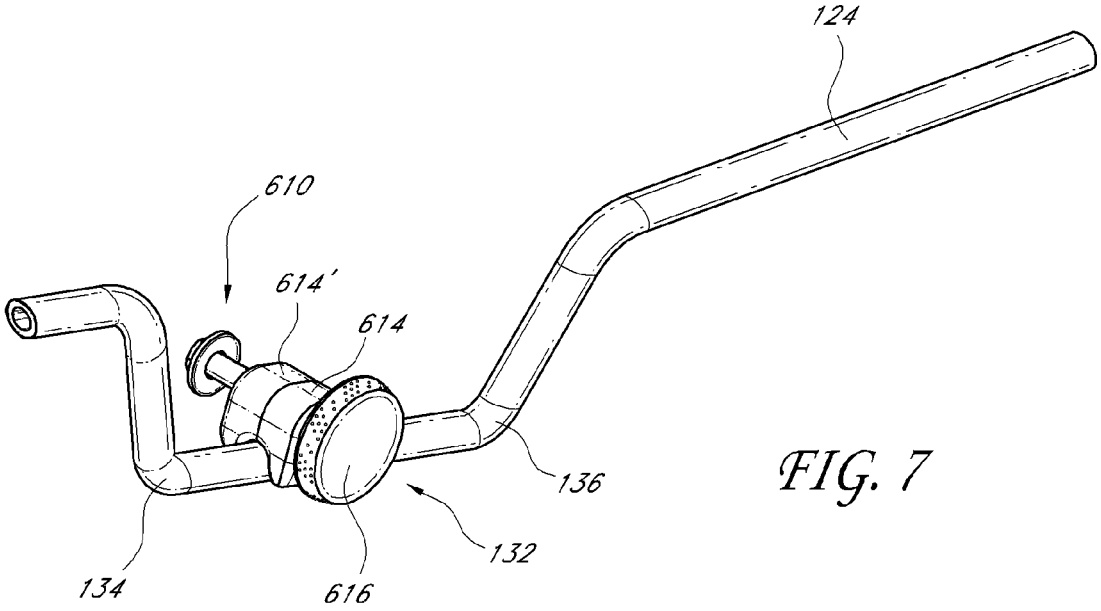
FIG. 7 is a side-perspective view of a track and guide assembly used in the reclinable seating.

An example guide assembly 132 is shown in greater detail in FIG. 6 and FIG. 7. In this example, the guide assembly 132 includes a connector portion 610 that is fixedly attached to the seat. Suitable methods for attaching the connector portion 410 and the seat are known in the art and include screwing, bolting, and so on. The guide assembly 132 also includes a slide portion 612, including a device such as a slide shoe or cylinder, which is slideably engaged with the track 124. In this example, the slide portion 612 includes a first half slide shoe 614 and a second half slide shoe 614' engaged around the track 124. At least the inner surfaces of the first half slide shoe 614 and the second half slide shoe 614' are made of a durable material having a low coefficient of friction with the track 124. The coefficient of friction should be sufficiently low to permit the slide portion 612 to easily slide on the track 124 when the user changes his or her center of gravity on the seating 100. Furthermore, the material should be sufficiently durable to withstand repeated use under heavy loads. DELRIN®, a polyoxymethylene plastic originally manufactured by DuPont, which is hard, yet has a dynamic coefficient of friction against steel in the range of about 0.19 to 0.41, has been used successfully. However, a variety of durable, low-friction materials, such as compositions of rubbers, resins and plastics (e.g., PTFE, HDPE, TEFLON®), ceramics (e.g., BN), metals (bronze, Mb), and/or graphite are also contemplated for use in the slide portion 612.

In certain embodiments, the guide assembly 132 also includes a frictional control 616, such as a knob, that permits a user to increase the amount of friction between the slide portion 612 and the track 124. In this example, the frictional control 616 is in the form of a wheel. However, alternative knobs, such as a bar, cubical or spherical member, and the like are also suitable for use. In the embodiment of FIG. 6 and FIG. 7 the frictional control 616 increases the tightness of the first half slide shoe 614 and a second half slide shoe 614' around the track 124. Preferably, the frictional control 616 is adjusted so that the amount of friction between the slide portion 612 and the track 124 is large enough such that a user, sitting relatively still in an equilibrium position, will not cause the slide portion 612 to slide along the track 124. However, the adjustment will preferably keep the coefficient sufficiently low, such that when the user shifts his or her center of gravity, the slide portion 612 will slide along the track 124 in response to the shift.

As the slide portion 612 slides along the track 124 in response to changes in the user's center of gravity, the seat and backrest will move accordingly to accommodate the user's position. Thus, once the user adjusts the frictional control 616 to the user's specific body weight, the seating will adjust itself to various positions simply by the user shifting his or her weight.

After the initial adjustment, the frictional control 616 no longer needs to be adjusted. However, the frictional control 616 can be adjusted at any time to "lock" the seating 100 into a particular position by increasing the coefficient of friction between the track 124 and the slide portion 612, such that the slide portion 612 will not move if the user changes his or her center of gravity.

Although the frictional control 616 advantageously permits a high degree of customization to a user's particular weight and center of gravity, it is optional. For example, the materials and configuration of the slide portion 612 can be selected to provide a coefficient of friction that is sufficiently high to permit the slide portion 612 to hold its position when the user stops changing his or her center of gravity for a majority of users, for example, assuming a normal distribution around an average user weight of about 180 lbs. (81.6 kg). This configuration would advantageously allow the seating to hold an equilibrium position until application of force, as described above, for most users. Materials such as DELRIN® have been found to function without such a frictional control 616. Such a configuration could be advantageously employed in, for example, the middle section(s) of a couch in which a frictional control is not easily reachable by the occupant; however, it can be employed in any furniture configuration embodying the disclosed seating.

With reference again to FIG. 1A and FIG. 1B, as the seating 100 moves from the upright position (FIG. 1A) to the fully reclined position (FIG. 1B), the rear portion of the seat 114 begins to lift upward, because the rear portion of the seat 114 is pivotally connected to the backrest 112, which itself is rotatably connected to the frame 118. It was discovered, however, that a user's comfort can be improved if the angle of the seat 114 relative to the ground is maintained in the range of 8° to 22° when the backrest 112 is fully reclined. Maintaining such an angle decreases a user's desire to elevate his or her knees when seated in a reclined position if the angle is too steep or, conversely, obviates the user's feeling of sliding off the seat if the angle is too shallow. Thus, certain embodiments include the realization that reclinable seating 100 should increase vertical distance between the front of the seat 114 and the ground as the backrest 112 reclines, to improve user comfort. Accordingly, some preferred embodiments of the invention seek to enhance comfort of and convenience of use for the user by configuring the seating such that, in use, the front of the seat portion will rise. The plane or angle of the seat portion, with respect to its front, may decrease with respect to the floor or ground as the seating is reclined, or the plane or angle may remain relatively constant.

An example method for increasing the vertical distance between the front portion of the seat 114 and the ground as the backrest 112 reclines is explained below. As shown in FIG. 1A, at least a portion of the track 124 slopes downward, with the higher portion of the slope toward the front member 120 and the lower portion of the slope toward the rear members 122. The guide assembly 132 is engaged with the track 124 within this downward-sloping portion of the track 124. When the backrest 112 is in the upright position, as in FIG. 1A, the guide assembly 132 is engaged with the track 124 near the bottommost portion of the slope. As the backrest 112 reclines, the guide assembly 132 slides up the slope. When the backrest 112 is fully reclined, as in FIG. 1B, the guide assembly 132 is engaged with the track 124 near the topmost portion of the slope. Such a configuration increases the vertical distance between the front of the seat 114 and the ground as the backrest 112 reclines, permitting the seat 114 to have an angle of 9° to 16° (from the rear of the seat 114 or pivot 116) relative to the ground when the backrest 112 is upright, and an angle relative to the ground in the range of 8° to 22° (from the rear of the seat 114 or pivot 116) when the backrest 112 is fully reclined. This configuration advantageously improves a user's comfort throughout the range of movement of the seating 100.

For a user's safety and/or comfort, it can be desirable to limit the seating 100 movement. As explained above, the rear portion of the seat 114 lifts as the backrest 112 reclines. This motion causes the front portion of the seat 114 to move laterally outward (that is, in a direction away from the backrest). It can be desirable to limit this forward lateral travel to between about 3 in. (7.62 cm) and 8 in. (20.32 cm), for example, to about 4¾ in. (12.07 cm) of forward lateral travel for dining-type seating or about 6.375 in. (16.19 cm) of forward lateral travel for deep-type seating. As another example, it can also be desirable to limit the backward lateral travel of the seat 114 (that is, travel toward the direction of the backrest 112). As the seat 114 moves backward, toward the backrest 112, the backrest 112 will move forward toward the seat 114. If this motion were not limited, the backrest 112 and seat 114 could fold together, which raises a potential safety concern.

Thus, the track 124 can include stops that limit the range of movement of the backrest 112 and/or seat 114. An example of a stop is an upward-projecting member in the track 124, such as an upward-projecting bend. The example of FIG. 1A includes two upward-projecting bends, a front bend 134 and a back bend 136. The example of FIG. 5 includes one upward-projecting bend, a back bend 136. The guide assembly 132 cannot travel up the steep angle between the upward-projecting bends and the lower portion of the track 124. Thus, the front bend 134 limits the forward lateral travel of the seat 114. Without, for example, a front bed 134 as illustrated in FIG. 5, forward lateral travel of the seat 114 can be limited by the guide assembly 132 not being travel off the track 124' beyond a connection point to a member of the frame as discussed herein. The limitation upon lateral travel of the seat 114 also results in a limitation upon the amount that the backrest 112 reclines. Consequently, the front bend also defines the fully reclined backrest 112 position. The back bend 136, limits the backward lateral travel of the seat 114 (and, consequently, defines the upright backrest 112 position). One or more of these bends can be eliminated if no limitation on the forward and/or backward lateral movement of the seat 114 is desired, other than the limitations created by the pivot connections described herein. Moreover, alternative stops can be employed, such as solid stoppers placed along the track 124. The guide assembly 132 and track 124, including the front bend 134 and back bend 136 is shown in greater detail in FIG. 7.

Figure 9:
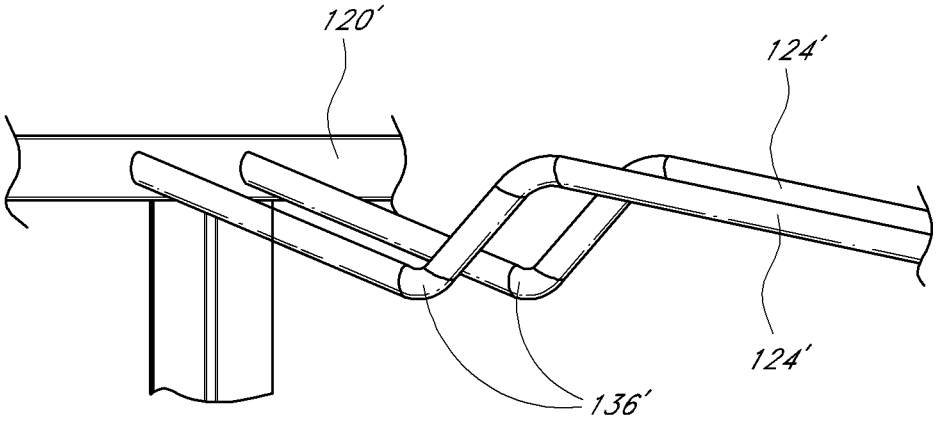
FIG. 9 shows a rear-perspective view of the connection between the inner tracks and the front member of the frame in the example frame of FIG. 8.

Frame components for a couch or loveseat are shown in FIG. 8. The example loveseat has outer armrests, but lacks inner armrests. The sides of the frame include outer tracks 124 extending between upright front members 120 and upright first rear members 126. The side tracks 124 include a front bend 134 and a back bend 136. The center of the frame includes inner tracks 124' extending between a laterally-extending front member 120' and an upright first rear member 126'. FIG. 9 shows a detailed rear-perspective view of the connection between the inner tracks and the front member 120' of the frame. The track 124' includes back bend 136. As illustrated, the track 124' can be directly connected to the front member 120' without a front bend. A seat and backrest can be engaged with the frame, as described above, between each set of inner and outer tracks. The assembled loveseat would thus include a pair of reclining seats and backrests. In the example of FIG. 8, downwardly-extending guide assemblies can be installed on the bottom of the seats to engage the inner tracks 124' as discussed herein, while laterally-extending guide assemblies can be installed on the sides of the seats to engage the outer tracks 124 as discussed herein. When so installed, the front bends 134 of the outer tracks 124 would limit the forward travel of the seats. A three-person couch can be constructed by adding one or more additional seats and backrests between two outer seats and backrests. The additional seats and backrests can be reclinable or stationary.

Example Embodiment of a Chaise

Another example embodiment of reclinable seating 1100 is shown in FIGS. 10-13. In this example, the seating 1100 is a chaise. However, the seating 1100 can be integrated into a variety of formal and casual, indoor and outdoor seating options, such stationary or swivel rockers or chairs, lounge chairs, action loungers or swivel action loungers, chaise loungers, settees, love seats, couches, and the like.

Figure 10:
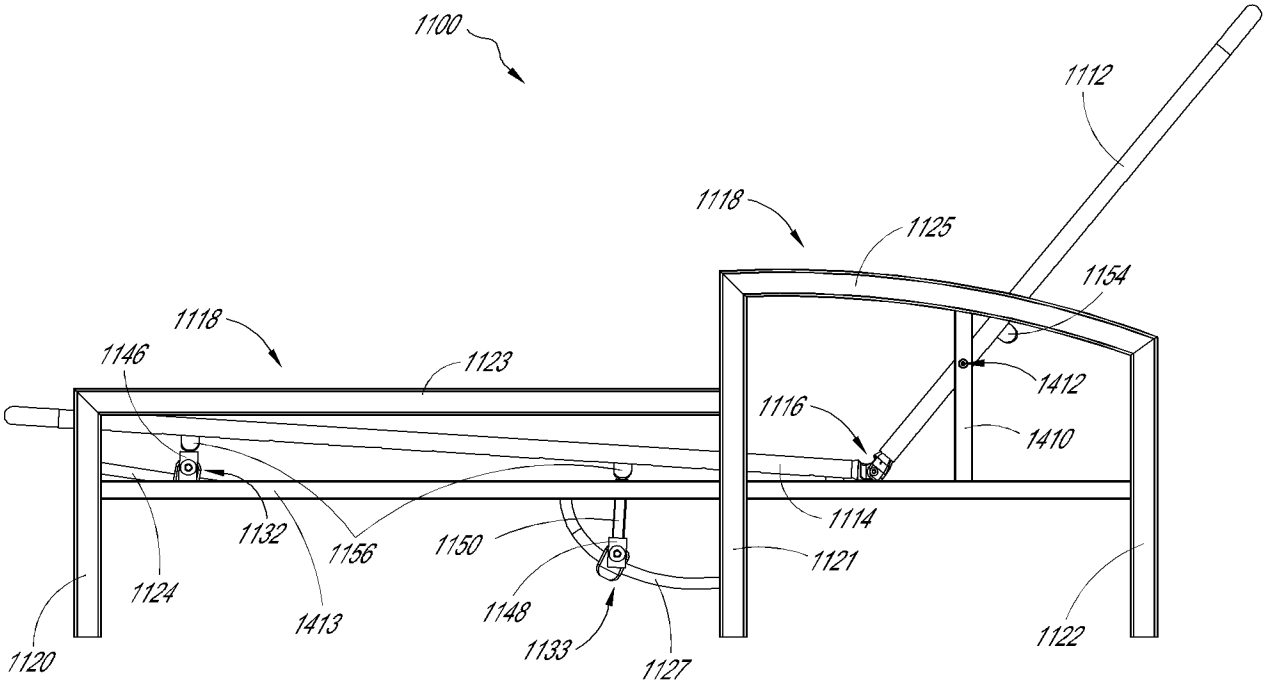
FIG. 10 is a side view of an embodiment of the reclinable seating.
Figure 11:
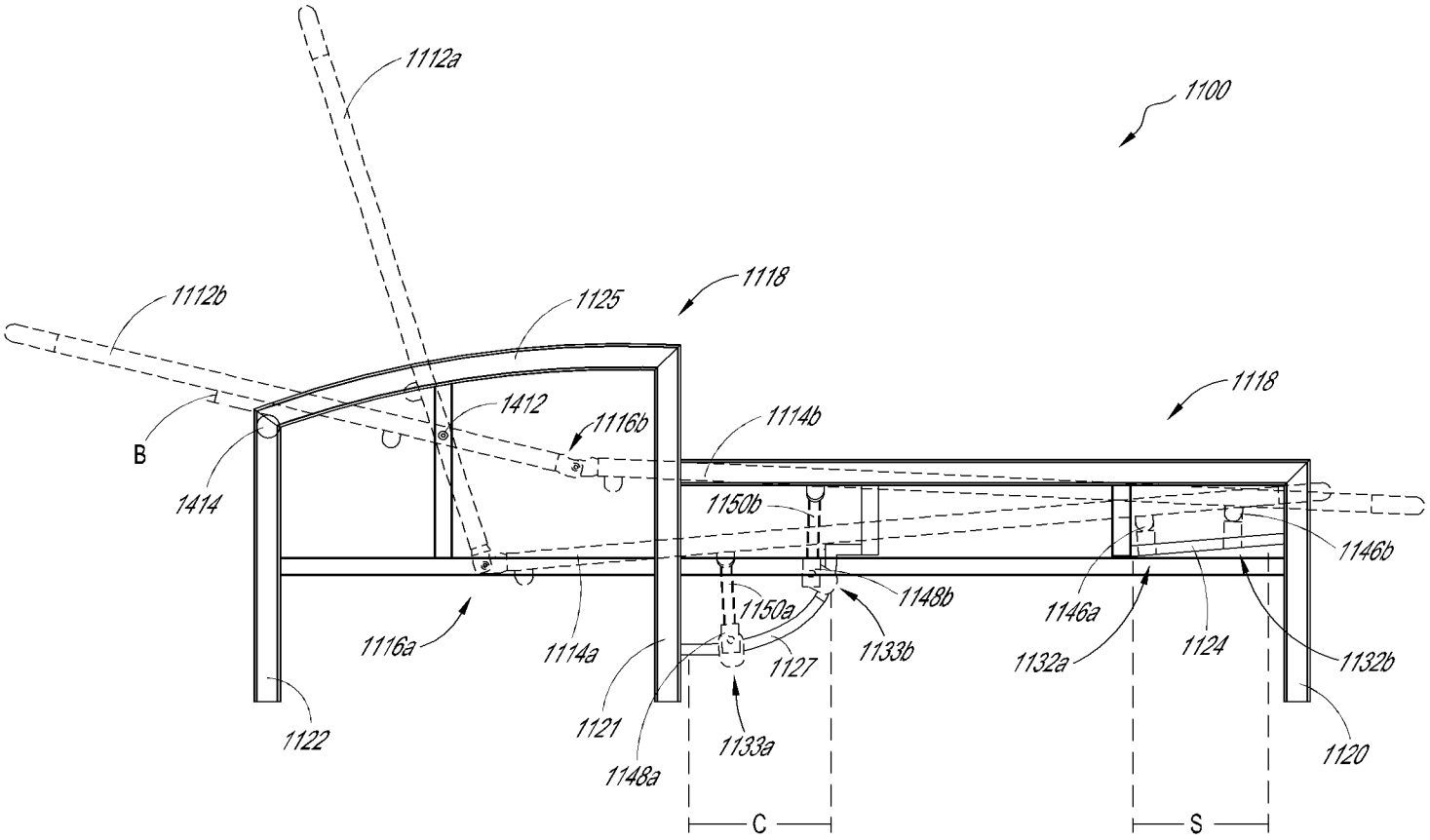
FIG. 11 is a side view of an embodiment of the reclinable seating in various positions.

FIGS. 10 and 11 are side views of an embodiment of the reclinable seating 1100. FIG. 11 is a side view illustrating the seating in various positions. The seating 1100 includes a backrest 1112 portion that is configured to recline from an "upright" position to a "reclined" position. FIG. 11 illustrates two out of many possible positions for the seating

1100. The backrest 1112 is connected to a seating section or bed 1114 via a pivot connection 1115. An example upright position versus an example reclined position is illustrated by features of the reclinable seating 1100 having either an "a" or "b", respectively, added to the corresponding feature numerals in FIG. 11. The seating 1100 can move beyond the example upright and reclined positions such as, for example, into a more fully upright position and a more fully reclined position, or other positions therebetween. Specifically, in the upright position, the backrest 1112*a* can be in a nearly or substantially vertical position, while the bed or seating section 1114*a* can be in an inclined position (slope upwards) with respect to the ground from the pivot connection 1116*a* to the front of the bed 1112*a*. In the reclined position, the backrest 1112*b* can be in a nearly or substantially horizontal (e.g., flat) position (lesser upward slope relative to the backrest 1112*a* in the upright position), while the bed 1114*b* can also be in a horizontal (e.g., flat) position (lesser upward slope relative to the bed 1114*a* in the upright position). In some embodiments, the bed 1114*b* can be substantially level with the ground in the reclined position. As illustrated in FIG. 11, the bed 1114*b* in the reclined position can slope downwards from the pivot connection 1116*b* as discussed in further detail herein.

In some embodiments, the backrest 1112*a* can be in the range of about 90° to 122° (e.g., around 110°, and including about 100° to 115° and about 105° to 110°, including the aforementioned values and bordering ranges) relative to the ground in the upright position measured from the pivot connection 1116*a*. The backrest 1112*b* can be in the range of about 105° to 180° (e.g., around 133°, and including about 120° to 160° and about 130° to 150°, including the aforementioned values and bordering ranges) relative to the ground in the reclined position measured from the pivot connection 1116*b*. In some embodiments, the backrest 1112*a* can in the range of about 92° to 124° (e.g., around 113°, and including about 100° to 115° and about 105° to 110°, including the aforementioned values and bordering ranges) relative to the ground in the upright position measured from the pivot connection 1116*a* for example, in lounge-type or deep-type of seating. For lounge-type seating, the backrest 1112*b* can be in the range of about 110° to 180° (e.g., around 145°, and including about 120° to 160° and about 130° to 150°, including the aforementioned values and bordering ranges) relative to the ground in the fully reclined position measured from the pivot connection 1116*b*. The bed 1114*a* can be generally in the range of about 1° to 30° (including about 9° to 20° and about 12° to 15°, including the aforementioned values and bordering ranges) relative to the ground in the upright position measured from the pivot. The angle of the bed 1114*b* in the reclined position is discussed herein in further detail.

The seating 1100 is continuously adjustable, in that a user can position the backrest 1112 at any point between the upright and reclined positions. Cushioning can be provided on the backrest 1112 and/or bed 1114. However, such cushioning is optional. For instance, the backrest 1112 and/or bed 1114 can include transverse straps 210 engaged around supportive tubing as shown for the reclinable seating 100 in FIG. 2. As additional examples, the seat and backrest can include a fabric or mesh sling, woven straps, or a solid cast material. Sling, strap, cast seating, and the seating disclosed herein can be integrated with each.

With reference to FIG. 10, the bed 1114 can be connected to the backrest 1112 at the rear of the bed 1114, for example, using a hinge, pin, rod, or other suitable pivot connection 1116, so that the bed 1114 can move relative to the backrest 1112. The pivot 1116 allows the backrest 1112 and the bed 1114 to move relative to each other guided by other pivots, guides, and tracks as discussed herein. The pivot 1116 enables the bed 1114 to move with the backrest 1112 to provide a fluid and synchronized (backrest 1112 and bed 1114 moving together) transition between the upright and reclined position as discussed herein.

Figure 14A:
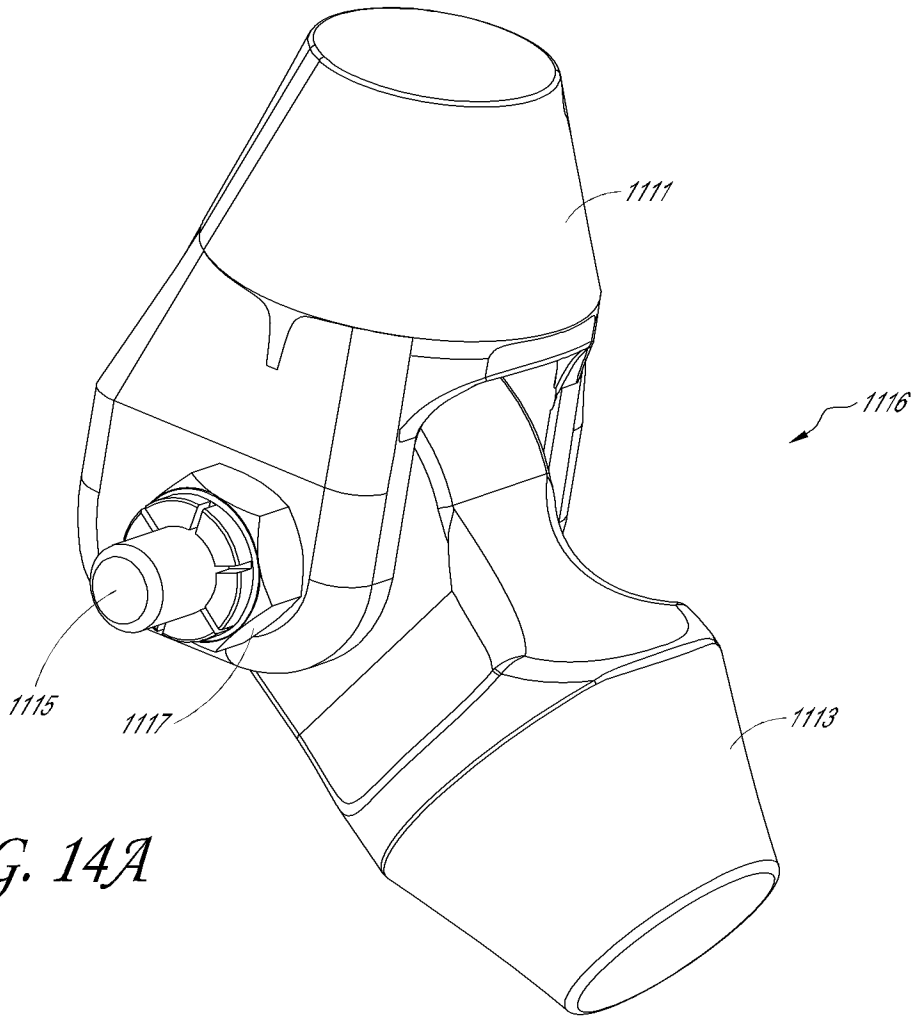
FIGS. 14A-C illustrate an embodiment of a pivot connection for connecting the backrest and a bed of the reclinable seating.
Figure 14B:
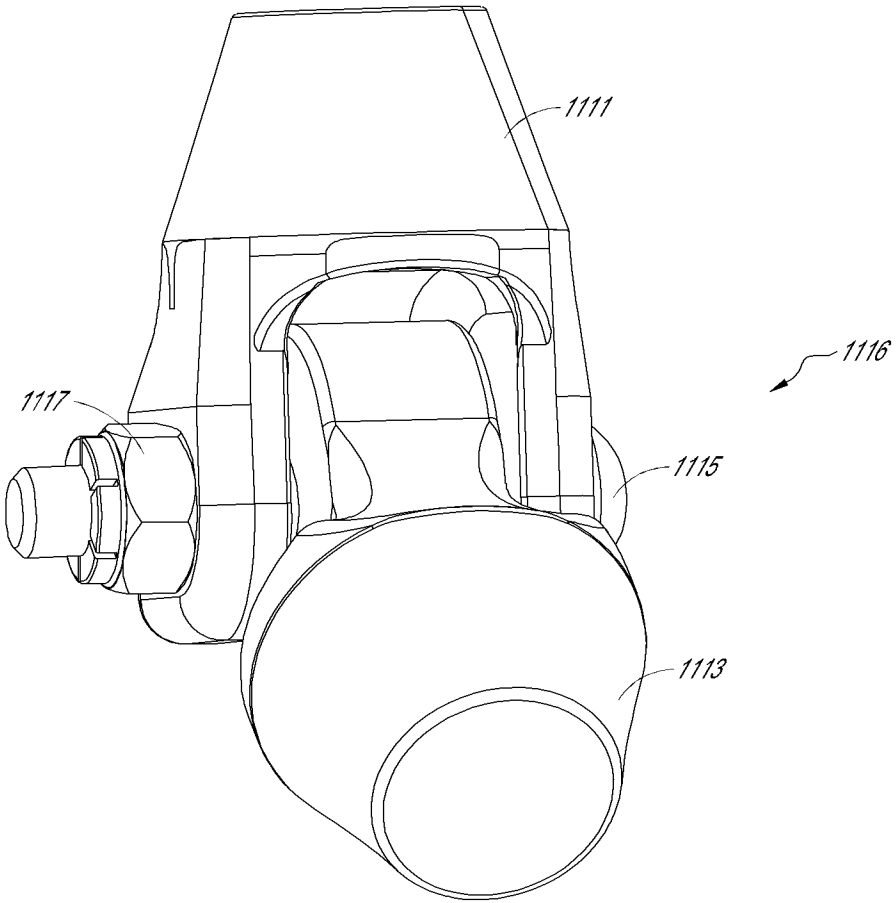
Figure 14C:
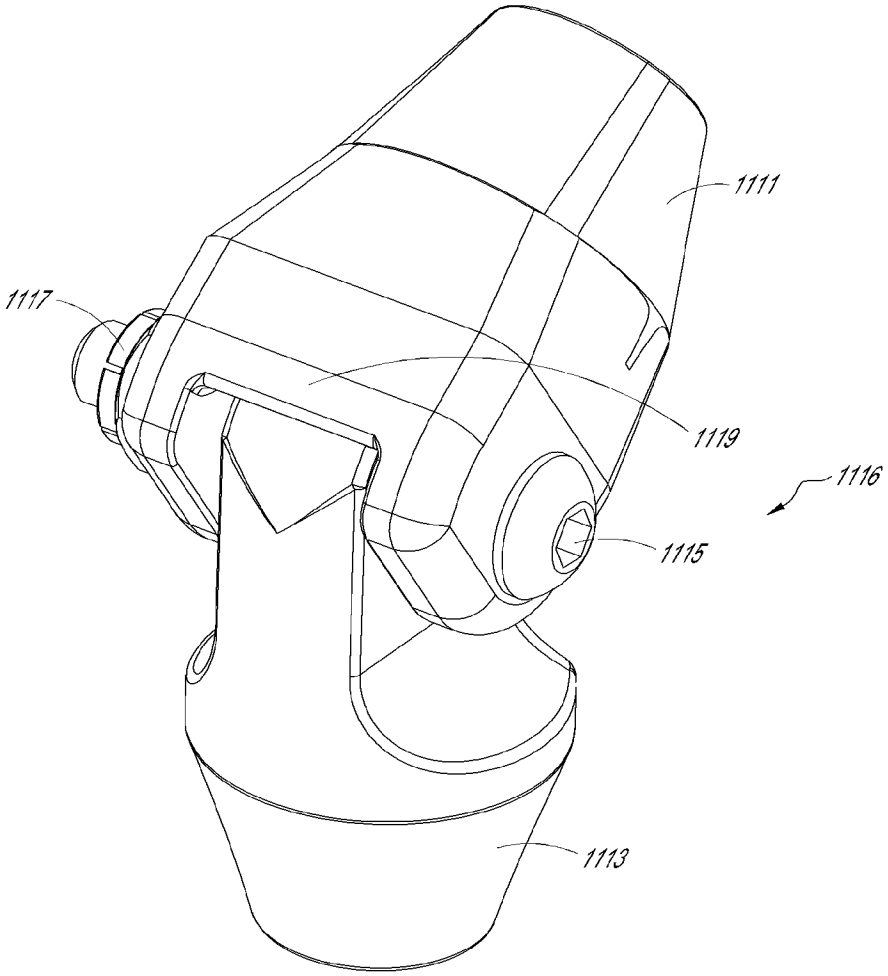

FIGS. 14A-C illustrate an embodiment of a pivot connection 1116 for connecting the backrest 1112 and the bed 1114. The pivot connection or pivot 1116 can include a backrest fitting 1111 connected to a bed fitting 1113, which can be connected to the backrest 1112 and bed 1114, respectively. The pivot 1116 can be any suitable joint to provide a hinged movement as discussed herein. As illustrated in FIGS. 14A-C, the backrest fitting 1111 can be connected to the bed fitting 1113 with a bolt 1115 and a nut 1117. The backrest fitting 1111 and bed fitting 1113 can pivot or hinge relative to each other about the bolt 1115. The nut 1115 can be tightened or loosened to provide a desired amount of tension and a desired ease with which the backrest fitting 1111 and bed fitting 1113 can pivot or hinge relative to each other. The nut 1115 can be secured in the desired position on the threads of the bolt 1115 using any suitable mechanism known in the art. As shown in the FIGS. 14A-B, the bed fitting 1113 can fit into a recess in the backrest fitting 1111. The bolt 1115 can be inserted through corresponding openings of the backrest fitting 1111 and the bed fitting 1113 for the fittings to pivot about the same axis (central axis of the bold 1115). As shown in FIG. 14C, the backrest fitting 1111 can have a stop wall 1119 disposed about the recess in which the bed fitting 1113 is positioned in. The stop wall 1119 can be positioned such that when the reclinable seating 1100 is in the reclined positioned (e.g., the backrest 1112 and bed 1114 are at nearly 180° relative to each other), the bed fitting 1113 comes against or abuts the stop wall 1119, inhibiting or preventing the backrest 1112 and bed 1114 from pivoting any further relative to each other. The stop wall 1119 can be disposed/positioned such that backrest 1112 and bed 1114 are inhibited from pivoting beyond any desired angle, such as, for example, less than about 180, 170, 160, 150, or 140°, including the foregoing values and bordering ranges.

With reference to FIGS. 10-13, a frame 1118 is disposed around the backrest 1112 and the bed 1114. The example frame 1118 includes front members 1120, middle members 1121, rear members 1122, front top members 1123, rear top members 1125, pivot support members 1410, a straight track 1124, and arced track 1127 (e.g., curved track, arcuate track, etc.). The front members 1120, middle members 1121, rear members 1122 (e.g., support members) can rest on the ground as leg members providing support against the ground for the frame 1118. The tracks 1124, 1127 can form travel paths to act as guiderails in a direction substantially parallel to (or generally along) a direction between the rear and front (e.g., foot portion) of the seating 1100. In some embodiments, the rear top members 1125 can act as armrests.

Figure 12:
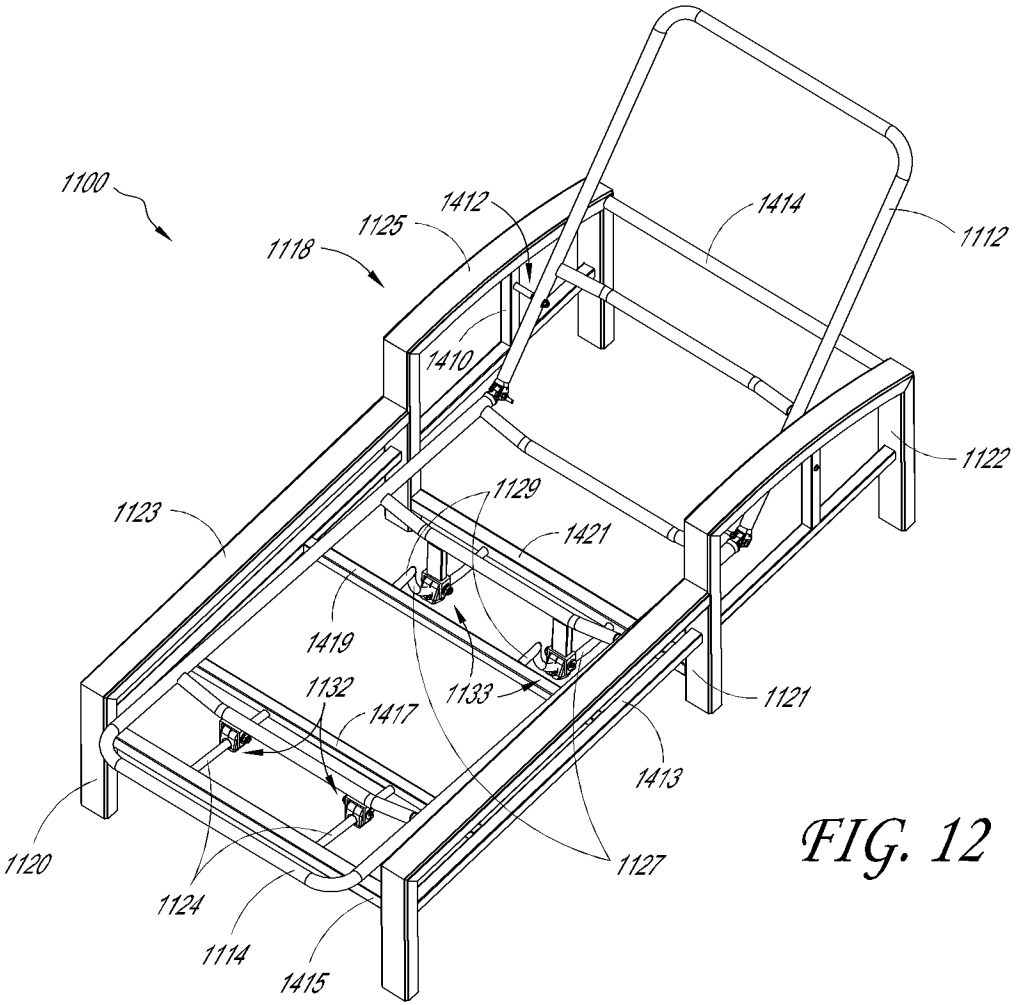
FIG. 12 is a side, front, top perspective view of an embodiment of the reclinable seating.

FIG. 12 is a side, front, top perspective view of an embodiment of the reclinable seating 1100. The front members 1120 are located near the front of the bed 1114 or frame 1118. The middle members 1121 are located near the middle, rear-middle, or front middle of bed 1114 or frame 1118. Conventional framing components known in the art can be used for the front members 1120 and middle members 1121. For instance, a front leg post or other suitable generally upright framing component can be used, as shown in FIG. 10. As shown in FIG. 12, two front members 1120 and two middle members 1121 can extend upward at a 90° angle relative to the ground. However, any generally upright angle is suitable for use herein. For instance, two front members and/or two middle members can be generally trapezoidal relative to each other. Alternatively, a generally horizontal front rail or other non-upright framing component can be used. Materials commonly used for framing are woods, such as teak, cedar, oak, or the like, metals, such as aluminum, steel, iron, or the like, or synthetic polymers, such as heavy-duty plastics and composites. These materials are suitable for use in the embodiments disclosed herein.

Referring again to FIG. 10, the rear members 1122 are located near the rear of the backrest 1112 or frame 1118. Again, conventional framing components can be used for the rear members 1122, and the rear members can be positioned at any suitable angle. For example, the rear members 1122 can include a generally upright member, such as a back upright slat, or a back arm post, as shown in FIG. 10. A back rail, crest rail, cross rail, cross member, or other generally horizontal framing component, such as the back rail 1414, is also suitable. Other irregular angles, such as trapezoidal angles, are also suitable for use.

In the example embodiment of FIG. 12, a second rear member 1412 (e.g., a pivot member) extends substantially horizontally, such as, generally perpendicularly, from pivot support members 1410. The second rear member 1412 is configured to provide support for the backrest 1112 and to provide a pivot connection to the frame 1118 that allows the backrest 1112 to move in relation to the bed 1114 and/or frame 1118. The second rear member 1412 can include a hinge, pin, rod, ball and socket, or other suitable pivot connection and/or member adjoined to or passing through the backrest 1112. In some embodiments, as illustrated in FIG. 12, two second rear member 1412 can be connected to the frame 1118 via the pivot support members 1410. The two second rear members 1412 can connect to the opposite sides of the backrest 1112. The connections between the frame 1118 and/or the backrest 1112 can be any pivotal connection to allow the backrest 1112 to pivot relative to the frame 1118 as discussed herein.

Figure 15:
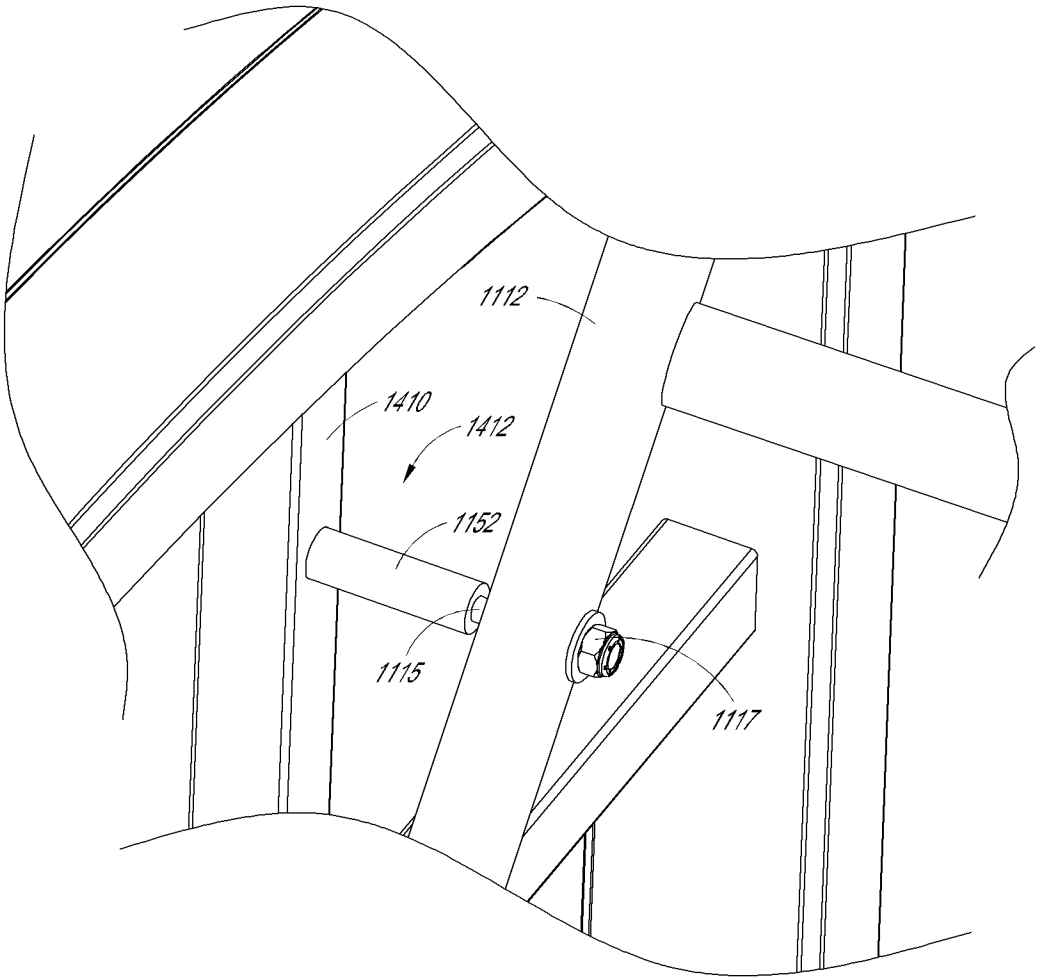
FIG. 15 illustrates an embodiment of a pivot member for connecting the bed and the frame of the reclinable seating.

FIG. 15 illustrates an embodiment of a pivot member 1412. The pivot member 1412 can be a bolt 1115 connecting the back rest 1112 to the pivot support member 1410 of the frame 1118. As illustrated in FIG. 15, a nut 1117 can secure the bolt 1115 to the backrest 1112. In some embodiments, another nut can also secure the bolt 1115 to the pivot support member 1410. In some embodiments, a head of the bolt 1115 can secure the bolt 1115 to the pivot support member 1410. The pivot member 1412 can be secured to the frame 1118 and/or the backrest 1112 with any suitable mechanical connection as discussed herein, such as, for example, interference fit mechanisms, snap fit mechanisms, notched mechanism, and so forth, which can include using male and female mating parts. The pivot member 1412 can have a spacer 1152, which as illustrated in FIG. 15, can be a sleeve that slides over the bolt 1115 to provide a minimum separation between the pivot support member 1410 and the backrest 1112. When provided on both sides of the backrest 1112, the spacers 1152 can substantially fix the backrest 1112 relative to frame 1118 along the axis of the pivot members 1412.

In some embodiments, the back rail 1414 (or crest rail) extending perpendicularly from the rear members 1122 could serve a similar function with or without second rear member 412 to provide a pivot connection to the backrest 1112 relative to the frame 1118. The backrest 1112 can abut the frame 1118 at the back rail 1414, and pivot about the abutment. This pivoting abutment connection can be secured via, for example, bolts.

Figure 13:
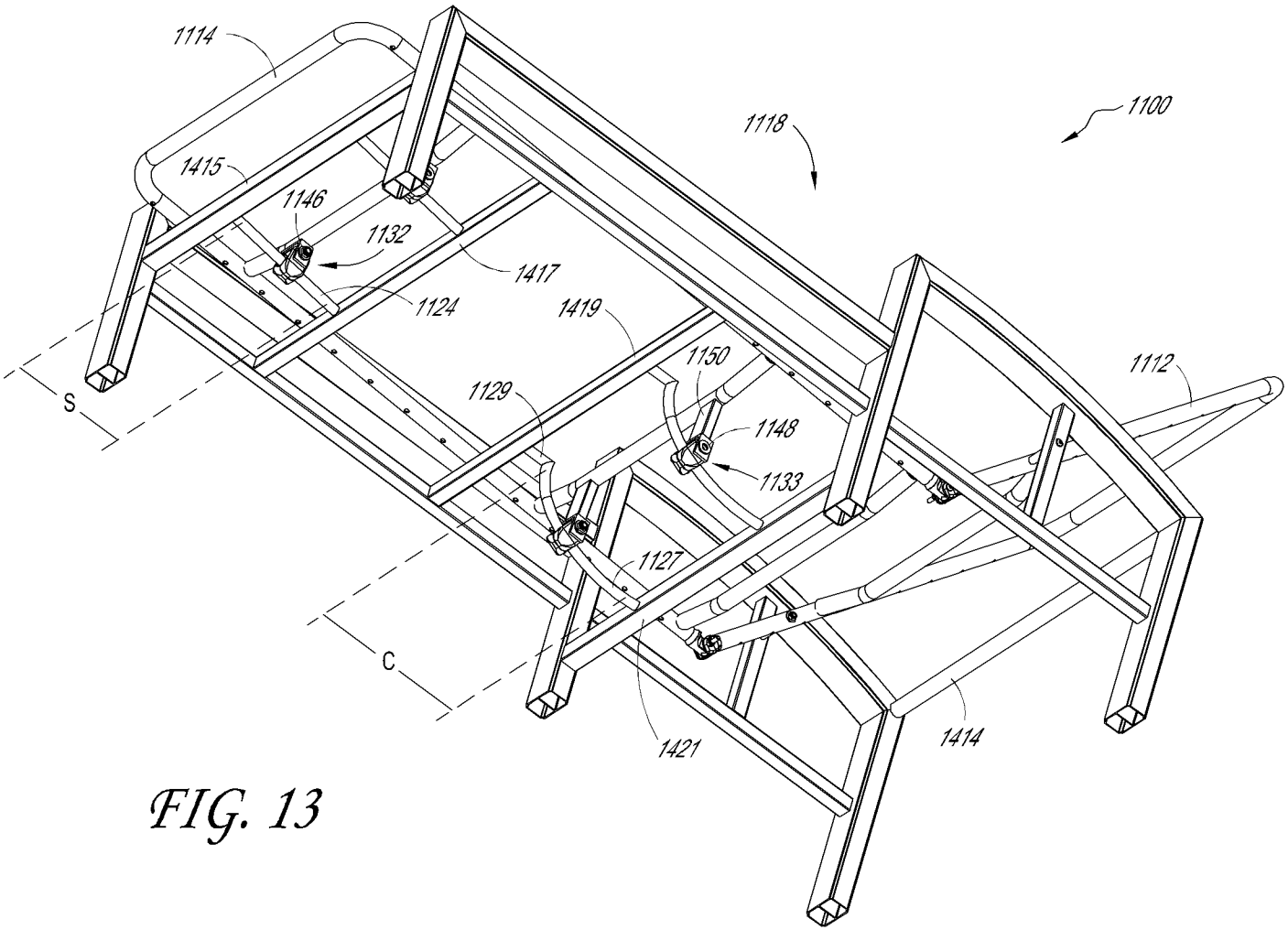
FIG. 13 is a side, bottom, front perspective view of an embodiment of the reclinable seating.

As illustrated in FIGS. 12 and 13, the frame 1118 can include support members 1413, a front rail or member 1415, a front brace or member 1417, a middle brace or member 1419, a middle rail or member 1421. These rails can be cross rails, braces, or members positioned along the frame to provide structural support and support to other features of the seating 1100 as discussed herein. The front rail 1415 can extends between front members 1120. In some embodiments, the front rail 1415 can extend between the front top members 1123. The middle rail 1421 extends between the middle members 1121. In some embodiments, the middle rail 1421 can extend between the front top members 1123. In some embodiments, the frame 1118 can have other vertical (or other types) members between the front members 1120 and middle members 1121. The other members can be connected to the front top member 1123. The other members can be support by and be connected to any of the aforementioned features for supporting the straight tracks 1124 and/or arced tracks 1125. For example, the front brace 1417 and/or middle brace 1419 can be connected to the other members that are connected to the frame 1118 (including the front top members 1123). The front brace 1417 and/or middle brace 1419 are connected to support members 1413. The support members 1413 can run parallel to the front top members 1123 and can be connected to the front member 1120 and middle members 1121.

As illustrated in FIG. 12, the front rail 1415 and front brace 1417 can support one or more straight tracks 1124. The straight tracks 1124 can be fixedly connected to the front rail 1415 and front brace 1417. The middle brace 1419 and middle rail 1421 can support one or more arced tracks 1127. The arced tracks 1127 can be fixedly connected to the middle brace 1419 and middle rail 1421.

In some embodiments, the arced track 1127 can be directly connected to the middle brace 1419. As illustrated in FIG. 12, the arced track 1127 can be spaced from the middle brace 1419 via one or more hangers 1129. The hangers 1129 can be substantially horizontal or parallel to a resting surface of the chaise. In some embodiments, the hangers 1129 can be inclined downward toward or upward away from the resting surface (e.g., the ground, such as, concrete), up to about 5°, about 10°, about 15°, about 20°, about 25°, about 30°, or more degrees, including the aforementioned values and bordering ranges. The hangers 1129 can space the arced track 1127 from the middle brace 1419 to inhibit contact with other features of the seating 1100 or limit guide assembly travel as discussed in further detail herein.

As illustrated in FIGS. 10-13, a first guide assembly 1132 is configured to support the bed 1114 on the straight track 1124. A second guide assembly 1133 is configured to support the bed 1114 on the arced track 1127. In some embodiments, the guide assembly 132 discussed herein, and in particular in reference to FIGS. 6 and 7 can be the first guide assembly 1132 and/or the second guide assembly 1133 configured to engage the straight track 1124 and/or the arced track 1127.

FIG. 13 is a side, bottom, front perspective view of an embodiment of the reclinable seating 1100. The first guide assemblies 1132 can travel over a range S on the straight tracks 1124. Correspondingly, the second guide assemblies 1133 can travel over a range C on the arced tracks 1127. The travel range S of the first guide assemblies 1132 can be limited by the front rail 1415 and front brace 1417. For example, the first guide assemblies 1132 can come against or abut the front rail 1415 and/or front brace 1417 as the reclinable seating 1100 is adjusted between the reclining position and the upright position, respectively. In some embodiments, the straight tracks 1124 can be longer than the travel range S such that the first guide assemblies 1132 do not come against the front rail 1415 and/or front brace 1417 when the travel range S is set by other features of the reclinable seating 1100 as discussed herein. In some embodiments, the travel range S can be about 3 to 35 inches, including about 4 to 30, about 4 to 20, about 5 to 15, and about 5 to 10 inches, including the foregoing values and bordering ranges.

The travel range C of the second guide assemblies 1132 can be limited by the middle brace 1419 and/or middle rail 1421. The second guide assemblies 1132 can come against or abut the middle brace 1419 and/or middle rail 1421 as the reclinable seating 1100 is adjusted between the reclining position and the upright position, respectively. In some embodiments, the length of the arced tracks 1124 along the travel range C can be longer than the travel range C such that the second guide assemblies 1133 do not come against the middle brace 1415, hanger 1129, and/or middle rail brace 1429 when the travel range C is set by other features of the reclinable seating 1100 as discussed herein. In some embodiments, the travel range C can be about 3 to 35 inches, including about 4 to 30, about 4 to 20, about 5 to 15, and about 5 to 10 inches, including the foregoing values and bordering ranges. As illustrated in FIG. 13, travel range S can be less than travel range C. Accordingly, the travel range of the second guide assemblies 1133 will be limited by the travel range of first guide assemblies 1132 over the travel range S when, for example, the first guide assemblies 1132 abut or come against the front rail 1415 or front brace 1417. In some embodiments, the travel range C can be less than travel range S and accordingly limit travel range of the guide assemblies as discussed herein. Limited travel ranges as discussed herein can inhibit or prevent the backrest 1112 and bed 1114 from folding onto each other (or the user) when the seating is transiting in the upright position. Conversely, the limited ranges as discussed herein can inhibit or prevent the backrest 1112 and bed 1114 from separating from each other (unfolding) more than a desired angle (e.g., 180°) as discussed herein.

As illustrated in FIG. 13, the arced tracks 1127 can be connected to hangers 1129. The travel range C can be limited by the hangers 1129 when, for example, the second guide assemblies 1133 come against or abut the hangers 1129 from the bottom relative to the ground when the reclinable seating 1100 is in the reclined positioned. As discussed herein, the second guide assemblies 1133 can pivot about the second bracket 1148. With the second guide assemblies 1133 fully, nearly, or substantially enveloping the arced track 1127 as discussed herein, travel range C of the second guide assemblies 1133 is limited when the second guide assemblies 1133 abuts the hangers 1129 and the second guide assemblies 1133 are inhibited or prevented from coming off the arced track 1127. Stated differently, the connection between the substantially vertical arced track 1127 (near the hangers 1129) and the hangers 1129 form a discontinuous travel path that can inhibit or prevent the second guide assembly 1133 from moving off the arced track 1127 and/or onto the hangers 1129.

Other features, such as stops, protrusions, detents, supports, rails, braces, and/or bars can be implemented with or independently from the front rail 1415, front brace 1417, middle brace 1419, middle rail 1421, and/or hangers 1129 to limit the travel ranges of the guide assemblies and/or travel range of the seating 1100 between the upright and reclined positions. For example, as illustrated in FIGS. 12 and 13, the reclinable seating 1100 can have a back rail 1414. The back rail 1414 can be positioned to further limit (inhibit, prevent, etc.) travel of the reclinable seating 1100 in the reclined positioned, and in particular, limit the travel of the backrest 1112. As illustrated in FIG. 11, the back rail 1414 can be positioned a distance B from the backrest **1112*b* in the fully reclined position. The distance B can be a sufficient distance from the backrest 1112*b* to prevent a hard stop of the backrest 1112*b* when a user extends the seating 1100 into the reclined position. Other features of the reclinable seating 1100 as discussed herein can stop of the backrest 1112 in the reclined position while the distance B provides a soft landing for the backrest 1112*b*. For example, if a user continues to attempt proceed into a more reclined position beyond the travel ranges, the back rest 1112*b* can come against or abut the back rail 1414 to prevent further travel of the back rest 1112*b*, flexing the backrest 1112*b* over the distance B to provide the soft landing. Upon contact with the back rail 1414, the user can feel a hard stop of the backrest 1112*b* to realize that the reclinable seating 1100 cannot recline any further. This can help prevent damage of the reclinable seating 1100 if a user attempts to force the reclinable seating 1100 into a reclined positioned beyond, for example, the intended travel ranges S and C. In some embodiments, the back rail 1414 can be position without the distance B when the backrest 1112*b* is in the reclined position. Without the distance B, a user can immediately feel the fully reclined positioned of the reclinable seating 1100 with a hard stop, negating any further travel of the back rest 1112*b*** beyond the fully reclined positioned. The distance B can be about less than 2, less than 1.5, less than 1, less than ¾, less than ½, less than ¼, less than ⅛, and less than 1/16 inches, including the foregoing values and bordering ranges.

Returning to FIG. 11, the side view of the reclinable seating 1100 shows two possible positions ("a" and "b") as discussed above of the reclinable seating 1100. As illustrated in FIGS. 11 and 12, the first guide assemblies 1132 can be connected to bed 1114 via a first bracket 1146. The first bracket 1146 can be connected directly to the bed 1114 via, for example, a bed rail as discussed herein, and in particular, as discussed in reference to FIG. 18. The second guide assembly 1133 can be connected to the bed via a second bracket 1148 as discussed herein for FIG. 16. In some embodiments, the second bracket 1149 can be connected to the bed 1111 via a bed rail as discussed in reference to the first bracket 1146. As illustrated in FIGS. 10 and 11, an extension 1150 can be connected to the second bracket 1148. The extension 1150 can be connected to the bed 1114 via, for example, a bed rail as discussed herein.

Figure 16:
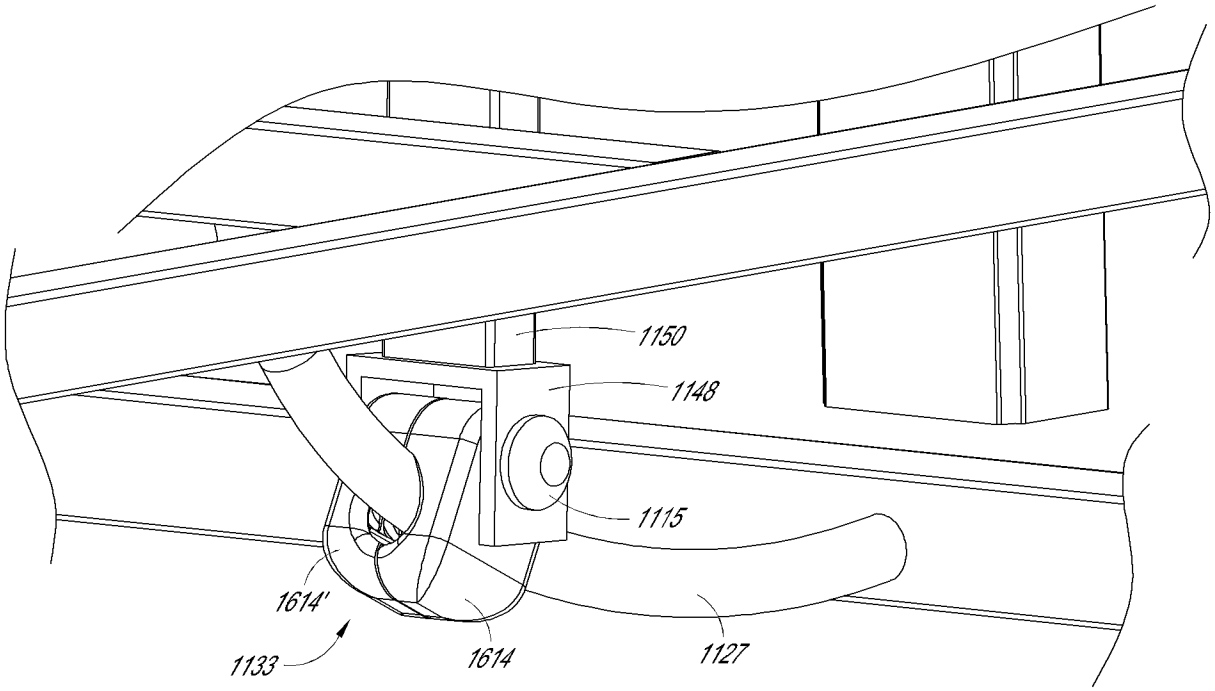
FIG. 16 illustrates an embodiment of a guide assembly.
Figure 17:
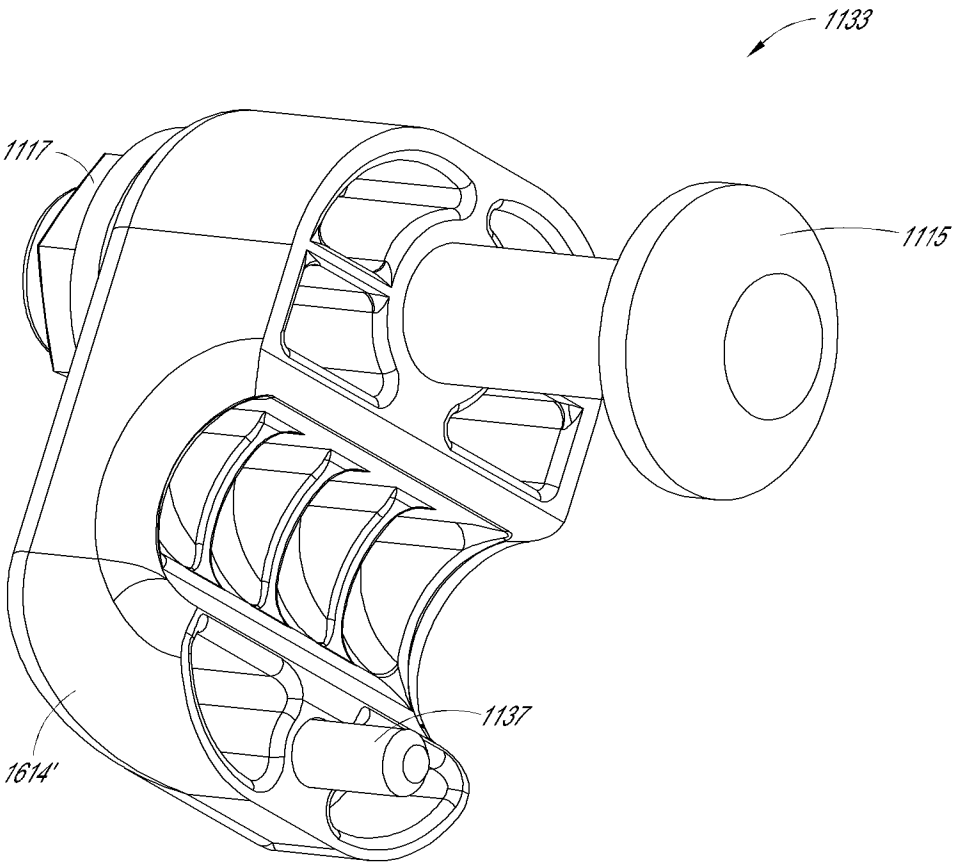
FIG. 17 illustrates an embodiment of the guide assembly.

FIGS. 16 and 17 illustrates an embodiment of a guide assembly. In particular, FIG. 16 illustrates an embodiment of the second guide assembly 1133 on an arced track 1127. However, the discussion herein of the features and function of the second guide assembly 1133 can be applied similarly to the first guide assembly 1132. The second guide assembly 1133 can include a first half slide shoe 1614 and a second half slide shoe 1614' engaged around the arced track 1127. The inner surfaces of the first half slide shoe 1614 and the second half slide shoe 1614' can made of a durable material having a low coefficient of friction with the arced track 1127. The coefficient of friction should be sufficiently low to permit the second guide assembly 1133 to easily slide on the arced track 1127 when the user changes his or her center of gravity on the seating 1100 as discussed herein. Furthermore, the material should be sufficiently durable to withstand repeated use under heavy loads. DELRIN®, a polyoxymethylene plastic originally manufactured by DuPont, which is hard, yet has a dynamic coefficient of friction against steel in the range of about 0.19 to 0.41, has been used successfully. However, a variety of durable, low-friction materials, such as compositions of rubbers, resins and plastics (e.g., PTFE, HDPE, TEFLON®), ceramics (e.g., BN), metals (bronze, Mb), and/or graphite are also contemplated for use in the second guide assembly 1133.

As illustrated in FIG. 16, the first half slide shoe 1614 and the second half slide shoe 1614' can fully or substantially fully enclose or envelope the arced track 1127. To fully enclose the arced track 1127, the first half slide shoe 1614 and the second half slide shoe 1614' can contact each other at two areas of contact (e.g., top and bottom portions) to form a closed shape (e.g., circle, oval, square, and/or the like) through which the arced track 1127 can snugly (e.g., relatively small dimensional clearance between the features) fit or project through. In some embodiments, fully enclosing the arced track 1127 allows for more secure engagement of the second guide assembly 1133 with the arced track 1127. Secure engagement of the arced track 1127 can facilitate transport, use, and durability of the seating 1100. For example, during shipping of the seating 1100, the seating 1100 may be jostled around in the back of a delivery truck. The vibration may cause a guide assembly to come off a track. By fully enclosing, for example, the arced track 1127, the second guide assembly 1135 can better withstand the vibrations during shipping and to arrive at a desired destination (e.g., warehouse or retail location) still engaged with the arced track 1127.

As another example, a user may pull on the bed 1114 to, for example, move the seating 1100. The pulling may cause stresses between a guide assembly and a track that can lead to the guide assembly separating from the track. By fully enclosing the track, the guide assembly can help inhibit separation from the track to retain engagement. Further, as the seating 1100 is used over an extended period over its lifetime, the guide assembly and/or track may wear such that engagement between the guide assembly and the track has greater dimensional clearance. The enclosing guide assembly can help inhibit separation from the track by retaining full enclosure of the track even after extended wear.

FIG. 17 illustrates an embodiment of the second guide assembly 1133 with some features removed for illustration purposes. As illustrated in FIG. 17, the first half slide show 1614 is not shown to illustrate the interior features of the second half slide shoe 1614'. The second guide assembly 1133 can include a locking pin 1137. The locking pin 1137 can fit through holes or openings formed in a portion (e.g., bottom portion) of the first half slide shoe 1614 and the second half slide shoe 1614'. The locking pin 1137 can engage or mate with the first half slide shoe 1614 and the second half slide shoe 1614' using any suitable locking and/or releasing attachment mechanism, such as, for example, interference fit mechanisms, snap fit mechanisms, notched mechanism, and so forth, which can include using male and female mating parts. The locking pin 1137 can be engaged during, for example, shipping to help prevent disengagement of the guide assembly and track as discussed herein. Upon arrival at a desired destination, the locking pin 1137 can be disengaged and/or removed for desired functionality of the guide assembly and track as discussed herein. In some embodiments, the locking pin 1137 is retained in the second guide assembly 1133 during use of the seating 1100 for desired functionality of the guide assembly and track as discussed herein.

As illustrated in FIG. 16, the second guide assembly 1133 can be connected to a bracket 1148. The connection between the second guide assembly 1133 and the bracket 1148 can include a bolt 1115 and a nut 1117 (FIG. 17). The bolt 1115 can be inserted through corresponding openings in the bracket 1148 and second guide assembly 1133 (e.g., the first half slide shoe 1614 and/or the second half slide shoe 1614'). The openings can line up such that insertion of the bolt 1115 secures the positions of the closed guide assembly 1135 and the bracket 1148 relative to each other and allows for adjustment of the tension in the bolt 1115. The bolt 1115 can be secured via the nut 1117. Depending on the torque applied to the bolt 1115 and nut 1117 when tightening, a desired level of friction between the second guide assembly 1133, the bracket 1148, and/or arced track 1127 can be achieved. For example, by increasing the tension applied to the bolt 1115, the bracket 1148 partially enclosing or enveloping the second guide assembly 1133 can come together against the second guide assembly 1133. Concomitantly, as the first half slide shoe 1614 and the second half slide shoe 1614' are forced closer together by the bracket 1148, the first half slide shoe 1614 and the second half slide shoe 1614' move against the arced track 1127 to increase sliding friction (dynamic friction) therebetween.

The desired level of friction can affect the ease with which the closed guide assembly 1133 pivots about the bolt 1115 relative to the bracket 1148 as discussed herein. The desired level of friction can affect the ease with which the closed guide assembly 1133 slides or moves along the arced track 1127 as discussed herein. Adjustment of the friction between the closed guide assembly 1135, the bracket 1148, and/or arced track 1127 can help achieve or attain a desired/predetermined level of overall friction (rotating and sliding) such that a user sitting relatively still in an equilibrium position does not cause the closed guide assembly 1135 to slide along the arced track 1127. Yet, the desired level of friction will preferably keep the coefficient sufficiently low, such that when the user shifts his or her center of gravity, the shoes 1614, 1614' will slide along the arced track 1127 and rotate relative to the bracket 1148 in response to the shift.

The friction created by the bolt 1115 and nut 1117 between the closed guide assembly 1135, the bracket 1148, and/or arced track 1127 as discussed herein can be adjusted at the factory for an average user weight to achieve desired functionality. At the point of sale or final destination, the tension can be tuned based on the user's actual weight (tension increased for a heavier user and decreased for a lighter user). Further, the tension can be adjusted to according to the type of seating surface construction. For example, cushioned seating surfaces may be heavier (weigh more) than mesh/sling seating surfaces. Heavier seating surfaces and/or heavier users may require relatively higher tensions for the seating to stay in a desired position as discussed herein. Lighter seating surfaces and/or heavier users may require relatively lower tensions for the seating to stay in a desired position as discussed herein. Accordingly, the tension may be adjusted based on a combination of the weight of the seating surfaces and the (anticipated) weight of the user. In some embodiments, the tension can be adjusted with a wrench corresponding to the size of the bolt 1115 and nut 1117. In some embodiments, the resulting dynamic coefficient of friction between in the guide assemblies and tracks range of about 0.19 to 0.41, including about 0.25 to 0.35, including the foregoing values and bordering ranges.

As the second guide assembly 1133 slides along the arced track 1127 in response to changes in the user's center of gravity, the backrest 1112 and bed 1114 will move accordingly to accommodate the user's position. Thus, once the tension of the bolt 1115 and nut 1117 is adjusted to achieve the desired amount of friction based on the user's specific body weight, the seating 1100 will adjust itself to various positions simply by the user shifting his or her weight. As tension is unlikely to need constant adjustment, the embodiment of the guide assembly discussed herein provides a minimalist design with less moving parts that can cost less to manufacture and is easier to use and aesthetically pleasing. The materials and configuration of the second guide assembly 1133 can be selected to provide a coefficient of friction as discussed herein that is sufficiently high to permit the second guide assembly 133 to hold its position when the user stops changing his or her center of gravity for a majority of users, for example, assuming a normal distribution around an average user weight of about 180 lbs. (81.6 kg). This configuration would advantageously allow the seating 1100 to hold an equilibrium position until application of force, as described above, for most users. Materials such as DELRIN® have been found to achieve the desired function as discussed herein, without needing, for example, a frictional control 616 (FIG. 6) as discussed herein. Again, the discussion herein pertaining to the features and functionality of the second guide assembly 1133 can be similarly implemented and utilized with the first guide assembly 1132.

Referring again to FIG. 11, the first guide assembly 1132*a* is substantially vertically aligned along a central axis of the bracket 1146*a* extending through the first guide assembly 1132*a* when the seating 1100 is in the upright position. The first guide assembly 1132*b* pivots relative to the bracket 1146*b* as the first guide assembly moves 1146*b* along travel range S on the straight track 1124 when the seating 1100 is reclined. Similarly, the second guide assembly 1133*a* is substantially vertically aligned along a central axis of the bracket 1148*a* extending through the second guide assembly 1133*a* when the seating 1100 is in the upright position. The second guide assembly 1133*b* pivots relative to the bracket 1148*b* as the second guide assembly 1148 moves along travel range C on the arced track 1127 when the seating 1100 is reclined. As illustrated in FIG. 11, the second guide assembly 1133*b* in the reclined position can pivot to be horizontal or nearly horizontal relative to the position of the of the second guide assembly 1133*a* in the upright position of bed 1114.

As illustrated in FIG. 11, the arced track 1127 provides forward (horizontal) movement for the second guide assembly 1133*b* toward the foot of the bed 1114 (or toward the first guide assembly 1132). Simultaneously, the arced track 1127 provides vertical movement for the second guide assembly 1133*b* relative to the resting surface. In some embodiments, the arced track 1127 can have a radius of curvature of about 1 to 100 inches, including about 2 to 90, about 3 to 80, about 4 to 70, about 5 to 60, about 5 to 50, about 5 to 40, about 5 to 30, about 5 to 20, about 2 to 10, about 3 to 10, about 4 to 10, about 5 to 10 inches, and about 6 to 10 inches, including the foregoing values and bordering ranges. As illustrated, for example, in FIG. 10, the arced track 1127 can have a radius of curvature that changes throughout the length of the arced track 1127. For example, the radius of curvature can decrease moving up the arced track 1127 (from the rear portion to the front portion of the track) to provide more horizontal support for the second guide assembly 1148*a* in the upright position (rear portion) while more fully suspending the second guide assembly 1148*b* in the reclined position (front portion) as discussed herein. The arced track 1127 may provide relatively less, insignificant, or negligible weight support when the second guide assembly 1148*b* is suspended (on the substantially or relatively vertical portion of the arced track 1127) as discussed herein.

As illustrated in FIGS. 10-13, the arced track 1127, hanger 1129, middle brace 1419, and/or middle rail 1421 can be sized and positioned (e.g., connected to the frame 1118) to be underneath the bed 1114 relative to the ground when the seating 1100 is on the ground. The arced track 1127 and rails 1129, 1419, and/or 1421 can be sized and positioned to be within an outer boundary or perimeter of the bed 1114 when, for example, the seating 1100 is in the first position. For example, the outer perimeter can be formed or defined by outer members or tubes forming the frame or support structure of the bed 1114. The arced track 1127 and rails 1129, 1419, and/or 1421 can be sized and shaped (e.g., curved) such that the arced track 1127 can be positioned underneath the bed 1114 while achieving a desired height of the seating 1100. Stated differently, the arced track 1127 is sized and positioned to guide, push, or move the second guide assembly 1133 along the arced track 1127 as discussed herein while providing the seating 1100 and/or the bed 1114 a desired or predetermined height or range of height, such as, for example, a height for a standard chaise used for lounging. The brackets 1148 and/or extension can be correspondingly sized and positioned (e.g., vertical height) to support the bed 1114 at a desired height and relative to the frame 1118 while allowing for movement of the seating 1100 as discussed herein.

As illustrated in FIGS. 10-13, the straight track 1124, front rail 1415, and/or front brace 1417 can be sized and positioned (e.g., connected to the frame 1118) to be underneath the bed 1114 relative to the ground when the seating 1100 is on the ground. The straight track 1124 front rail 1415, and/or front brace 1417 can be sized and positioned to be within an outer boundary or perimeter of the bed 1114. The straight track 1124 front rail 1415, and/or front brace 1417 can be sized and shaped (e.g., straight) such that the straight track 1124 can be positioned underneath the bed 1114 while achieving a desired height of the seating 1100. Stated differently, the straight track 1124 is sized and positioned to guide, push, or move the first guide assembly 1132 along the straight track 1124 as discussed herein while providing the seating 1100 and/or the bed 1114 a desired or predetermined height or range of height, such as, for example, a height for a standard or conventional chaise used for lounging.

Accordingly, with the tracks 1124, 1127 underneath the bed 1114, the tracks 1124, 1127, guide assemblies 1132, 1133, and other associated components of the seating 1100 can be positioned away and out of sight from a user. Further, such positioning allows for a compact structure of the seating 1100 at a desired height as discussed herein as well as a dimensionally compact frame 1118. For example, dimensions of the frame 1118 can be minimized to substantially correspond to the dimensions (e.g., width) of the bed 1114 with the tracks 1124, 1127 and guide assemblies 1132, 1133 not positioned at the sides of the frame 1118 or outside the perimeter of the bed 1114. Stated differently, dimensions of the frame 1118 do not have to be enlarged or expanded (e.g., horizontally relative to the ground) to accommodate tracks 1124, 1127 and guide assemblies 1132, 1132 because of their positions underneath the bed 1114, while simultaneously providing the desired movement of the seating 1100 (e.g., bed 1114) as discussed herein.

The tracks 1124, 1127 can be shaped to guide, push, or move the guide assemblies 1132, 1133 with a simultaneous horizontal and vertical movement. For example, when the seating 1100 is moved from the upright position to the reclined position, the bed 1114 can laterally move forward (e.g., horizontally) while various portions of the bed 1114 can rise/ascend vertically relative to the ground. The track 1127 can direct the guide assembly 1133 upwardly away from the ground and simultaneously forward toward the front portion of the frame 1118 while the seating 1100 is moved into the reclined position. Stated differently, the track 1127 can push the bed 1114 (e.g., a portion of the bed 1114 proximate to the pivot connection 1116) away from or upwardly relative to the ground while the seating 1100 is moved into the reclined position. The track 1127 pushes the bed 1114 upwardly via the track 1127 imparting a desired direction or path of motion on the guide assembly 1133 as discussed herein.

Accordingly, the tracks 1124, 1127 can be shaped such that as the guide assemblies 1132, 1133 are moved, guided, directed, or pushed along the tracks 1124, 1127 when the seating 1100 is moved into the reclined position, the rear portion of the bed 1114 rises/ascends (e.g., moves upward) a greater vertical height/distance than the front portion of the bed 1114 over a same horizontal distance or later movement. Conversely, the tracks 1124, 1127 can be shaped such that as the guide assemblies 1132, 1133 are moved, guided, directed, or pushed along the tracks 1124, 1127 when the seating 1100 is moved into the upright position, the rear portion of the bed 1114 falls/descends a greater vertical height/distance than the front portion of the bed 1114 over a same horizontal distance or later movement. Such an arrangement of the tracks 1124, 1127 can assist the user in more easily and fluidly to move the seating 1100 into the reclined position (e.g., the user moving into a generally prone position) as discussed herein, where for example, the bed 1114 rises while the backrest 1112 tilts relative to the ground and pivots relative to the bed 1114. Further, such an arrangement of the tracks 1124, 1127 can assist the user in more easily and fluidly to move the seating 1100 into the upright position while in a prone position, where for example, the guide assembly 1133 is substantially vertically suspended (e.g., the track 1127 substantially does not vertically push against the guide assembly 1133 in the reclined position) to allow a user to impart motion on the bed 1114 and backrest 1112 by pushing on the bed 1114 with body weight (e.g., shifting center of gravity as discussed herein) such that the vertically suspended guide assembly 1133 moves downward as the seating 1100 moves into the upright position.

As illustrated in FIGS. 10 and 12, the arced track 1127 can generally have a curvature and/or shape that is concave from a perspective of or relative to the pivot connection 1116, second rear member 1412 and/or any other feature of the seating proximate to the pivot connection 1116 or second rear member 1412, such as the bed 1114. The concave curvature and/or shape of the arced track 1127 can provide a simultaneous horizontal and vertical movement or travel of the second guide assembly 1133 along a constant and/or varying radius of curvature as discussed herein. Stated differently, the arced track 1127 can generally have a curvature and/or shape that is convex from a perspective of or relative to a resting surface for the seating 1100. The convex curvature and/or shape of the arced track 1127 can provide a simultaneous horizontal and vertical movement of the second guide assembly 1133 along a constant and/or varying radius of curvature as discussed herein.

The concave/convex shape of arced track 1127 can vary in length and/or radius of curvature such that an upper portion of the arced track 1127 (proximal to or near a hanger 1129 (FIG. 12)) is substantially vertical (e.g., perpendicular) relative to the resting surface. At the upper portion of the arced track 1127, the second guide assembly 1133 can be substantially vertically suspended (e.g., providing relatively minimal weight support of a user) when the seating 1100 is in the reclined position. In some embodiments, the concave/convex shape of arced track 1127 can vary in length and/or radius of curvature such that the upper portion of the arced track 1127 can be partially vertical (with a horizontal component) relative to the resting surface (e.g., angled less than 90 degrees relative to the resting surface or not perpendicular relative to the resting surface to provide at least some weight support of the user) when the seating 1100 is in the reclined position.

The concave/convex shape of arced track 1127 can vary in length and/or radius of curvature such that a horizontal portion of the arced track 1127 (proximal to or near the middle member 1121) is substantially horizontal relative to the resting surface. At the horizontal portion of the arced track 1127, the second guide assembly 1133 can be substantially vertically supported (e.g., providing weight support of the user) when the seating 1100 is in the upright position. In some embodiments, the concave/convex shape of arced track 1127 can vary in length and/or radius of curvature such that the horizontal portion of the arced track 1127 is partially horizontal (with a vertical component) relative to the resting surface (e.g., angled greater than zero degrees relative to the resting surface or not fully horizontal relative to the resting surface to provide some weight support of the user) when the seating 1100 is in the upright position.

The concave/convex shape of arced track 1127 can provide a path along the arced track 1127 for the second guide assembly 1133 that has an increasing vertical rise over a predetermined or same horizontal distance of travel relative the resting surface when the seating 1100 is being reclined. Stated differently, as the seating 1100 is moved from a fully upright position to the reclined position, the second guide assembly 1133 will first move or travel along a path that is mostly horizontal (relative to the resting surface) over a predetermined distance or length along the path. As the seating 1100 is moved closer to the reclined positioned, the second guide assembly 1133 will move or travel along a path that is mostly vertical (relative to the resting surface) over the same predetermined distance or length along the path. The increasingly vertical movement of the second guide assembly 1133 from the upright position to the reclined position of the seating 1100 also occurs when viewed form a perspective of a predetermined horizontal distance relative to the resting surface. The arced track 1127 will provide varying vertical support (e.g., weight support of a user) to the second guide assembly 1133 that decreases from the upright position to the reclined position as the second guide assembly 1133 moves from the substantially horizontal portion to the substantially vertical portion of the arced track 1127 to provide smooth and continuous adjustment of the positions of the seating 1100 as discussed herein.

Conversely, as the seating 1100 is moved from a fully reclined position to the upright position, the second guide assembly 1133 will first move or travel along a path that is mostly vertical (relative to the resting surface) over a predetermined distance or length along the path. As the seating 1100 is moved closer to the upright position, the second guide assembly 1133 will move or travel along a path that is mostly horizontal (relative to the resting surface) over the same predetermined distance or length along the path. The increasingly horizontal movement of the second guide assembly 1133 from the reclined position to the upright position of the seating 1100 also occurs when viewed form a perspective of a predetermined horizontal distance relative to the resting surface. The arced track 1127 will provide varying vertical support (e.g., weight support of a user) to the second guide assembly 1133 that increases from the reclined position to the upright position as the second guide assembly 1133 moves from the substantially vertical portion to the substantially horizontal portion of the arced track 1127 to provide smooth and continuous adjustment of the positions of the seating 1100 as discussed herein.

In some embodiments, the arced track 1127 can have straight portions (e.g., hangers 1129) or be wholly straight such as the straight track 1124. For example, as illustrated in FIGS. 10 and 11, the arced track 1127 can have a substantially horizontal or straight portion near the rear portion of the bed 1114. The second guide assembly 1133*a* engages the substantially straight portion when the seating 1100 is in the upright position as discussed herein. The substantially straight portion can be level to provide vertical weight support while a user sits in the seating 1100 in the upright position. The second guide assembly 1127 can abut the middle rail 1421 as discussed herein to prevent further movement of the second guide assembly 1127 along or off the track 1127, therefore facilitating vertical support for supporting the weight of the user.

As illustrated in FIG. 11, the first guide assembly 1133 moves substantially in a flat plane along the straight track 1124. The first guide assembly 1133 also has vertical movement determined by the degree of tilt of the straight track 1124 relative to the ground. The straight track 1124 is angled relative to the ground to provide smoother travel path for the bed 1114 between the upright and reclined positions as discussed herein. For example, a user shifting body weight move from the reclined position to the upright position focuses more of the body weight toward the arced track 1127 (rear of the bed 1114). The downward angle from the foot of the bed 1114 creates a downward slope, facilitating movement of the first guide assembly downwards (with gravity) along the straight track 1124 as the user shifts body weight toward the rear of the bed 1114.

In some embodiments, the straight track 1124 can be inclined relative to the ground (from the rear portion to the front portion) at an angle of about 1° to 30° (including about 9° to 20° and about 12° to 15°, including the aforementioned values and bordering ranges). In some embodiments, the straight track 1124 can include curved portions as discussed herein in reference to the arced track 1127. In some embodiments, the straight track 1127 can be substantially arcuate such as the arced track 1127 as discussed herein.

As illustrated in FIG. 11, the pivot connection 1116 between the backrest 1112 and bed 1114 is located closer to the second guide assembly 1133 than the first guide assembly 1132. The further a point on the bed 1114 is away from the pivot 1116, the less that point on the bed 1114 vertically travels. Stated differently, the vertical travel of a point on the bed 1114 is generally inversely proportional to the distance from the pivot 1116. Thus, as the backrest 1112 and the bed 1114 pivot relative to each other about the pivot connection 1116, the second guide assembly 1133 has more vertical travel than the first guide assembly 1132. For example, the second guide assembly 1133 can vertically travel about 7 to 15 inches, including about 8 to 12 and about 9 to 10 inches, including the foregoing values and bordering ranges, between the upright and reclined positions, while the first guide assembly 1132 can vertically travel about 2 to 6 inches, including about 3 to 5 and about 4 to 5 inches, including the foregoing values and ranges bordering, between the upright and reclined positions.

The relatively more vertical of the second guide assembly 1133 relative to the vertical movement of the first guide assembly 1133 results from the backrest 1114 pivoting about the pivot member 1412. The backrest 1114 acts like seesaw like about pivot member 1412, causing the pivot connection 1116 to move in a teeter like fashion relative to the pivot member 1412. The further the point along the bed 1114 is away from the pivot connection 1116, the less of the effect of the moving (teetering) pivot connection 1116. The relative vertical and horizontal movements of the bed 1114 discussed herein facilitates the movement of the backrest 1112 and bed 1114 into a relatively flat position as a person reclines in the seating 1100.

The arced track 1127 can have any combination of arcuate, circular, oval, elliptical, and/or any other suitable shape for creating a path of travel to accommodate the vertical movement of the bed 1114 discussed herein. The path of travel can be continuous. The path of travel can gradually and smoothly transition between the various shapes. The arcuate, curved, circular, oval, and/or elliptical shape of the arced track 1127 provides for the necessary horizontal movement of second guide assembly 1133 that matches the horizontal movement of the first guide assembly 1132 while simultaneously providing for the relatively larger vertical movement of the second guide assembly 1133 (compared to the vertical travel of the first guide assembly 1132) because the second guide assembly 1133 is closer to the pivot connection 1116. The relatively larger vertical movement of the second guide assembly 1133 facilitates the backrest 1112 and bed 1114 reclining into a substantially flat position.

An example method for increasing the vertical distance between the rear portion of the bed 1114 and the ground as the backrest 1112 reclines is explained below. As shown in FIG. 11, at least a portion of the track 1127 is curved upwards, with the higher portion of the curve/arc toward the front member 1120 and the lower portion of the slope toward the middle member 1121. The guide assembly 1133 is engaged with the track 1127 within this arcuate portion of the track 1127. When the backrest 1112*a* is in the upright position, the guide assembly 1133*a* is engaged with the track 1127 near the bottommost portion of the curve. As the backrest 1112*b* reclines, the guide assembly 1133*b* slides up the curve of the track 1127. When the backrest 1112*b* is fully reclined, the guide assembly 1133*b* is engaged with the track 1127 near the topmost portion of the curve. Such a configuration increases the vertical distance between the rear of the bed 1114*b* and the ground as the backrest 1112*b* reclines, permitting the bed 1114*b* to reverse angle of inclination relative to the ground as discussed herein. As discussed above, the bed 1114*a* generally has about a 1° to 30° upwards angle relative to the ground as measured from the pivot connection 1116*a*. As the bed 1114*b* moves into the reclined position and the rear portion vertically rises as discussed herein, the inclination relative to the ground can to have a downward angle of about 1° to 30° (including about 9° to 20° and about 12° to 15°, including the aforementioned values and bordering ranges) as measured form the pivot connection 1116*b*. Stated differently, the bed 1114*a* moves from being inclined upwards in the upright position to the bed 1114*b* being declined downwards in the reclined position relative to pivot 1116. This configuration advantageously improves a user's comfort throughout the range of movement of the seating 1100. Further, this configuration and switch of inclination accommodates the pivoting the backrest 1112 about pivot member 1412 and allowing bed 1114 to rise along with rising pivot 1116 to form a substantially flat configuration (180° open) between the backrest 1112 and the bed 1114.

In some embodiments, the position of the pivot member 1412 on the frame 1118 may be vertically lowered. Lowering the position of the pivot member 1412 can allow for a more level configuration of the backrest 1112*b* and bed 1114*b* in the reclined position. For example, the pivot member 1412 may be lowered such that as the rear portion of the bed 1114*b* vertically rises with the pivot 1116*b*, the bed 1114*b* does not switch inclination (or slope) relative to the ground, but rather decreases in angle to become substantially level with the ground in the fully reclined position.

Alternatively, to achieve a leveled configuration of the backrest 1112*b* and bed 1114*b* in the reclined position, the bed 1114*b* may be further elevated above the frame 1118 as discussed herein, and in particular in reference to FIG. 18 below. For example, the extension 1150 connecting the bed 1114 and the second bracket 1148 can be made longer; another support rail may be added between the bed 1114 and the first bracket 1146; the arced tack 1127 can be extended to allow the second guide assembly 1133*b* to vertically rise further in the reclined position; the straight track 1124 can be further inclined upwards to further vertically rise the first guide assembly 1132*b* in the reclined position; and/or the straight track 1124 and/or the arced track 1127 can be positioned vertically further up on the frame 1118.

Figure 18:
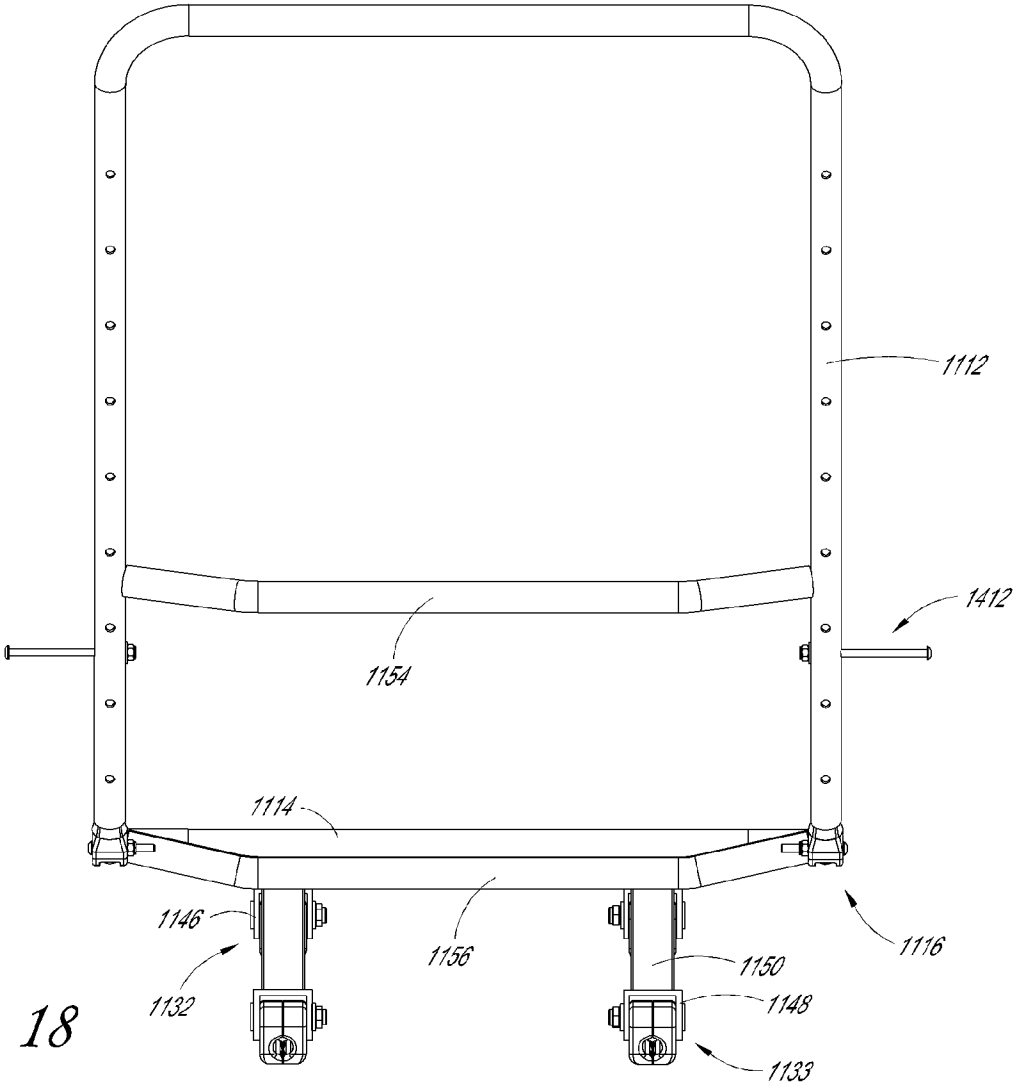
FIG. 18 is a back view of an embodiment of the backrest and the bed of the seating.

FIG. 18 is a back view of an embodiment of the backrest 1112 and the bed 1114 of the seating 1100. The backrest 1112 can have a backrest rail 1154 connected to a frame of the backrest 1112. The backrest rail 1154 can buttress and support the frame of the backrest 1112. The backrest rail 1154 can support upholstery or supportive straps as discussed herein. The bed 1114 can have a bed rail 1156 connected to a frame of the bed 1114. The bed rail 1156 can support upholstery or supportive straps. The bed rail 1156 can connect to the extension 1150, to which the brackets 1148 are connected, to which the second guide assemblies 1133 are connected as discussed herein. The bed 1114 can have more than bed rail 1156. A second bed rail 1156 can be connected to the bed 1114 near the location of the first guide assemblies 1132 along the bed 1114. Brackets 1146 can be directly connected to the second bed rail 1156 to which the first guide assemblies 1132 are connected.

As illustrated in FIG. 18, the backrest rail 1154 and the bed rail 1156 can be shaped to have a u-shape configuration. The u-shape configuration is provided by bends or kicks in the backrest rail 1154 and the bed rail 1156. The u-shaped backrest rail 1154 and bed rail 1156 elevate the frames of the backrest 1112 and bed 1114 relative to, for example, the guide assemblies 1132, 1133, the tracks 1124, 1127, and/or frame 1118 of the seating 1100. Elevation of the backrest 1112 and/or bed 1114 can be advantageous to, for example, help prevent snagging of upholstery or supportive straps as the backrest 1112 and bed 1114 slide on the tracks relative to the frame 1118 as discussed herein. In some embodiments, the backrest rail 1154 or the bed rail 1156 can be a straight member where, for example, elevation the backrest 1112 and the bed 1114 is not desired.

Example Embodiment of a Chair with an Ottoman

Another example embodiment of reclinable or adjustable seating 2100 and possible accessories, such as an ottoman 3100, are shown in FIGS. 19-28. In this example, the seating 2100 can be a chair as discussed, for example, in reference to FIGS. 1-7. The seating 2100 can also be used with an ottoman 2100. The seating 2100, with or without the ottoman 2100, can be integrated into a variety of formal and casual, indoor and outdoor seating options, such stationary or swivel rockers or chairs, lounge chairs, action loungers or swivel action loungers, chaise loungers, settees, love seats, couches, and the like.

Figure 19:
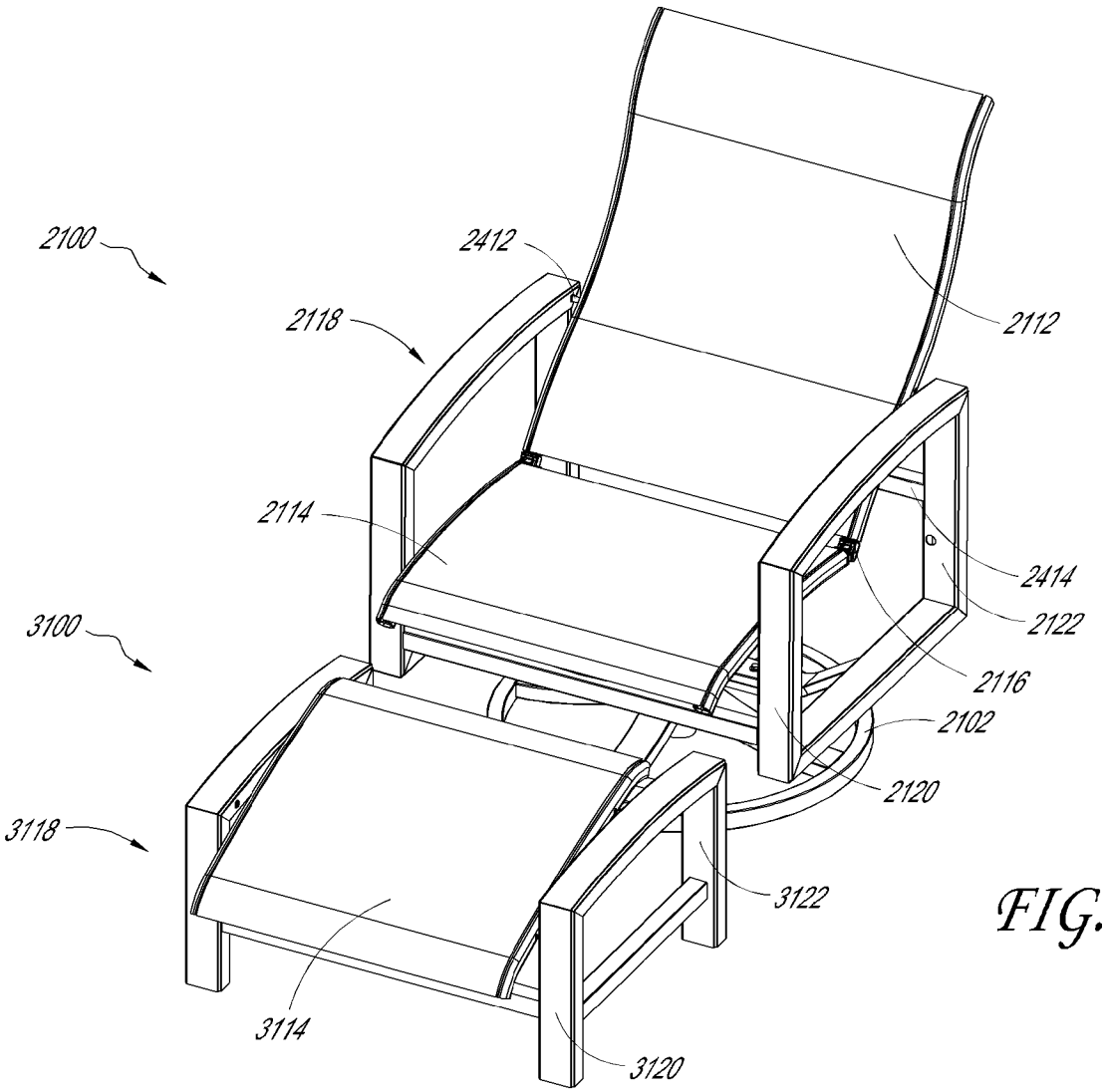
FIG. 19 illustrates a side, top, perspective view of an embodiment of a reclinable seating with an ottoman.

FIG. 19 illustrates a side, top, perspective view of an embodiment of a reclinable seating 2100 with an ottoman 2100. The seating 2100 can have a frame 2118 disposed about a seat 2114 and a backrest 2112 as discussed herein, and in particular, as discussed in reference to FIGS. 1-5. The frame 2118 can have a front member 2120 and a rear member 2122 as discussed herein, and in particular, as discussed in reference to FIGS. 1-5. The backrest 2112 can be pivotally connected to the frame 2118 via a horizontal rear member or pivot member 2412 as discussed herein. The pivot member 2412 is configured to provide support for the backrest 2112 and to provide a pivot connection to the frame 2118 that allows the backrest 2112 to move in relation to the seat 2114 and/or frame 2118. The second rear member 2412 can include a hinge, pin, rod, ball and socket, or other suitable pivot connection and/or member adjoined to or passing through the backrest 2112 as discussed herein, and in particular, in reference to FIG. 15. In some embodiments, a back rail 2414 of the frame 2118 can act as a stop to inhibit further pivoting (e.g., beyond a desired reclined position) of the backrest 2112 about the pivot connection or second rear member 2412. In some embodiments, the backrest 2112 can pivot about other parts of the frame 2118, such as, for example, the back rail 2414. As illustrated in FIG. 19, the backrest 2112 and/or seat 2114 has a fabric and/or mesh sling suspended between support members of the backrest 2112 and/or seat 2114. In some embodiments, the backrest 2112 and/or seat 2114 can have cushioning, woven straps, and/or solid case materials as discussed herein.

With continued reference to FIG. 19, the seating 2100 can have a seat 2114 pivotally connected to the backrest 2112 via the pivot connection 2116 such as, for example, a hinge, pin, rod, or other suitable pivot connection, as discussed herein, and in particular, in reference to FIGS. 14A-C. The pivot connection 2116 allows the backrest 2112 and seat 2114 to move relative to each other guided by other pivots, guides, and tracks as discussed herein. The pivot connection 2116 enables the seat 2114 to move with the backrest 2112 to provide a fluid and synchronized (backrest 1112 and seat 2114 moving together) transition between the upright and reclined position as discussed herein.

The ottoman 3100 can have a rest (e.g., a foot rest or support surface) 3114 that is used by the user as, for example, a foot rest when in the seating 2100. The ottoman 3100 can have a frame 3118 disposed about the rest 3114. The frame 3118 can have a front member 3120 and a rear member 3122 as discussed herein. As illustrated in FIG. 19, the rest 3114 has a fabric and/or mesh sling suspended between support members of the rest 3114. In some embodiments, the rest 3114 can have cushioning, woven straps, and/or solid case materials as discussed herein.

Figure 20:
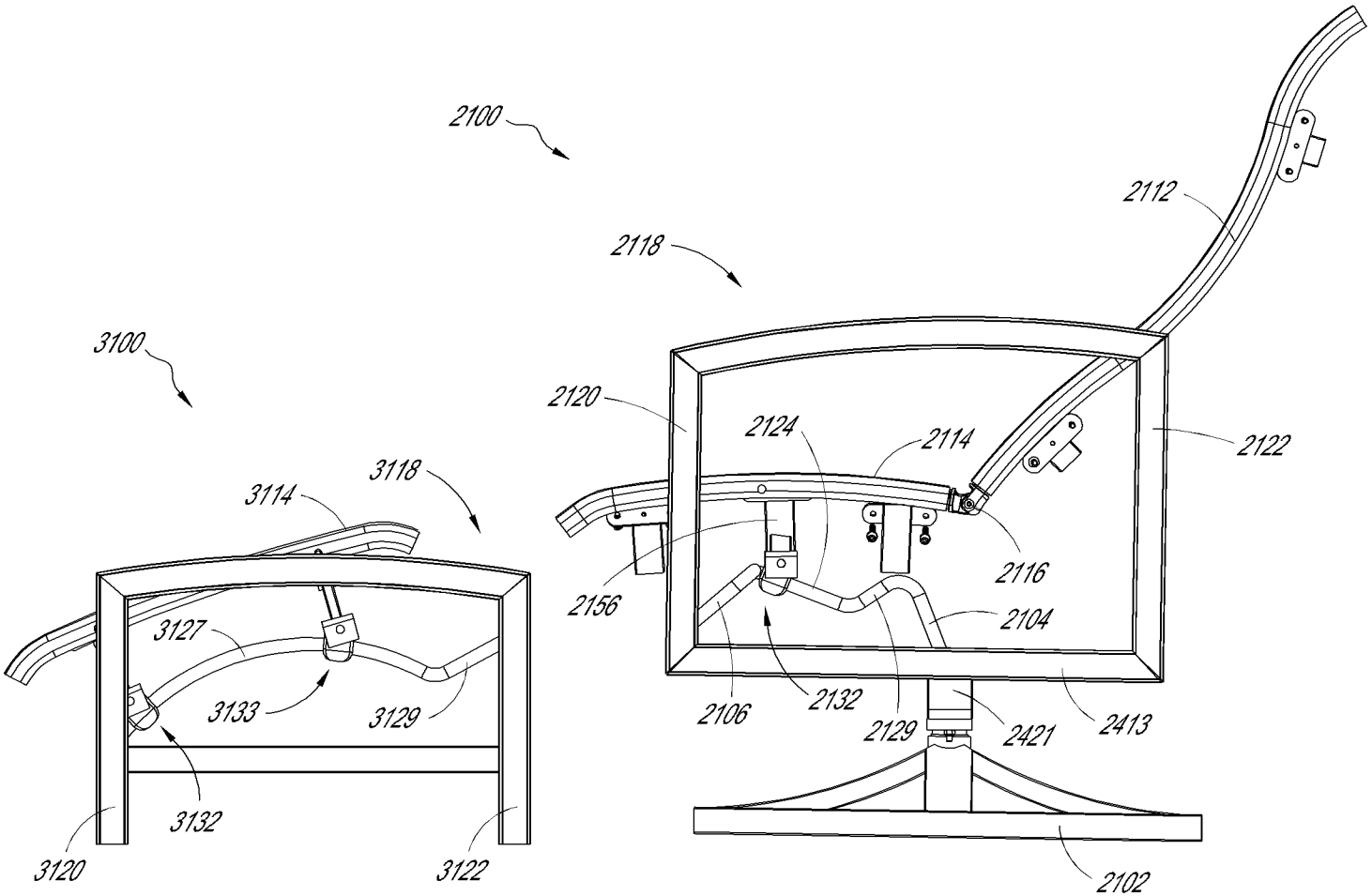
FIG. 20 illustrates a side view of an embodiment of a seating and an ottoman.
Figure 21:
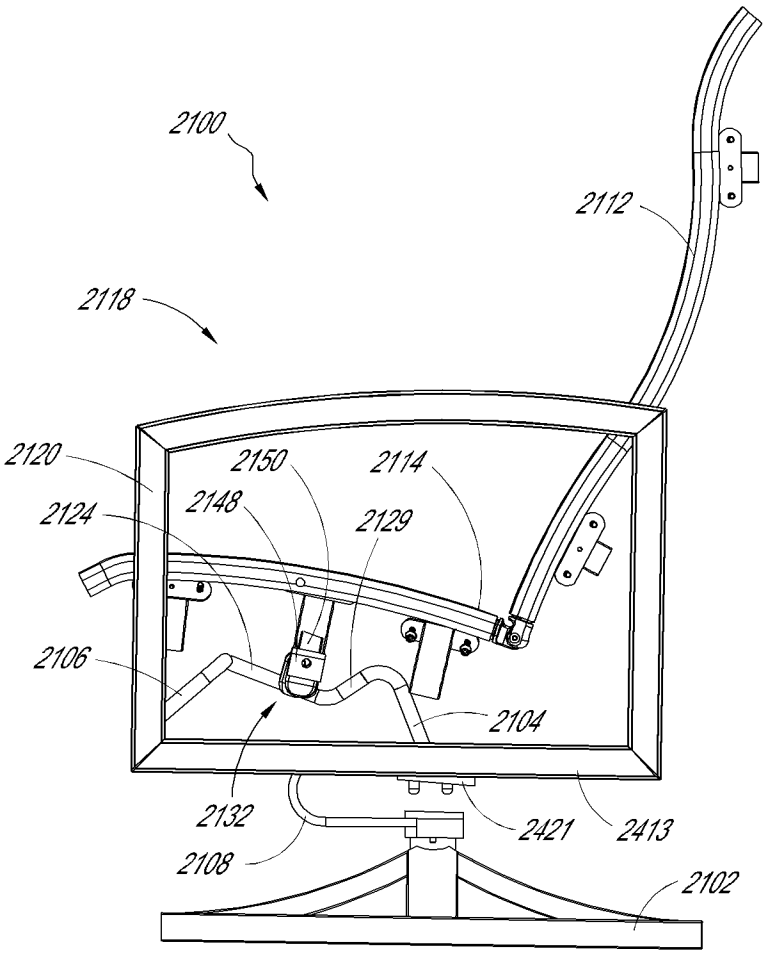
FIG. 21 illustrates a side view of an embodiment of a seating in an upright position.
Figure 22:
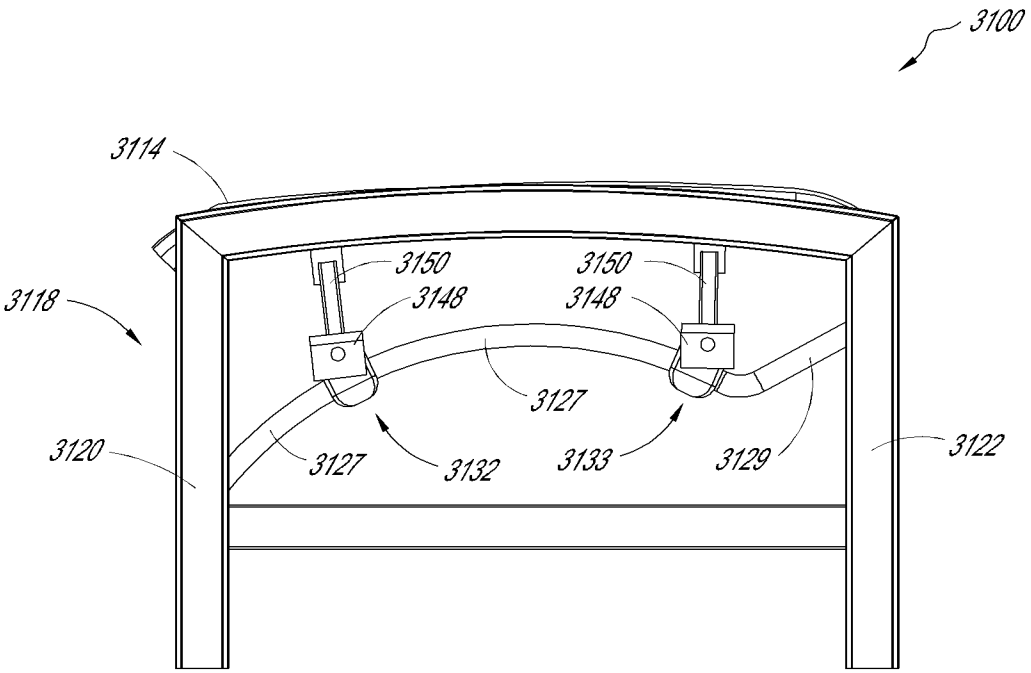
FIG. 22 illustrates a side view of an embodiment of an ottoman.

FIG. 20 illustrates a side view of an embodiment of a seating 2100 and an ottoman 3100 in a reclined position. FIG. 21 illustrates a side view of an embodiment of a seating 2100 in an upright position. FIG. 22 illustrates a side view of an embodiment of an ottoman 3100 in a first resting position.

As illustrated in FIGS. 20-22, the seating 2100 can have a guiding rail or track 2124 as discussed herein, and in particular, as discussed in reference to track 124 corresponding to FIGS. 1-2 and 4-9. The ottoman 3100 can have an arced track 3127 as discussed herein, and in particular, as discussed in reference to curved track 1127 corresponding FIGS. 10-13 and 16. In some embodiments, the seating 2100 can have an arced track as discussed herein, and in particular, as discussed in reference to curved track 1127 corresponding FIGS. 10-13 and 16. In some embodiments, the ottoman 3100 can have a track or straight track as discussed herein, and in particular, as discussed in reference to track 124 and straight track 1124 corresponding to FIGS. 1-2, 4-9, 10-13, and 16. As further illustrated in FIGS. 20-22, the seating 2100 can have a guide or guide assembly 2132 as discussed herein. The ottoman 3100 can have a first guide or first guide assembly 3132 and a second guide or second guide assembly 3133. The guide assemblies 2132, 3132, 3133 can be the guide assemblies as discussed herein, and in particular, as discussed in references to guide assemblies 132, 1132, 1133 corresponding to FIGS. 6, 7, 16, and 17. For example, the guide assemblies 2132, 3132, 3133 can be assembled from sliding shoes made of durable material(s) having a low coefficient of friction with the track 2124 and arced track 3127. The material should be sufficiently durable to withstand repeated use under heavy loads as discussed herein and can include materials discussed herein. The guide assemblies 2132, 3132, 3133 can have frictional control, such as frictional control 616 discussed in reference to FIGS. 6 and 7. The guide assemblies 2132, 3132, 3133 can have other tightening and friction control mechanisms, such as a nut and bolt assembly 1115, 1117 discussed in reference to FIGS. 16 and 17.

With continued reference to FIGS. 20-22, the guide assembly 2132 is connected to the seat 2114 with a bracket 2148 and an extension 2150 (see also FIG. 25) as discussed herein, and in particular, as discussed in reference to extensions 1250 and brackets 1148 corresponding to FIG. 18. The extension 2150 can elevate or space the seat 2114 from the guide assembly 2132 and/or frame 2118 to provide sliding clearance between the seat 2114 and other components of the seating 2100. The sliding clearance can provide clearance to accommodate, for example, upholstery, cushions, and other features attached to seat 2114 and/or frame 2118 and allow for movement of the seat 2114 as discussed herein. The guide assembly 2132 can be connected to the bracket 2148 via a nut and bolt assembly 1115, 1117 or other suitable attachment mechanisms as discussed herein.

As illustrated in FIGS. 20-22, 27 and 28, the ottoman 3100 can have a first guide assembly 3132 and a second guide assembly 3133 connected to a rest 3114 with brackets 3148 and extensions 3150 as discussed herein, and in particular, as discussed in reference to extensions 1250 and brackets 1148 corresponding to FIG. 18. The extensions 3150 can elevate or space the rest 3114 from the guide assemblies 3132, 3133 and/or frame 2118 to provide sliding clearance between the rest 3114 and other components of the ottoman 3100. The sliding clearance can provide clearance to accommodate, for example, upholstery, cushions, and other features attached to rest 3114 and/or frame 3118 and allow for movement of the rest 3114 as discussed herein. The guide assemblies 3132, 3133 can be connected to the brackets 3148 via nut and bolt assemblies 1115, 1117 or other suitable attachment mechanisms as discussed herein.

FIGS. 19-21 illustrate an embodiment of the seating 2100 that is connected to a base 2102 that is in contact with the ground or resting surface. The base 2102 can be round about which the seating 2100 can pivot. For example, a user in the seating 2100 can rotate the backrest 2112 and seat 2114 to face a desired direction without lifting the seating 2100 from the ground or resting surface. Accordingly, the frame 2118 can be elevated above the resting surface by a pivotal connection to the base 2102. In particular, the front member 2120 and rear member 2122 may be not in contact with the ground, but still provide the desired support of the components of the seating 2100 as discussed herein.

FIG. 21 illustrates an embodiment of the seating 2100 with a spring 2108 connected to a round base 2102. The spring 2108 can provide the connection between the frame 2118 and the base 2102. For example, the spring 2108 may elevate the frame 2118 above the base 2102 and provide an indirect connection between the frame 2118 and the base 2102. The spring 2108 can provide a dampening/cushioning effect when the user gets into the seating 2100. As illustrated in FIG. 21, the spring 2108 can be a spring leaf. In some embodiments, the spring 2108 can be a coil spring suspended between the frame 2118 and the frame 2108. In some embodiments, the spring 2108 may encase a support member that can further provide a dampening/cushioning effect.

As discussed herein, the seating 2100 can respond to changes in the user's center of gravity by the seat 2114 and backrest 2112 moving to accommodate the user's position. FIG. 20 illustrates the seating 2100 in a fully reclined position. FIG. 21 illustrates the seating 2100 in a fully upright position. The reclined position can include the backrest 2112 reclining or tilting (FIG. 20) to be less vertical relative to an upright position (FIG. 21). As the seating 2100 moves from the upright position to the reclined position, a rear portion or end of the seat 2114 can begin to lift upward because the rear portion of the seat 2114 is pivotally connected to the backrest 2112, which is rotatably/pivotally connected to the frame 2118. In some embodiments, substantially a same inclination or slope of the seat 2114 relative to the ground can be maintained between the upright and reclined positions. For example, an angle or inclination relative to the ground of the seating 2114 in the fully reclined position may be in the range of 1° to 25° degrees from the rear of the seat 2114 or pivot connection 2116. Accordingly, the vertical distance between the front portion or end of the seat 2114 and the ground can increase as the backrest 2112 reclines. Comfort and convenience for the user can be enhanced by configuring the seating 2100 such that, in use, the front portion of the seat 2114 will rise with the rear portion. The plane or angle of the seat 2114, with respect to its front, may decrease with respect to the floor or ground as the seating is reclined, or the plane or angle may remain relatively constant.

As illustrated in FIG. 21, angle of the seat 2114 in the upright position may be in the range of 1° to 25° degrees from the rear of the seat 2114 or pivot connection 2116. FIG. 20 illustrates an embodiment of the seating 2100 where the angle of the seat 2114 in the reclined position decreases from the upright position relative to the ground. For example, the seat 2114 may be substantially level or flat (e.g., 0° degrees) relative with the ground. In some embodiments, the angle 2214 of the seat 2114 in the reclined position may decrease to be negative relative to the ground from the rear of the seat 2114 or pivot connection 2116. For example, the angle of the seat 2114 in the reclined position may be −1° to −22° degrees relative to the ground from the rear of the seat 2114 or pivot connection 2116. In some embodiments, the seat 2114 may be substantially flat or level with the ground in the upright position with the angle of the seat 2114 decreasing as the seating 2100 is moved into the reclined position. Such an arrangement of the seating 2100 to have an angle of the seat 2114 that moves into a flat/level or negative angle in the reclined position can help accommodate the use of an ottoman 3100 as discussed herein. For example, as the user reclines the seating 2100, the rest 3114 of the ottoman 3100 may generally be at a vertical height that is less than the vertical height of the seat 2114 (e.g., front portion of the seat 2114). In order to accommodate the flatter position (e.g., nearly or substantially prone position) of the user, the angle of the seat 2114 as discussed herein may decrease to help a user comfortably attain or maintain contact with the vertically lower ottoman while having, for example, substantially or nearly straight legs.

For the user's safety and/or comfort, it can be desirable to limit the seating 2100 movement. As explained above, the rear portion of the seat 2114 lifts as the backrest 2112 reclines. This motion causes the front portion of the seat 2114 to move laterally outward (in a direction away from the backrest 2112). It can be desirable to limit this forward lateral travel to between about 3 in. (7.62 cm) and 8 in. (20.32 cm), for example, to about 4¾ in. (12.07 cm) of forward lateral travel for dining-type seating or about 6.375 in. (16.19 cm) of forward lateral travel for deep-type seating. As another example, it can also be desirable to limit the backward lateral travel of the seat 2114 (travel toward the direction of the backrest 2112). As the seat 2114 moves backward, toward the backrest 2112, the backrest 2112 will move forward toward the seat 2114 which should be limited to, for example, inhibit the backrest 2112 and seat 2114 closing in on each other (folding onto each other).

As discussed herein, the seating 2100 can respond to changes in the user's center of gravity by the seat 2114 and backrest 2112 moving to accommodate the user's position. As the seating 2100 is moved between the upright and reclined positions, the ottoman 3100, and in particular, the rest 3114 can move to accommodate the shift in position of the user and corresponding shift in the user's position. FIGS. 20 and 22 illustrate side views of an embodiment of an adjustable ottoman 3100 that can be used with reclinable seating 2100. The ottoman 3100 can move on a curved track 3127 with first and second guides 3132, 3133 engaging the arced track 3127. FIG. 22 illustrates the rest 3114 of the ottoman 3100 in a substantially level or flat angle position (e.g., a first resting position) relative to the ground. For example, the first resting position can include a position of the rest 3114 where a front portion/end of the rest 3114 (e.g., proximate to the front member 3120) is substantially at a same vertical height/distance (relative to the ground) as a rear portion/end of the seat 3114 (e.g., proximate to the rear member 3122). Stated differently, the angle between a front portion/end of the rest 3114 and a rear portion/end of the rest 3114 can be substantially zero relative to the ground. The first resting position of the seat 3114 may complement or correspond to the upright position of the seating 2100. The first resting position of the seat 3114 can be used to support the user's legs when the seating 2100 is in the upright position. In the upright position, a user may desire more direct and vertical support of his or her weight, including at the legs. In some embodiments, the first resting position of the seat 3114 can include the rest 3114 being upwardly inclined or sloping from the rear of the seat 3114 as discussed herein, and in particular, as discussed herein in reference to the adjustable seating (e.g., barstool) 4100.

FIG. 20 illustrates the rest 3144 of the ottoman 3100 in a downwardly inclined or sloping position (e.g., a second resting position) where the front portion/end of the seat 3114 is at a lower vertical height/distance (relative to the ground) compared to the rear portion/end of the seat 3114. Stated differently, the angle of the seat 3114 in the second resting position may be −1° to −25° degrees relative to the ground from the rear of the rest 3114 or rear member 3122. The downwardly inclined/sloping angle of the seat 3114 may complement or correspond the reclined position of the seating 2100. For example, as discussed herein, the seat 2114 can either be flat or downwardly sloping in the reclined position. Accordingly, a user in the seating 2100 approaches a more flat position of the body (e.g., prone position) in the reclined position such that a downwardly sloping rest 3114 can complement downwardly stretched legs of the user extending from the downwardly sloped seat 2114 toward the ottoman 3100. In the reclined position, a user may desire to have his/her legs in a substantially straight position. A downwardly sloped rest 3114 can provide a substantially straight line or gradually curved line between the surfaces of the seat 2114 and the rest 3114 to accommodate the user's reclined position as the body of the user approaches the prone position. For example, the second resting position of the seat 3114 can be configured such that a straight tangent line coming off a top surface of rest 3114 points substantially directly at or into the seat 2114 and/or front portion of seat 2114. With such a configuration, the user can feel a substantially continuous weight support for the legs from the seat 2114 to the rest 3114 when in the reclined position in the seating 2100.

Figure 23:
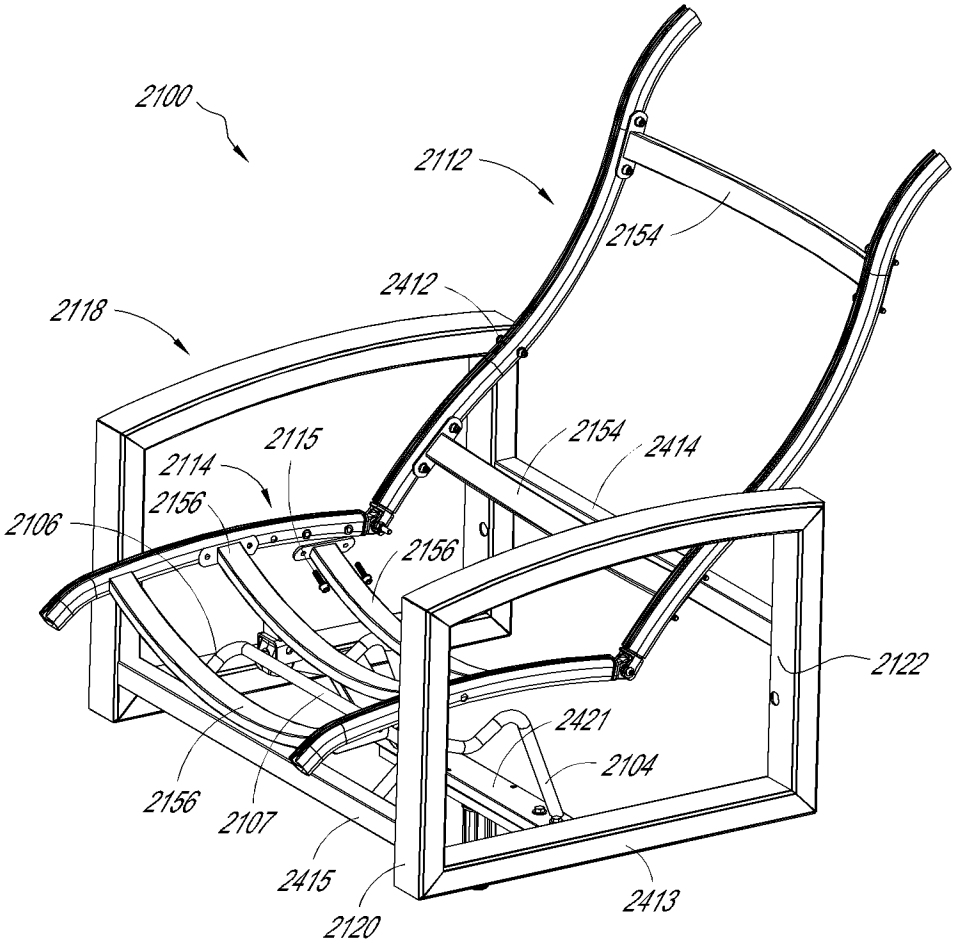
FIGS. 23-25 illustrate side front and back perspective views of an embodiment of the reclinable seating with various components removed for discussion purposes.
Figure 24:
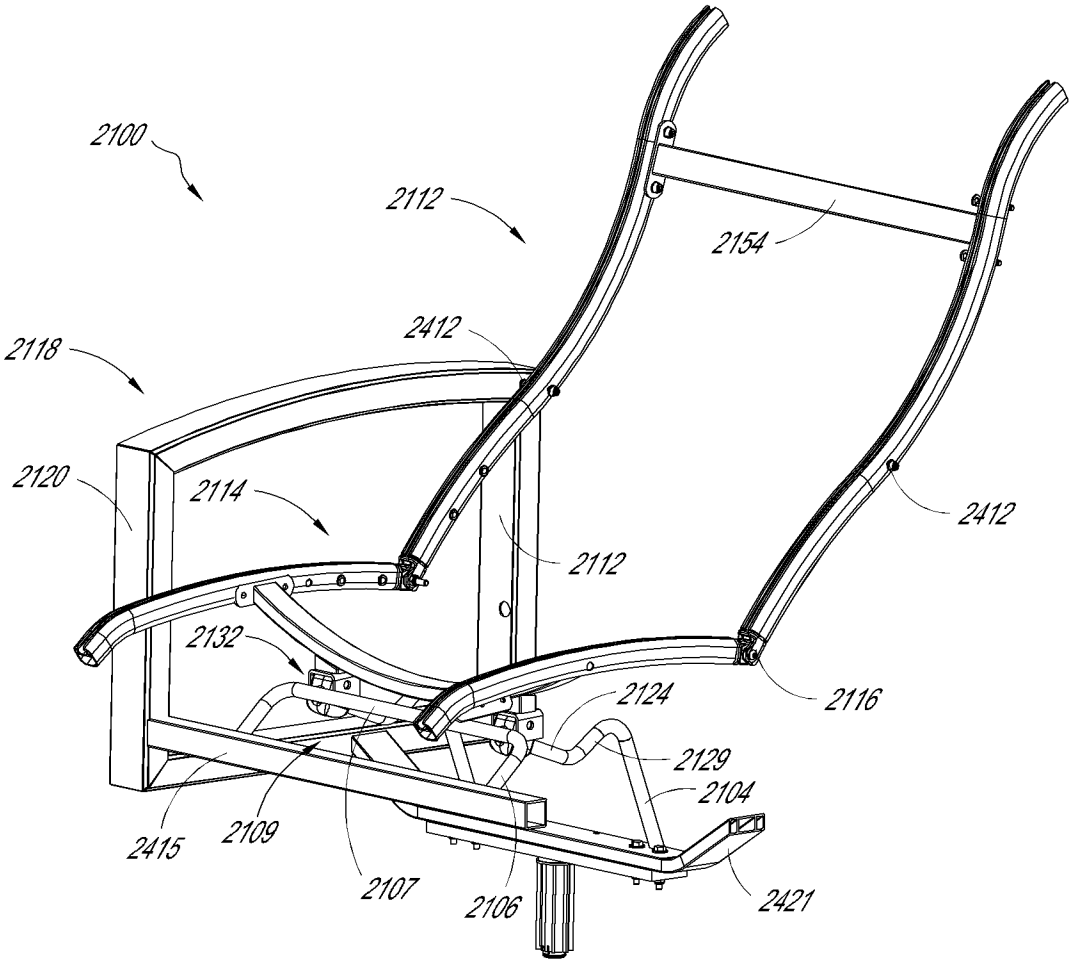
Figure 25:
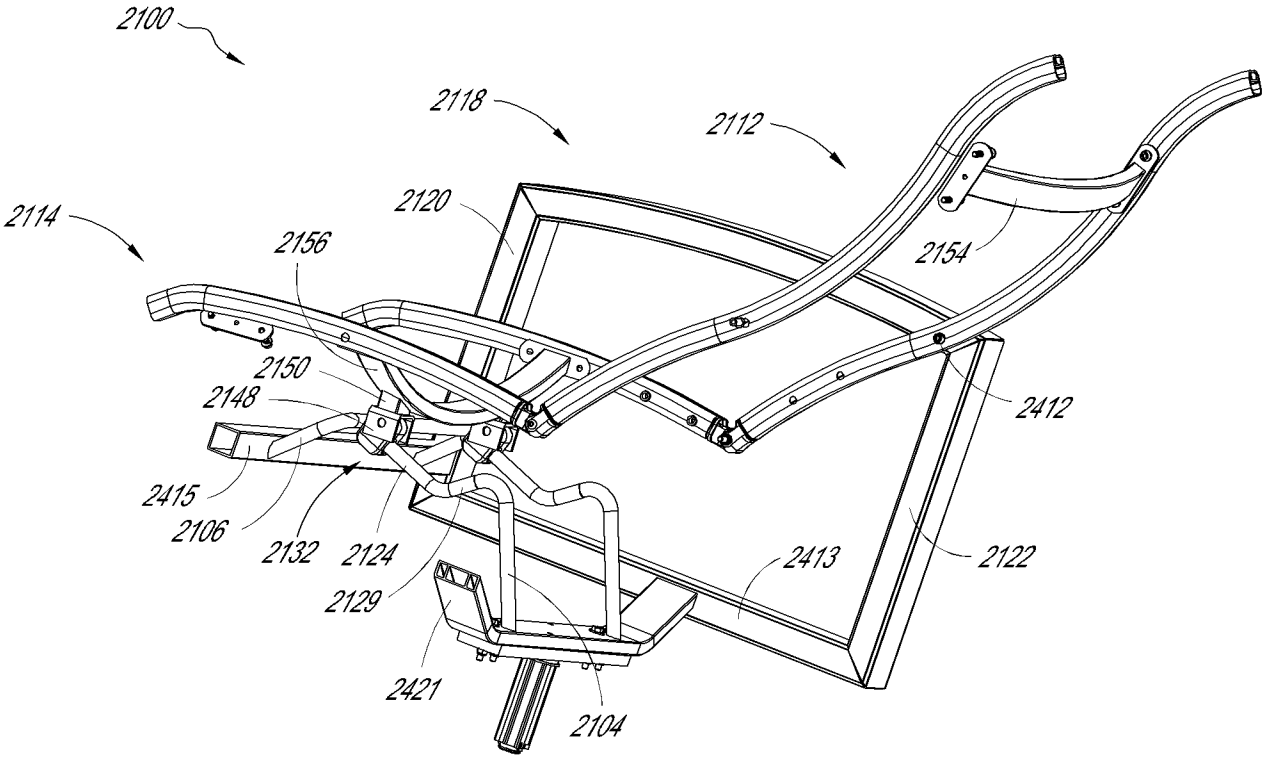

FIGS. 23-25 illustrate side front and back perspective views of an embodiment of the reclinable seating 2100 with various components removed for discussion purposes. FIG. 23 illustrates the seating 2100 with the mesh and/or fabric sling removed from the backrest 2112 and seat 2114 to illustrate, for example, the backrest rails 2154 and the seat rails 2156. The backrest rails 2154 and the seat rails 2156 can be secured to the backrest 2112 and seat 2114, respectively, with for example, bolts 2115 and/or other suitable attachment mechanisms as discussed here. The backrest rails 2154 and seat rails 2156 can be arced or curved to, for example, accommodate flexing in the sling when the seating 2100 is occupied by the user (e.g., the mesh flexes toward the backrest rails 2154 and seat rails 2156 under the weight of the user). Further, the backrest rails 2154 and seat rails 2156 can be arced, curved, or arcuate to, for example, elevate the seat 2114 above the guiding rails 2124 and/or frame 2118 to provide sliding clearance as discussed herein. As illustrated in FIG. 23, the seat 2114 can have three seat rails 2156. As also illustrated, the guide assembly 2132 can be attached to a middle or seat mid-rail 2156. In some embodiments, the seat 2114 can have 1, 2, or 4 or more seat rails 2156 and the guide assembly 2132 can be attached to any of the seat rails 2156 to achieve a desired rise and/or inclination of the seat 2114 as discussed herein.

Figure 26:
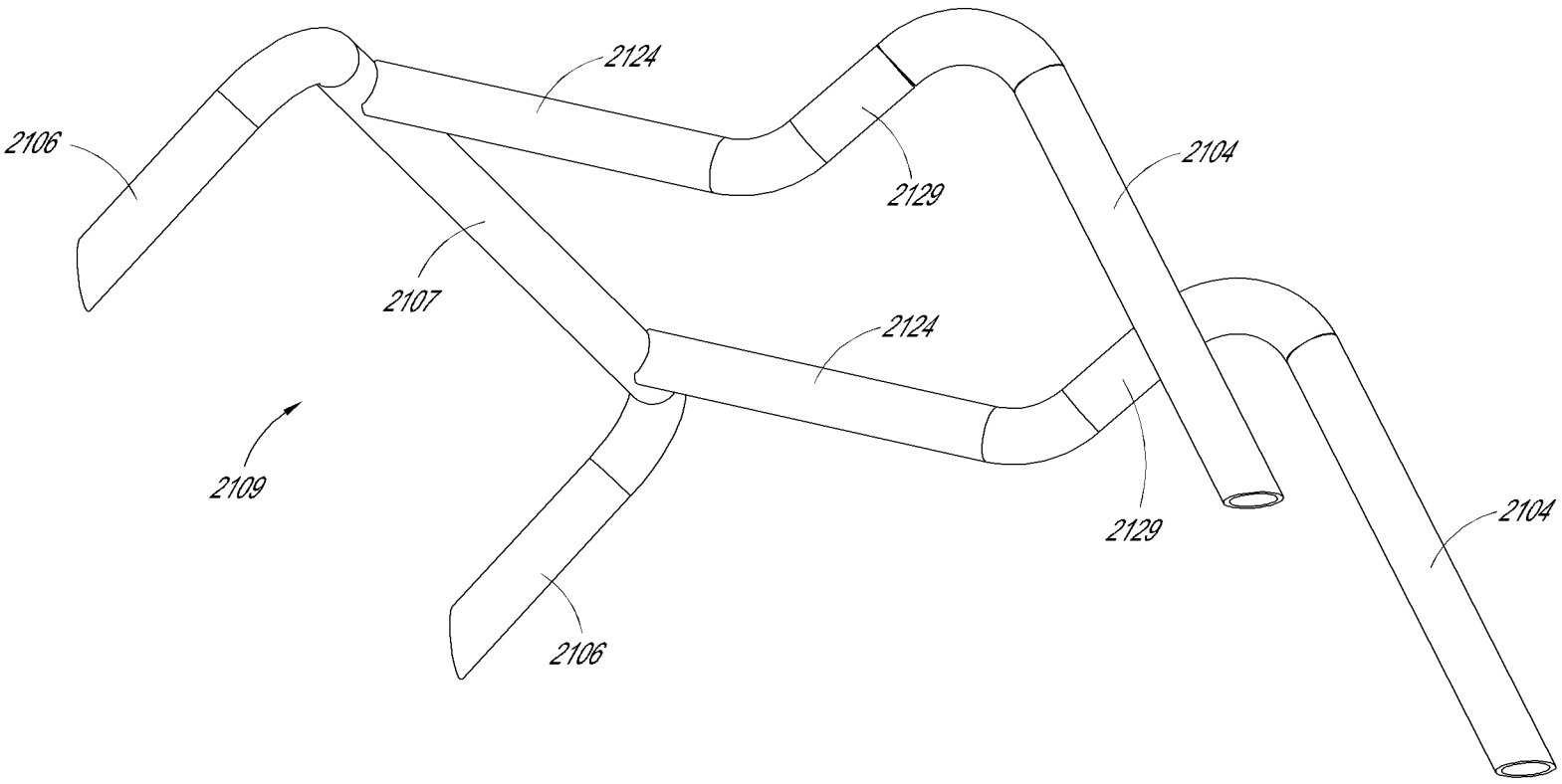
FIG. 26 illustrates a side, back, bottom perspective view of an embodiment of tracks.

FIGS. 24 and 25 illustrate side front and back perspective views of the an embodiment of the reclinable seating 2100 with mesh and/or sling fabric, one side of the frame 2118, some of the backrest rails 2154 and seat rails 2156, and the base 2102 removed for discussion purposes. FIG. 26 illustrates a side, back, bottom perspective view of an embodiment of a guiding rail 2124 and associated tracks. With reference to FIGS. 24-26, the guiding rail 2124 can be connected to a hanger rail 2129. The hanger rail 2129 can be connected to a support rail 2104. The support rail 2104 can be connected to a middle rail or member 2421 (e.g., a cross member). The middle member 2421 can extend from side to side of the frame 2118. Stated differently, the middle member 2421 can extend substantially perpendicular to the direction of the reclining movement of the seating 2100 as discussed herein. As illustrated in FIG. 25, the middle member 2421 can be connected to a support member 2413 that runs between the front member 2120 and the rear member 2122 of the frame 2118. The middle member 2421 can be arced to curve toward the ground (e.g., a U-shape). The arcuate shape of the middle member 2421 can elevate the frame 2118 and correspondingly, the backrest 2112 and seat 2114 to a desired vertical height/distance above the ground when, for example, the frame 2118 is connected to base 2102 as discussed herein. In some embodiments, the middle member 2421 can be substantially straight or flat. As illustrated in FIG. 21, the middle ember 2421 can be at a same vertical level as support member 2413 to accommodate and provide clearance for a spring 2108 as discussed herein.

Figure 27:
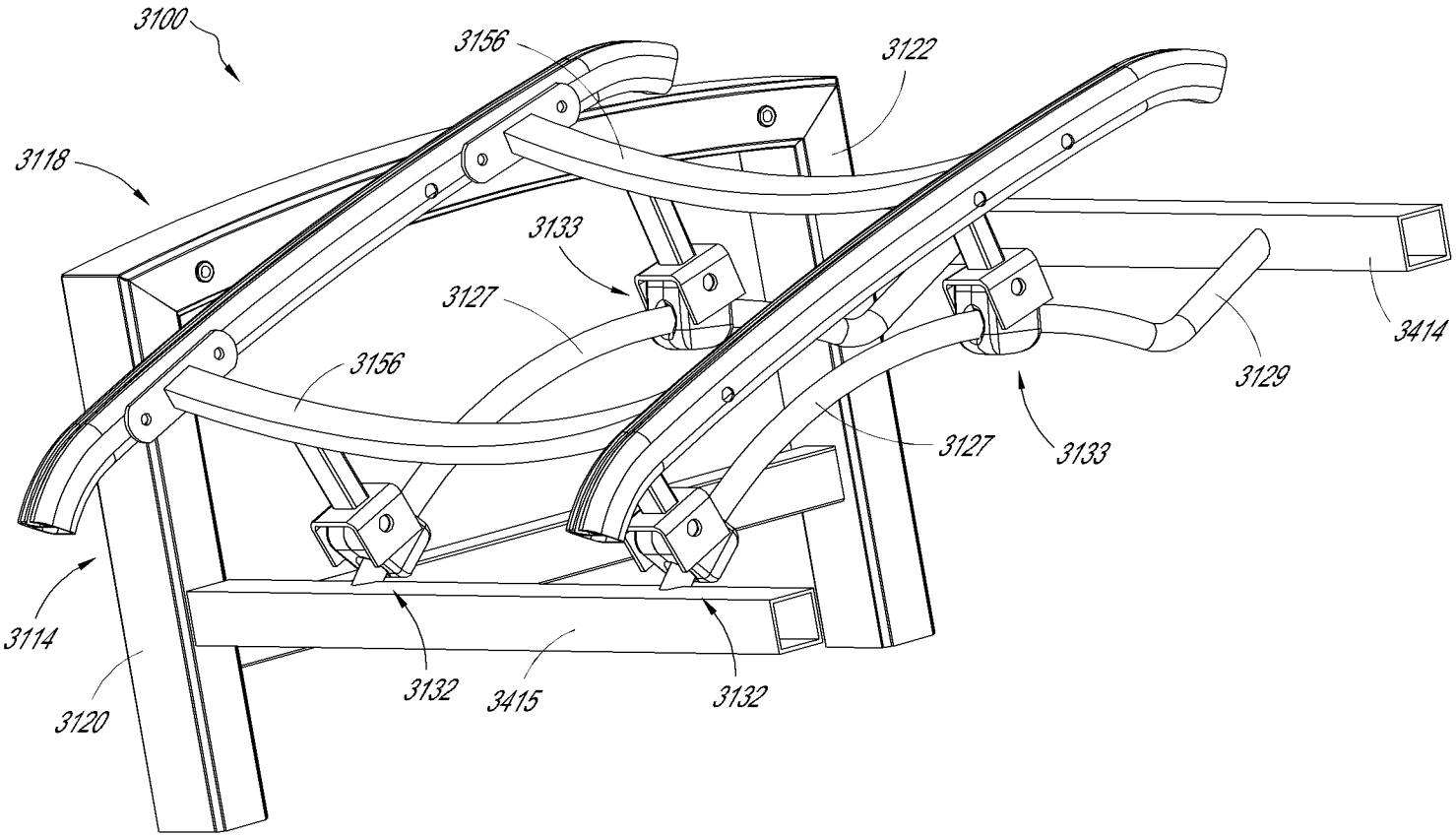
FIGS. 27 and 28 illustrate side front and back perspective views of an embodiment of an adjustable ottoman with various components removed for discussion purposes.

The middle member 2421 can be connected to the support rail 2104. In some embodiments, the support rail 2104 and/or hanger rail 2129 can extend to or connect to the frame 2118 proximate to the rear member 2122 as discussed herein, and in particular, as discussed in reference to FIGS. 1-5. The support rail 2104 can extend from the middle member 2421 generally upwardly, away from the ground or support surface. In some embodiments, the support rail 2104 can extend from other portions of the frame 2118 (e.g., rear member 2122 and/or support member 2413). As illustrated in FIGS. 25-27, the support rail 2104 can extend from the middle member 2421 generally toward the front of the seating 2100 (e.g., generally toward the front portion of the frame 2118, such as, the front members 2120). A hanger rail 2129 can extend from the support rail 2104 generally downwardly, toward the ground. The hanger rail 2129 can extend from the support rail 2104 generally toward the front of the seating 2100 (e.g., generally toward the front portion of the frame 2118, such as, the front members 2120). A guiding rail 2124 can generally extend upwardly (e.g., along a second direction), away from the ground. The guiding rail 2124 can extend from the hanger rail 2129 generally toward the front of the seating 2100 (e.g., generally toward the front portion of the frame 2118, such as, the front members 2120). As illustrated in FIGS. 20, 21, and 25-27, the guiding rail 2124 can extend upwardly at a slope or angle less than the support rail 2104. In some embodiments, the guiding rail 2124 can extend upwardly at a slope or angle greater than the support rail 2104 depending on the desired vertical rise and/or angle in the reclined position of the seat 2114 as discussed herein. An arm (e.g., a stay) 2106 can extend from the guiding rail 2124 generally downwardly (e.g., along a first direction), toward the ground. The arm 2106 can extend from the guiding rail 2124 generally toward the front of the seating 2100 (e.g., generally toward the front portion of the frame 2118, such as, the front members 2120). As illustrated in FIGS. 20, 21, and 25-27, the arm 2106 can extend downwardly at a slope or angle greater than the hanger rail 2129. In some embodiments, the arm 2106 can extend downwardly at a slope or angle less than the hanger rail 2129 depending on, for example, the slope of upwardly extent of the guiding rail 2124.

As illustrated in FIGS. 20 and 24-26, the arm 2106 can connect to the frame 2118 (e.g., to a front rail 2415). In some embodiments, the arm 2106 can connect to the frame 2118 at other portions of the frame 2118 (e.g., a front member 2120). Tracing the above connections in reverse, the arm 2106 can extend from the frame 2118 (e.g., front rail 2415) generally upwardly (e.g., along a first direction or another direction with a similar trajectory as the first direction), away from the ground or support surface. As illustrated in FIGS. 20 and 24-26, the arm 2106 can extend from the frame 2118 generally toward the rear of the seating 2100 (e.g., generally toward the rear portion of the frame 2118, such as, the rear members 2122). The guiding rail 2124 can extend from the arm 2106 generally downwardly (e.g., along a second direction or another direction with a similar trajectory as the second direction), toward the ground. As illustrated in FIGS. 20 and 24-26, the guiding rail 2124 can extend from the arm 2106 generally toward the rear of the seating 2100 (e.g., generally toward the rear portion of the frame 2118, such as, the rear members 2122). The hanger rail 2129 can extend from the guiding rail 2124 generally upwardly (e.g., along the first direction or another direction with a similar trajectory as the first direction), away from the ground. As illustrated in FIGS. 20 and 24-26, the hanger rail 2129 can extend from the guiding rail 2124 generally toward the rear of the seating 2100 (e.g., generally toward the rear portion of the frame 2118, such as, the rear members 2122). The support rail 2104 can extend from the hanger rail 2129 generally downwardly (e.g., along the second or another direction with a similar trajectory as the second direction as, for example, illustrated in FIG. 20), toward the ground. As illustrated in FIGS. 20 and 24-26, the support rail 2104 can extend from the hanger rail 2106 generally toward the rear of the seating 2100 (e.g., generally toward the rear portion of the frame 2118, such as, the rear members 2122).

As illustrated in FIGS. 20 and 21, the guide assembly 2132 can be configured to travel over the guiding rail 2124. As discussed herein, bends connecting other portions of the track to the guiding rail 2124 can be inhibit or prevent the guide assembly 2132 from traveling off the guiding rail 2124. For example, the transition and connection between the guiding rail 2124 and the hanger rail 2129 is provided by a bend forming a discontinuous path that the guide assembly 2132 cannot or is inhibited from traveling over. For example, when the guide assembly 2132 envelopes or substantially envelopes the guiding rail 2124 as discussed herein (e.g., via sliding shoes), the guide assembly 2132 would have to deform for the guide assembly 2132 to travel over the bend/discontinuous path from the guiding rail 2124 onto the hanger rail 2129. Such a configuration can limit the travel range of the guide assembly 2132 and accordingly, limit the travel range of the seating 2100 between the upright and reclined positions. As illustrated in FIG. 24-26, the guide assembly 2132 is further inhibited from traveling from the guiding rail 2124 to the hanger rail 2129 because of the change in slope or inclination from the guiding rail 2124 to the hanger rail 2129. With the weight of the user in the seating 2100, the guide assembly 2132 is inhibited from traveling onto and up the upwardly sloping hanger rail 2129 (against gravity) from the downwardly sloping guiding rail 2124 when the seating is moved into the upright position.

In some embodiments, the guiding rail 2124 can directly connect the frame 2118 (e.g., front rail 2415 or front members 2120) without an arm 2106 and/or rail bracket 2109 when a longer travel range of the guide assemblies 2132 is desired (e.g., greater range between the upright and reclined positions of the seating 2100). However, providing an arm 2106 and/or rail bracket 2109 that is downwardly sloping toward the ground provides sliding clearance for the seat 2114. For example, as illustrated in FIG. 21, the guiding rails 2124 not upwardly extending directly to the front members 2120 provides clearance for the front portion of the seat 2114 to transition downwardly and toward the front members 2120 as the seating 2100 is moved from the reclined position to the upright position as discussed herein.

In some embodiments, the arm 2106 can be directly connected to the guiding rail 2124 to slope at a different angle than the guiding rail 2124 such that a transition between the guiding rail 2124 and the arm 2106 is provided by a bend forming a discontinuous path that the guide assembly 2132 cannot or is inhibited from traveling over.

However, because the arm 2106 slopes downwardly toward the ground, the guide assembly 2132 would not be working against gravity to slide over from the guiding rail 2124 to the arm 2106 in embodiments where the arm 2106 is directly connected to guiding rail 214 to form a straight travel/guide path along a direction from the rear portion to the front portion of the frame 2118. Accordingly, a rail bracket 2109 as illustrated in FIGS. 24-26 can be provided to further inhibit or prevent the guide assembly 2132 from traveling over the arm 2106.

With reference to FIGS. 24-26, a rail bracket 2109 can be formed from two arms 2106 connected by a cross rail (e.g., a crossbar) 2107. As discussed herein, the arms 2106 can extend from the front rail 2415 generally upwardly, away from the ground. The cross rail 2107 can extend substantially horizontally/parallel to the ground to connect the arms 2106. The guiding rail 2124 can be connected to the cross rail 2107, away from the arms 2106. Connecting the guiding rail 2124 away from the arms on the cross rail 2107 creates a discontinuous path that substantially changes the travel direction from guide path on the guiding rails 2124 along a direction between the front and rear portions of the frame 2118. Stated differently, as the guide assembly 2132 travels along the guide path on the guiding rail 2124, the guide assembly 2132 comes up against a hard stop formed by the cross rail 2107 connected to guiding rail 2124 in a substantially perpendicular manner. Without substantial deformation and possible breaking of the guide assembly 2132 and other connection mechanisms discussed herein (e.g., bracket 2148 and/or extension 2150), the guide assembly 2132 is inhibited or prevented from traveling onto the arm 2106 as the guide assembly 2132 travels over the guiding rail 2124 and up against the cross rail 2107 during movement of the seating 2100 into the reclined position.

As illustrated in FIGS. 24-26, the seating 2100 can have two guide assemblies 2132 to guide the seat 2114 between the upright and reclined positions as discussed herein. Accordingly, the seating 2100 can have two guiding rails 2124 to support the two guide assemblies 2132. The two guiding rails 2124 can be connected to one rail bracket 2109 as illustrated in FIG. 26 (e.g., connected to the cross rail 2107 away from the arms 2106). In some embodiments, the cross rail 2107 may not extend to or extend fully between the two arms 2106. For example, the guiding rail 2124 may be horizontally offset from the arm 2106 as discussed herein such that the arm 2106 forms an L-shape configuration with the guiding rail 2124 connected to an end of one of the arms of the L-shape. The guiding rail 2124 can be offset from the arm 2106 in any desired direction, such as vertically (in combination with or without horizontal offset) to, for example, elevate the connecting end of the guiding rail 2124 to a desired vertical height (e.g., providing a great vertical rise of the seat 2114 as discussed herein). In some embodiments, each guiding rail 2124 can be connected to an individual rail bracket 2109. For example, the seating 2100 may have two brackets 2109 (with four arms 2106 and two cross rails 2107 connecting pairs of arms) with each bracket connected to an individual guiding rail 2124 to achieve the upright and reclined positions of the seating 2100 as discussed herein.

As illustrated in FIGS. 19 and 23-25, the support rail 2104, arms 2106, cross rail 2107, guiding rail 2124, and/or hanger rail 2129, can be sized and positioned (e.g., connected to the frame 2118) to be underneath the seat 2114 relative to the ground when the seating 2100 is on the ground. The arms and rails 2104, 2106, 2107, 2124, and/or 2129 can be sized and positioned to be within an outer boundary or perimeter of the seat 2114 when for example, the seating 2100 is in the first position. For example, the outer perimeter can be formed or defined by outer members or tubes forming the frame or support structure of the seat 2114. The arms and rails 2104, 2106, 2107, 2124, 2129 can be sized and shaped (e.g., straight) such that the arms and rails 2104, 2106, 2107, 2124, and/or 2129 can be positioned underneath the seat 2114 while achieving a desired height of the seating 2100. Stated differently, the guiding rail 2124 is sized and positioned to guide, push, or move the guide assembly 2132 along, for example, the guiding rail 2124 as discussed herein while providing the seating 2100 and/or the seat 2114 a desired or predetermined height or range of height, such as, for example, a height for a standard or conventional chair used for lounging and/or dining.

Figure 28:
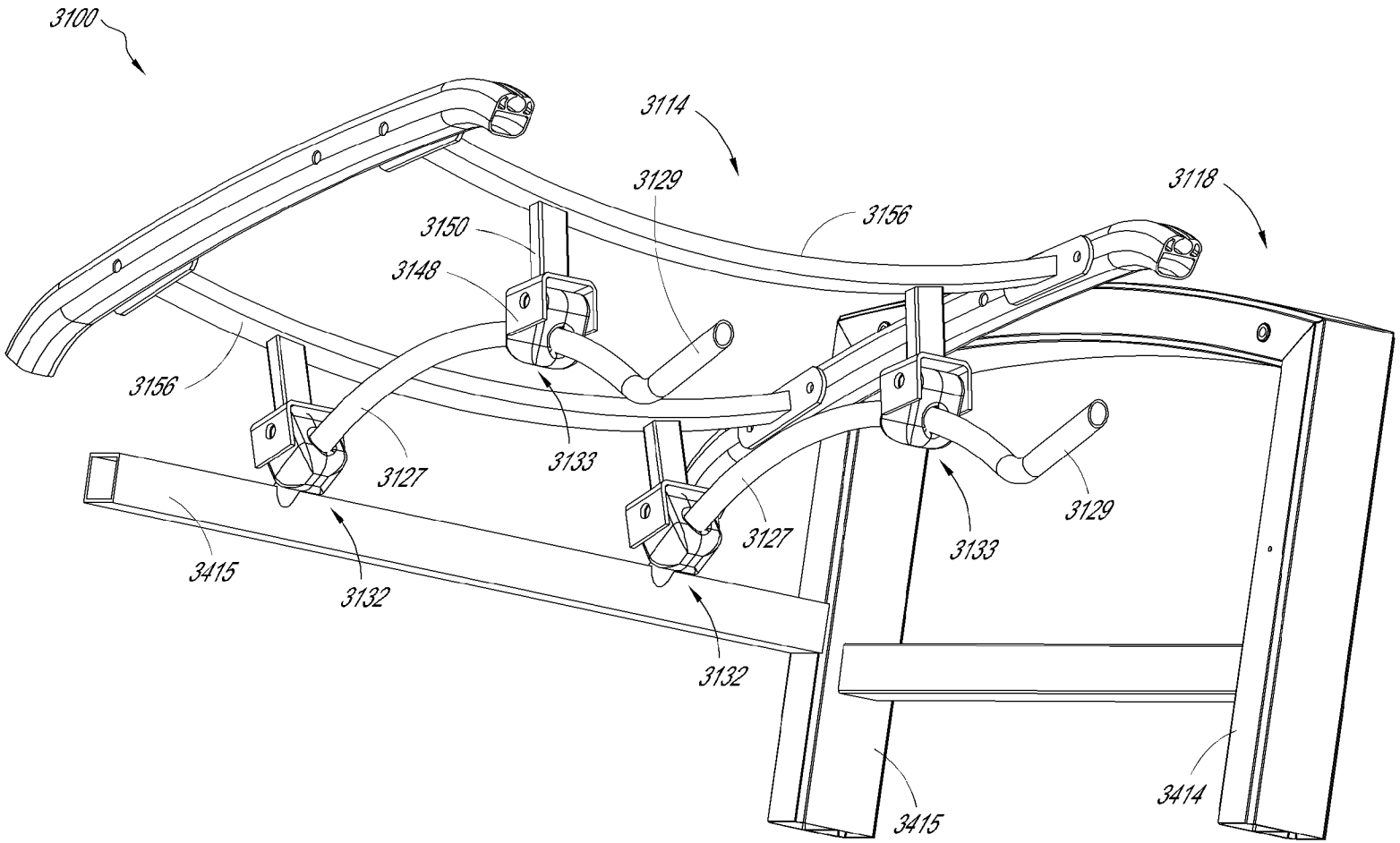

FIGS. 27 and 28 illustrate side front and back perspective views of an embodiment of an adjustable ottoman 3100 with various components removed for discussion purposes. FIGS. 27 and 28 illustrate the seating 3100 with the mesh and/or fabric sling and one side of the frame 3118 removed from the rest 3114 to illustrate, for example, rest rails 3156. The rest rails 3156 can be secured to the rest 3114 respectively with, for example, bolts, and/or other suitable attachment mechanisms. The rest rails 3156 can be arced or curved to, for example, accommodate flexing in the sling when the ottoman 3100 is occupied by the user (e.g., the mesh flexes toward the rest rails 3156 under the weight of the user). Further, the rest rails 3156 can be arced, curved, or arcuate to, for example, elevate the rest 3114 above the arced rails 3127 and/or frame 3118 to provide sliding clearance as discussed herein. As illustrated in FIGS. 27 and 28, the rest 3114 can have two rest rails 3156. As also illustrated, the first and second guide assemblies 3132, 3133 can be attached to both of the rest rails 3156. In some embodiments, the rest 3114 can have 1, 3, or 4 or more rest rails 3156, and the first and second guide assemblies 3132, 3133 can be attached to any of the rest rails 3156 to achieve a desired inclination(s) and support of the rest 3114 as discussed herein.

With continued reference to FIGS. 27 and 28, the arced rail 3127 can be connected to a front rail 3415. The front rail 3415 can extend from side to side of the frame 3118. Stated differently, the front rail 3415 can extend substantially perpendicular to the adjusting movement of the ottoman 3100 (e.g., the rest 3114) as discussed herein. The arced rail 3127 can also be connected to a hanger rail 3129. The hanger rail 3129 can be connected to a back rail 3414. The back rail 3414 can extend from side to side of the frame 3118. Stated differently, the back rail 3414 can extend substantially perpendicular to the adjusting movement of the ottoman 3100 (e.g., the rest 3114) as discussed herein. In some embodiments, the arced track 3127 and/or hanger rail 3415 can connect to other parts of the frame 3118, such as, for example, the front members 3120 and the back members 3122. In some embodiments, the arced track 3127 may be not connected to a hanger rail 3129. For example, the arced track 3127 can directly connect to the front rail 3415 and the back rail 3414. As another example, the arced track 3127 can directly connect to other parts of the frame 3118, such as the front members 3120 and the back members 3122.

As illustrated in FIGS. 27 and 28, the hanger rail 3129 can extend from the back rail 3414 generally downwardly, toward the ground or support surface. As illustrated in FIGS. 27 and 28, the arced track 3127 can extend from the hanger rail 3129 and can generally have a curvature and/or shape that is convex from a perspective of or relative to the rest 3114 and/or any other features proximate to top of the frame 3118. Stated differently, the arced track 3127 can generally have a curvature and/or shape that is concave from perspective of the ground or resting surface. In some embodiments, the arced track 3127 can be oppositely curved (e.g., concave from the perspective of the rest 3114 and convex from the perspective the ground) to provide an adjustment movement to the rest 3114 that functions as foot rest. For example, the rest 3114 on a concave arced track from the perspective of the rest 3114 would incline to provide a surface of the rest 3114 that faces the user in the seating 2100 for the user to rest the bottom of his/her feet. In some embodiments, the arced track 3127 can have straight portions (e.g., hangers 3129) or be wholly straight such as the straight track 1124 discussed herein.

As illustrated in FIGS. 22, 27, and 28, the concave curvature and/or shape of the arced track 3127 can provide a simultaneous horizontal and vertical movement or travel of the first and second guide assemblies 3132, 3133 along a constant and/or varying radius of curvature as discussed herein. As discussed further herein, the arced track 3127 and corresponding movements of the first and second guide assemblies 3132, 3133 allow for the downward tilting of the rest 3114 in the second resting position while limiting the vertical rise of the rear portion of the rest 3114 to not protrude past the frame 3118 beyond a desired vertical distance. The concave/convex shape of arced track 3127 can vary in length and/or radius of curvature such that a front portion of the arced track 3127 (proximal to the front member 3120) is at a greater downward slope relative to the resting surface from the perspective of the rear member 3122 than a mid-portion of the arced track 3127. As illustrated in FIG. 20, the arced track 3127 can have substantially a same curvature and/or radius throughout the arced track 3127. At the front portion of the arced track 3127, the first guide assembly 1132 can have an increasing vertical descent over a same distance in a direction from the rear portion to the front portion of the frame 3118 (e.g., in a direction from the rear member 3122 to the front member 3120) to provide a downwardly inclined angle to the rest 3114 in the second resting position as discussed herein. The arced track 3127 can have a curvature, changing curvature (e.g., as discussed in reference to the barstool 4100), and/or extension toward the ground to provide a desired downwardly inclined angle to rest 3114. For example, the greater the curvature (e.g., smaller radius of curvature) and/or the greater the extent of the arced track to the ground, the greater the downwardly inclined angle that will be imparted on the rest 3114 in the second resting position as the first guide assembly 3132 travels downwardly along the path, becoming more proximate to the front member 3120 as illustrated in FIGS. 27 and 28.

Stated differently, the concave/convex shape of arced track 3127 can provide a path along a front portion of the arced track 3127 for the first guide assembly 3132 that has an increasing vertical descent over a predetermined or same horizontal distance of travel relative the resting surface when the rest 3114 is being moved to the second resting position. As the rest 3114 is moved from the first resting position to the second resting position, the first guide assembly 1132 will first move or travel along a path that has a decreasing horizontal component (relative to the resting surface) over a predetermined distance or length along the path. As the rest 3114 is moved closer to the second position, the first guide assembly 1132 will move or travel along a path that increases in vertical travel (relative to the resting surface) over the same predetermined distance or length along the path. The increasingly vertical movement of the first guide assembly 3132 from the first resting position to the second resting position of the ottoman 3100 also occurs when viewed form a perspective of a predetermined horizontal distance relative to the resting surface. Such an arrangement of the arced track 3127 guides the movement of the first guide assembly 3132 where the rest 3114 tilts increasingly downwardly into the second resting position as discussed herein.

A generally opposite movement as discussed in reference to the first guide assembly 3132 can be imparted to the second guide assembly 3133. The concave/convex shape of arced track 3127 can vary in length and/or radius of curvature such that a rear portion of the arced track 3127 (proximal to the rear member 3122 and/or the hanger rail 3129) is at a greater downward slope relative to the resting surface from the perspective of the rear member 3122 than a mid-portion of the arced track 3127. At the rear portion of the arced track 3127, the second guide assembly 1132 can have an increasing vertical ascent over a same distance in a direction from the rear portion to the front portion of the frame 3118 (e.g., in a direction from the rear member 3122 to the front member 3120) to provide a downwardly inclined angle to the rest 3114 in the second resting position as discussed herein. The arced track 3127 can have a curvature, changing curvature (e.g., as discussed in reference to the barstool 4100), and/or extension toward the ground to provide a desired downwardly inclined angle to rest 3114. For example, the greater the curvature (e.g., smaller radius of curvature) and/or the greater the extent of the arced track to the ground, the greater the downwardly inclined angle that will be imparted on the rest 3114 in the second resting position as the second guide assembly 3133 travels along the path to be more proximate to a mid-portion of the arced track 3127 and/or a peak/top of the curvature of the arced track 3127 as illustrated in FIGS. 27 and 28.

Stated differently, the concave/convex shape of arced track 3127 can provide a path along a portion of the arced track 3127 for the second guide assembly 3133 that has a decreasing vertical ascent over a predetermined or same horizontal distance of travel relative the resting surface when the rest 3114 is being moved to the second resting position. As the rest 3114 is moved from the first resting position to the second resting position, the second guide assembly 1133 will first move or travel along a path that has an increasing horizontal component (relative to the resting surface) over a predetermined distance or length along the path. As the rest 3114 is moved closer to the second position, the second guide assembly 1132 will move or travel along a path that decreases in vertical travel (relative to the resting surface) over the same predetermined distance or length along the path. The decreasingly vertical movement of the second guide assembly 3133 from the first resting position to the second resting position of the ottoman 3100 also occurs when viewed form a perspective of a predetermined horizontal distance relative to the resting surface. Such an arrangement of the arced track 3127 guides the movement of the second guide assembly 3133 where horizontal movement of the second guide assembly 3133 accommodates the horizontal movement of the first guide assembly 3132 as discussed herein as the rest 3114 is moved into the second resting position and concomitantly, limiting the upward movement of the second guide assembly 3133 over the same horizontal movement. Limiting the upward movement of second guide assembly 3133 and accordingly, rear portion of the rest 3114 can enhance user comfort in the second resting position by mitigating, for example, the rear portion of the rest 3114 vertically rising more than a desired or predetermined distance or level, and pressing excessively or at an undesirable angle and height into the user's legs.

Conversely, as the rest 3114 is moved from a second resting position to the first resting position, the first guide assembly 3132 will first move or travel along a path that is initially more vertical (relative to the resting surface) over a predetermined distance or length along the path to bring the front portion of the rest 3114 up vertically over the predetermine distance. As the seating 1100 is moved closer to the first resting position, the second guide assembly 1133 will move or travel along a path that is mostly initially horizontal (relative to the resting surface) over the same predetermined distance or length along the path followed by a more vertical travel path to bring down the rear portion of the seat 3114 to be level with the front portion of the rest 3114 as the first resting position is approached. Such an arrangement of the arced track 1127 provides a smooth and continuous adjustment of the positions of the seating ottoman as discussed herein.

Accordingly, the greater the curvature of the arced track 3127, the greater to the extent the movement of the rest 3114 from the first to the second resting position may resemble a cantilevered movement of the rest 3114 that can be achieved by pivoting about the rear portion. For example, the rear portion of the rest 3114 can be pivotally/rotatably connected to the frame 3118 proximate to, for example, the rear member 3122. The front portion of the seat 3114 can pivot about the pivotally connected rear portion of the rest 3114. With such an arrangement, the rear portion of the rest 3114 can be rotated to any desired downward slope of the rest 3114, including having the front and rear portions of the rest 3114 being along a substantially vertical line, without or substantially without the rear portion of the rest 3114 rising vertically when the front portion of the rest is rotated downwardly.

As illustrated in FIGS. 20, 27, and 28, the first and second guide assemblies 3132 and 3133 can be configured to travel over the arced rail 3127. As discussed herein, bends connecting other portions of the track to the arced rail 3127 can inhibit or prevent the first and second guide assemblies 3132, 3133 from traveling off the arced rail 3127. For example, the transition and connection between the arced rail 3127 and the hanger rail 3129 is provided by a bend forming a discontinuous path, including a change to an upward slope of the guide path at the bend/connection that the second guide assembly 3133 cannot or is inhibited from traveling over as discussed herein.

As illustrated in FIGS. 27 and 28, the arced track 3127 is directly connected to the front rail 3415 creating a discontinuous path changing direction from the travel direction or guide path on the guiding rails 2124 along a direction between the front and rear portions of the frame 3118. Stated differently, as the first guide assembly 3132 travels along the guide path on the arced rail 3127, the first guide assembly 3132 comes up against a hard stop formed by the front rail 3415 connected to the arced rail 3127 in a substantially perpendicular manner. Without substantial deformation and possible breaking of the first guide assembly 3132 and other connection mechanisms discussed herein (e.g., bracket 3148 and/or extension 3150), the first guide assembly 3132 is inhibited or prevented from traveling onto or beyond the front rail 3415 as the first guide assembly 3132 travels over the arced rail 3127 during movement of the rest 3114 into the second resting position.

With continued reference to FIGS. 27 and 28, the ottoman 3100 can have two pairs of first and second guide assemblies 3132, 3133 supported on two arced tracks 3127. Accordingly, the rest 3114 can be provided with a four-point support system (e.g., four guide assemblies) without other connections to the frame 3118 or other portions of the frame 3118. The rest 3114 can be supported, elevated, and moved as discussed herein by being solely supported on the arced tracks 3127.

As illustrated in FIGS. 22, 27, and 28, the arced track 3127 and/or hanger rail 3129 can be sized and positioned (e.g., connected to the frame 3118) to be underneath the rest 3114 relative to the ground when the ottoman 3100 is on the ground. The arced track 3127 and/or hanger rail 3129 can be sized and positioned to be within an outer boundary or perimeter of the rest 3114 when for example, the ottoman 3100 is in the first position. For example, the outer perimeter can be formed or defined by outer members or tubes forming the frame or support structure of the rest 3114. The arced track 3127 and/or hanger rail 3129 can be sized and shaped (e.g., curved) such that the arced track 3127 and/or hanger rail 3129 can be positioned underneath the rest 3114 while achieving a desired height of the ottoman 3100. Stated differently, the arced track 3127 is sized and positioned to guide, push, or move the first and second guide assemblies 3132, 3133 along, for example, the arced track 3127 as discussed herein while providing the ottoman 3100 and/or the rest 3114 a desired or predetermined height or range of height, such as, for example, a height for a standard or conventional ottoman used for lounging.

Example Embodiment of an Elevated Chair

Figure 29:
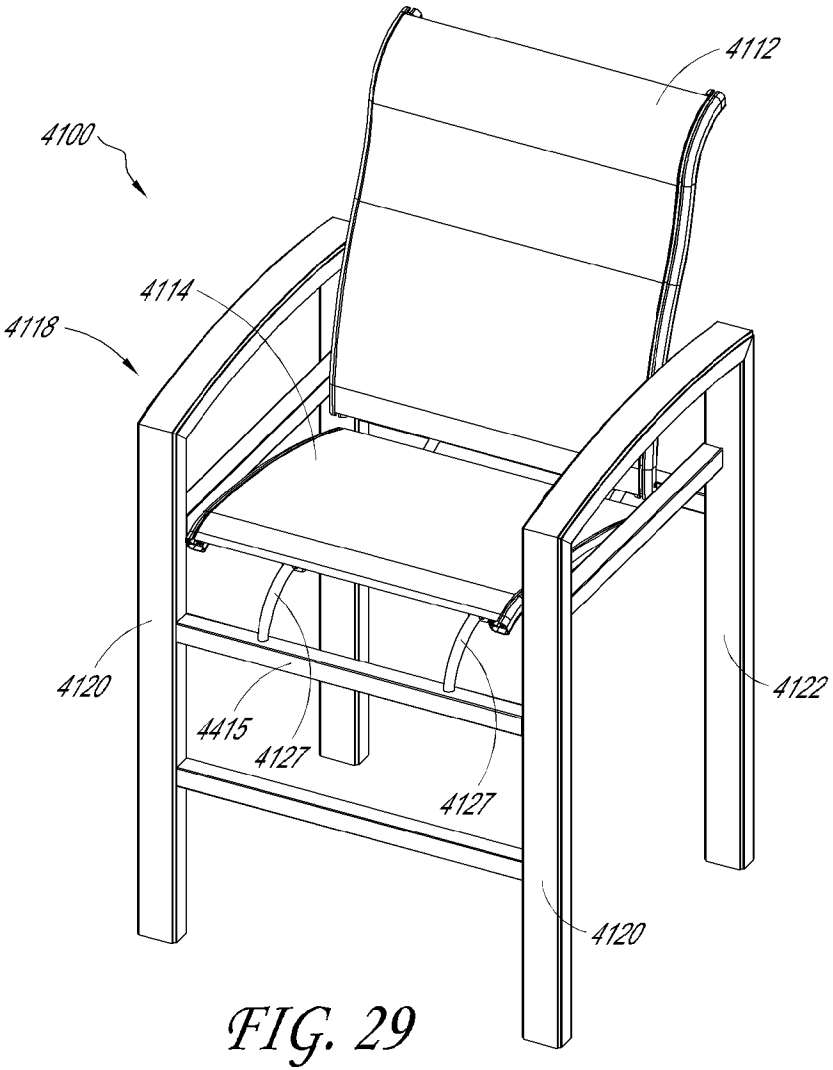
FIG. 29 illustrates a side, top, perspective view of an embodiment of an adjustable seating.

Another example embodiment of adjustable seating 4100 is shown in FIGS. 29-31. In this example, the seating 4100 can be a chair as discussed, for example, in reference to FIGS. 1-7 and FIGS. 19-26. As illustrated in FIGS. 29-31, the seating 4100, and in particular, the backrest 4122 and the seat 4114 can be vertically higher (e.g., elevated) relative to other reclinable or adjustable seating discussed herein. Accordingly, the adjustable seating 4100 can be considered a barstool. However, it will be understood that the term barstool is used in this disclosure for convenience of discussion. As with the other reclinable or adjustable seating discussed herein, the seating 4100 can be integrated into a variety of formal and casual, indoor and outdoor seating options, such stationary or swivel rockers or chairs, lounge chairs, action loungers or swivel action loungers, chaise loungers, settees, love seats, couches, and the like.

Further, the adjustable seating 4100 can be used for orthopedic purposes. For example, a user with a back injury, a hip injury, and/or other physical limitations can use the seating 4100 to comfortably and safely get into and out of the seating 4100. The seating 4100 can have a seat (e.g., a rest or support surface) 4114 that is proximate to or substantially at a user's hip level. As the user backs into the seating 4100 to get into the seating 4100, the seat 4114 can be downwardly inclined for the user's hips and/or buttocks to come against a main or top surface of the seat 4114 while the user is in substantially a standing or slightly crouched position (e.g., less crouched than to sit down in a standard height chair). As the user pushes his/her weight against the seat 4114, the seat 4114 can shift along the tracks as discussed herein to be upwardly inclined for the user to settle into the seating 4100.

FIG. 29 illustrates a side, top, perspective view of an embodiment of an adjustable seating 4100. The seating 4100 can have a frame 4118 disposed about a seat 4114 and a backrest 4212 as discussed herein, and in particular, as discussed in reference to FIGS. 1-5. The frame 4118 can have a front member 4120 and a rear member 4122 as discussed herein, and in particular, as discussed in reference to FIGS. 1-5. The backrest 4112 can be fixedly connected to the frame 4118 (e.g., the backrest 4112 does not recline or change position relative to the frame 4118 as discussed herein for other reclinable seating). As illustrated in FIG. 29, the backrest 4112 and/or seat 4114 has a fabric and/or mesh sling suspended between support members of the backrest 4112 and/or seat 4114. In some embodiments, the backrest 4112 and/or seat 4114 can have cushioning, woven straps, and/or solid case materials as discussed herein.

Figure 30B:
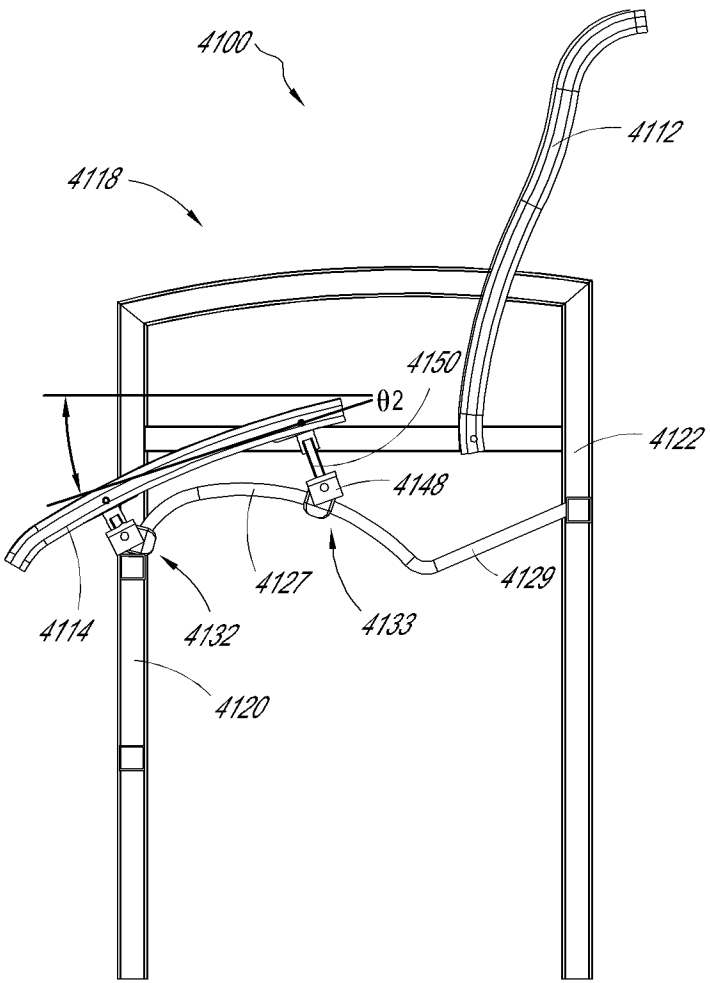
FIGS. 30A-B illustrate side views of an embodiment of an adjustable seating with various components removed for discussion purposes.
Figure 30A:
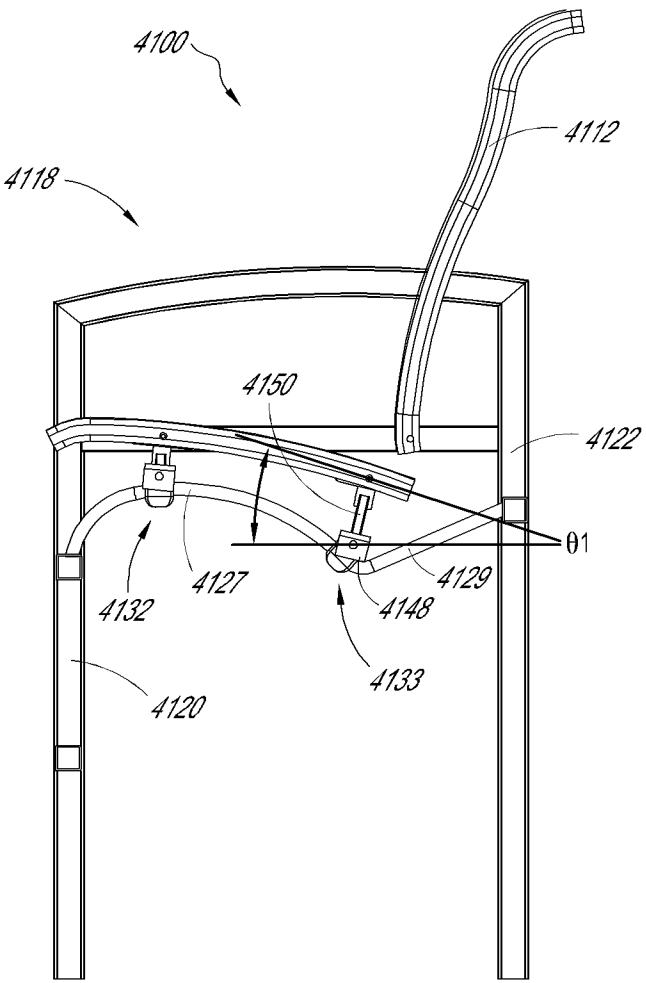
Figure 31B:
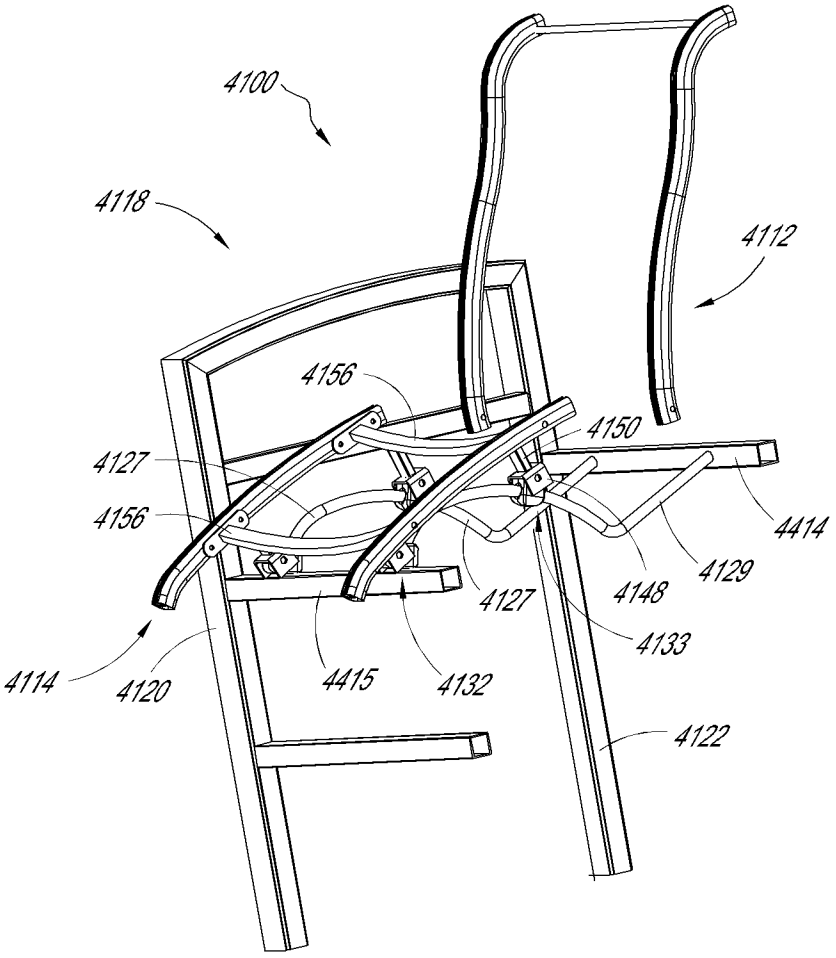
FIGS. 31A-B illustrate side, top, perspective views an embodiment of an adjustable seating with various components removed for discussion purposes.
Figure 31A:
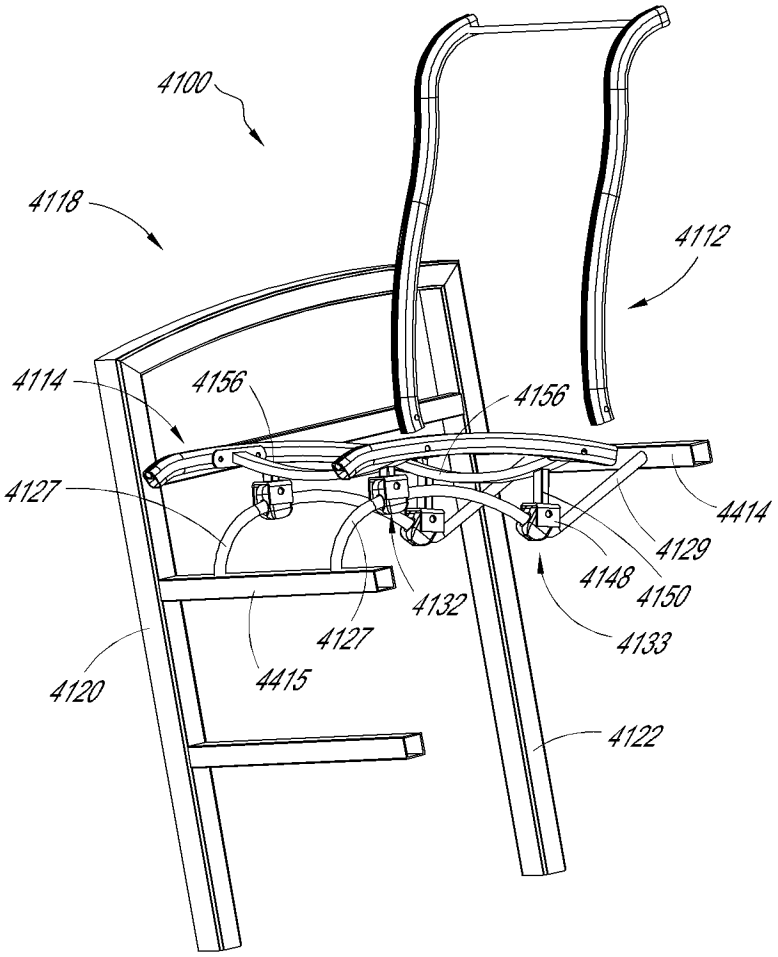

FIGS. 30A-B illustrate side views of an embodiment of an adjustable seating 4100 with one side of the frame 4118 removed to illustrate, for example, an arced track 4127 and movement of the seat 4114 on the arced track 4127. FIGS. 31A-B illustrate side, top, perspective views an embodiment of an adjustable seating 4100 with the mesh and/or fabric sling of the seat 4114 and one side of the frame 4118 removed to illustrate, for example, seat rails 4156, arced tracks 4127, and movement of the seat 4114 on the arced tracks 4127. As illustrated in FIGS. 30A-B and 31A-B, seating 4100 can have a first guide or first guide assembly 3132 and a second guide or second guide assembly 3133. The guide assemblies 4132, 4133 can be the guide assemblies as discussed herein, and in particular, as discussed in references to guide assemblies 132, 1132, 1133 corresponding to FIGS. 6, 7, 16, and 17. For example, the guide assemblies 4132, 4133 can be assembled from sliding shoes made of durable material(s) having a low coefficient of friction with the arced track 4127. The material should be sufficiently durable to withstand repeated use under heavy loads as discussed herein and can include materials discussed herein. The guide assemblies 4132, 4133 can have frictional control, such as frictional control 616 discussed in reference to FIGS. 6 and 7. The guide assemblies 4132, 4133 can have other tightening and friction control mechanisms, such as a nut and bolt assembly 1115, 1117 discussed in reference to FIGS. 16 and 17.

With continued reference to FIGS. 30A-B and 31A-B, the first and second guide assemblies 4132, 4133 are connected to the seat 4114 with a bracket 4148 and an extension 4150 as discussed herein, and in particular, as discussed in reference to extensions 1250 and brackets 1148 corresponding to FIG. 18. The extension 4150 can elevate or space the seat 4114 from the first and second guide assemblies 4132, 4133 and/or frame 4118 to provide sliding clearance between the seat 4114 and other components of the seating 4100. The sliding clearance can provide clearance to accommodate, for example, upholstery, cushions, and other features attached to seat 4114 and/or frame 4118 and allow for movement of the seat 4114 as discussed herein. The first and second guide assemblies 4132, 4133 can be connected to the bracket 4148 via a nut and bolt assembly 1115, 1117 or other suitable attachment mechanisms as discussed herein.

As discussed herein, the seating 4100 can respond to changes in the user's center of gravity by the seat 4114 moving to accommodate the user's position. For a user's safety and/or comfort, it can be desirable to limit movement of the seating 4100. The seat 4114 can be moved from a first resting position (see FIGS. 30A and 31A) to a second resting position (see FIGS. 30B and 31B) as discussed herein in reference to other seating. This motion causes the front portion of the seat 4114 (e.g., portion of the seat 4114 proximate to the front member 4120) to move laterally outward and downwardly (in a direction away from the backrest 4112 and toward the ground) when the seat 4114 is moved from the first resting position to the second resting position. It can be desirable to limit the forward lateral travel (e.g., horizontal movement) of the front portion of the seat 4114 to between about 3 in. (7.62 cm) and 20 in. (50.8 cm), depending on the orthopedic application. It can be desirable to limit downward travel (e.g., vertical movement) of the front portion of the seat 4114 to between about 3 in. (7.62 cm) and 20 in. (50.8 cm), depending on the orthopedic application. The lateral and downward travel range/distance of the front portion of the seat 4114 from the first position to the second position can be changed as desired by varying the length and/or curvature of the tracks, (e.g., arced track 4127). The reverse lateral and upward travel range/distance of the front portion of the seat 4114 from the second position to the first position can be changed as desired by varying the length and/or curvature of the tracks, (e.g., arced track 4127).

The rear portion of the seat 4114 (e.g., portion of the seat 4114 proximate to the rear member 4122) can move laterally forward and upwardly (in a direction away from the backrest 4112 and away from the ground) when the seat 4114 is moved from the first resting position to the second resting position. It can be desirable to limit the forward lateral travel (e.g., horizontal movement) to be substantially similar or same as the front portion of the seat 4114, such as between about 3 in. (7.62 cm) and 20 in. (50.8 cm), depending on the orthopedic application. It can be desirable to limit the upward travel (e.g., vertical movement) to between about 2 in. (5.08 cm) and 16 in. (40.64 cm), depending on the orthopedic application. The lateral and upward travel range/distance of the rear portion of the seat 4114 from the first position to the second position can be changed as desired by varying the length and/or curvature of the tracks, (e.g., arced track 4127) as discussed herein. The reverse lateral and downward travel range/distance of the rear portion of the seat 4114 from the second position to the first position can be changed as desired by varying the length and/or curvature of the tracks, (e.g., arced track 4127) as discussed herein. Accordingly, it can be desirable to limit the backward lateral travel of the seat 4114 (travel toward the direction of the backrest 4112) when the seat 4114 is moved from the second resting position to the first resting position. As the seat 4114 moves backward, toward the backrest 4112, it may be undesirable to have the seat 4114 contact the backrest 4112 and provide a hard stop against the user's momentum moving backwards with the seat 4114.

The seating 4100 can respond to changes in the user's center of gravity by the seat 4114 moving to accommodate the user's position as discussed herein in reference to other seating. In particular, the seat 4114 can move on an arced track 4127 with first and second guides 4132, 4133 engaging the arced track 4127. FIGS. 29, 30A, and 31A illustrate the seat 4114 in a first resting position (e.g., seated position). The first resting position can include where a rear portion/end of the seat 4114 is at a lower vertical height (relative to the ground) compared to a front portion/end of the seat 4114. Stated differently, an angle θ1 of the seat 4114 as illustrated in FIG. 30A in the first resting position may be 1° to 40° degrees relative to the ground from the rear of the seat 4114 or rear member 4122. Such an incline of the seat 4114 can be considered upwardly inclined/sloping angle. The upward slope of the seat 4114 can help retain the user as well as the user's position in the seating 4100. For example, the upwardly sloping seat 4114 can help bias and focus the user's weight to press the user against the backrest 4112. Accordingly, the user can be relatively secured in position once the user is in the seating 4100 and the seat 4114 is in the first position. The fixed backrest 4112 further accommodates the safety of the user in the seating 4100 by providing an unmoving part of the seating 4100 against which the user can securely rest and position against once in the seating 4100.

In some embodiments, the first resting position of the seating 4100 can correspond to the first resting position of other seating as discussed herein, and in particular, as discussed in reference to FIG. 22 illustrating an ottoman 3100. For example, the first resting position can include the seat 4114 being in a substantially level or flat angle position relative to the ground. Accordingly, such a first resting position includes the front portion/end of the seat 4114 (e.g., proximate to the front member 4120) being substantially at a same vertical height (relative to the ground) as the rear portion/end of the seat 4114 (e.g., proximate to the rear member 4122). Stated differently, the angle between the front portion/end of the rest 4114 and the rear portion/end of the rest 4114 can be substantially zero relative to the ground. A more flat or level first resting position may be desirable for an adjustable seating 4100 where the backrest 4112 and seat 4114 are vertically elevated at a smaller height from the resting surface relative to, for example, a barstool. A substantially level first resting position can help accommodate user's that desire adjustable seating 4100 that is lower in vertical elevation and desire the seat 4114 to have a smaller change in slope and/or momentum when getting positioned into the seating (e.g., in the first position).

In some embodiments, the second resting position of the seating 4100 can correspond to the second resting position as discussed herein for the ottoman 3100, and in particular, as discussed herein in reference to FIGS. 19, 20, 27, and 28. FIGS. 30B and 31B illustrate the seat 4114 in a second resting position (e.g., ready position). For example, the second resting position of the seat 4114 can include a downwardly inclined or sloping position where the front portion/end of the seat 4114 is at a lower vertical height (relative to the ground) compared to the rear portion/end of the seat 4114. Stated differently, an angle θ2 of the seat 4114 as illustrated in FIG. 30B in the second resting position may be 5° to 65° degrees relative to the ground from the rear of the seat 4114 or rear member 4122. The downwardly inclined/sloping angle of the seat 4114 may facilitate a user with a back injury, hip injury, and/or other physical limitation getting into the chair. For example, as the user in a standing position moves toward the downwardly inclined seat 4114, the seating 4114 can be positioned and downwardly inclined such that a user contacts the seat 4114 at substantially a same vertical height and point/spot on the seat 4114 as the user will be in when the user is fully positioned or resting in the seating 4100 (e.g., the seat 4114 is in the first resting position). Accordingly, once the buttocks of the user in substantially a standing position is against the seat 4114 that is in the ready position, the user pushes his/her weight against the seat 4114 such that his/her center of gravity shifts toward the backrest 4112 (e.g., toward the back portion of the seat 4114) to cause the seat 4114 to move into the first resting position (e.g., seated position), which includes general backward horizontal/lateral movement of the seat 4114 toward the backrest 4112, the front portion of the seat 4114 ascending/rising (e.g., moving upwardly), and rear portion of the seat 4114 descending (e.g., moving downwardly) as discussed herein. With the user 4114 already having initially contacted the same spot/point of the seat 4114 (in the second resting position) as the user is substantially comfortably contacting in the first resting position (e.g., the user is fully in the seating 4100), the user substantially does not have to or minimally has to shift around his/her buttocks or body (e.g., scoot on the seat 4114) to orient his/herself in a desired position relative to the seat 4114 as well as the backrest 4112.

Similarly, the arrangement of the seating 4100 and movement of the seat 4114 as discussed herein can facilitate a user with an injury getting up from the seating 4100. As the user shifts his/her center of gravity away from the backrest 4112 (e.g., by leaning forward) toward the front of the seat 4114, the seat 4114 moves from the first resting position to the second resting position. As discussed herein, movement of the seat 4114 over the arced tracks 4127 includes general forward horizontal/lateral movement of the seat 4114 toward the front portion of the frame 4118 (e.g., front member 4120), front portion of the seat 4114 descending (e.g., moving downwardly), and rear portion of the seat 4114 ascending (e.g., moving upwardly). Accordingly, the forward lateral motion in combination with a downward slope allows the user to simply dismount from the seating 4100 when the seat 4114 is in the second position substantially without having to or minimally having to shift around his/her buttocks or body (e.g., scoot on the seat 4114) to move off and get up from the seating 4100.

As illustrated in FIGS. 30A-B, the seat 4114 can be connected to and move on the arced track 4127 such that the seat 4114 cantilevers about or relative to the arced track 4127 or the ground. The inclination of the seat 4114 can change depending on the position of the seat 4114 to facilitate a user initially getting into the seating 4100 and retain a position of the seat 4114 once the user is seated or positioned in the seating. FIGS. 30B and 31B illustrate the seat 4114 in a downward slope (e.g., in the ready position) to face toward the user as the user is getting into the seating 4100 as discussed herein. As the user gets into the seating 4100, the weight of the user shifting against the seat 4114 (e.g., center of gravity shifting to be oriented toward the rear portion of the seat 4114) moves the seat 4114 on the arced track 4127 in a cantilevered fashion to change the inclination of the seat 4114 to be upward sloping (e.g., seated position) as illustrated in FIGS. 30B and 31B to help retain the user in the seating 4100 (e.g., bias the user against the backrest 4112).

FIGS. 30A-B and 31A-B illustrate an embodiment of the seating 4100 with, for example, rest rails 4156 and arced tracks 4127. The seat rails 4156 can be secured to the seat 4114 respectively with, for example, bolts, other attachment mechanisms, and/or any other suitable attachment mechanisms. The seat rails 4156 can be arced or curved to, for example, accommodate flexing in the sling when the seating 4100 is occupied by the user (e.g., the mesh flexes toward the seat rails 4156 under the weight of the user). Further, the seat rails 4156 can be arced, curved, or arcuate to, for example, elevate the seat 4114 above the arced rails 4127 and/or frame 4118 to provide sliding clearance as discussed herein. As illustrated in FIGS. 31A-B, the seat 4114 can have two seat rails 4156. As also illustrated, the first and second guide assemblies 4132, 4133 can be attached to both of the seat rails 4156. In some embodiments, the seat 4114 can have 1, 3, or 4 or more seat rails 4156, and the first and second guide assemblies 4132, 4133 can be attached to any of the seat rails 4156 to achieve a desired inclination(s) of the seat 4114 as discussed herein.

With reference to FIGS. 31A-B, the arced rail 4127 can be connected to a front rail 4415. The front rail 4415 can extend from side to side of the frame 4118. Stated differently, the front rail 4415 can extend substantially perpendicular to the adjusting movement of the seating 4100 (e.g., the seat 4114)

as discussed herein. The arced rail 4127 can also be connected to a hanger rail 4129. The hanger rail 4129 can be connected to a back rail 4414. The back rail 4414 can extend from side to side of the frame 4118. Stated differently, the back rail 4414 can extend substantially perpendicular to the adjusting movement of the seating 4100 (e.g., the seat 4114) as discussed herein. In some embodiments, the arced track 4127 and/or hanger rail 4415 can connect to other parts of the frame 4118, such as, for example, the front members 4120 and the back members 4122. In some embodiments, the arced track 4127 may be not connected to a hanger rail 4415. For example, the arced track 4127 can directly connect to the front rail 4415 and the back rail 4414. As another example, the arced track 4127 can directly connect to other parts of the frame 4118, such as the front members 4120 and the back members 4122.

As illustrated in FIGS. 29-31B, the arced track 4127 can be sized and positioned (e.g., connected to the frame 4118) to be underneath the seat 4114 relative to the ground when the seating 4100 is on the ground. The arced track 4127 can be sized and positioned to be within an outer boundary or perimeter of the seat 4114 when for example, the seating 4100 is in the first position. For example, the outer perimeter can be formed or defined by outer members or tubes forming the frame or support structure of the seat 4114. The arced track 4127 can be sized and shaped (e.g., curved) such that the arced track 4127 can be positioned underneath the seat 4114 while achieving a desired height of the seating 4100. Stated differently, the arced track 4127 is sized and positioned to guide, push, or move the first and second guide assemblies 4132, 4133 along, for example, the arced track 4127 as discussed herein while providing the seating 4100 and/or the seat 4114 a desired or predetermined height or range of height, such as, for example, a height for a standard or conventional barstool as well as an orthopedic barstool or chair.

Figure 32:
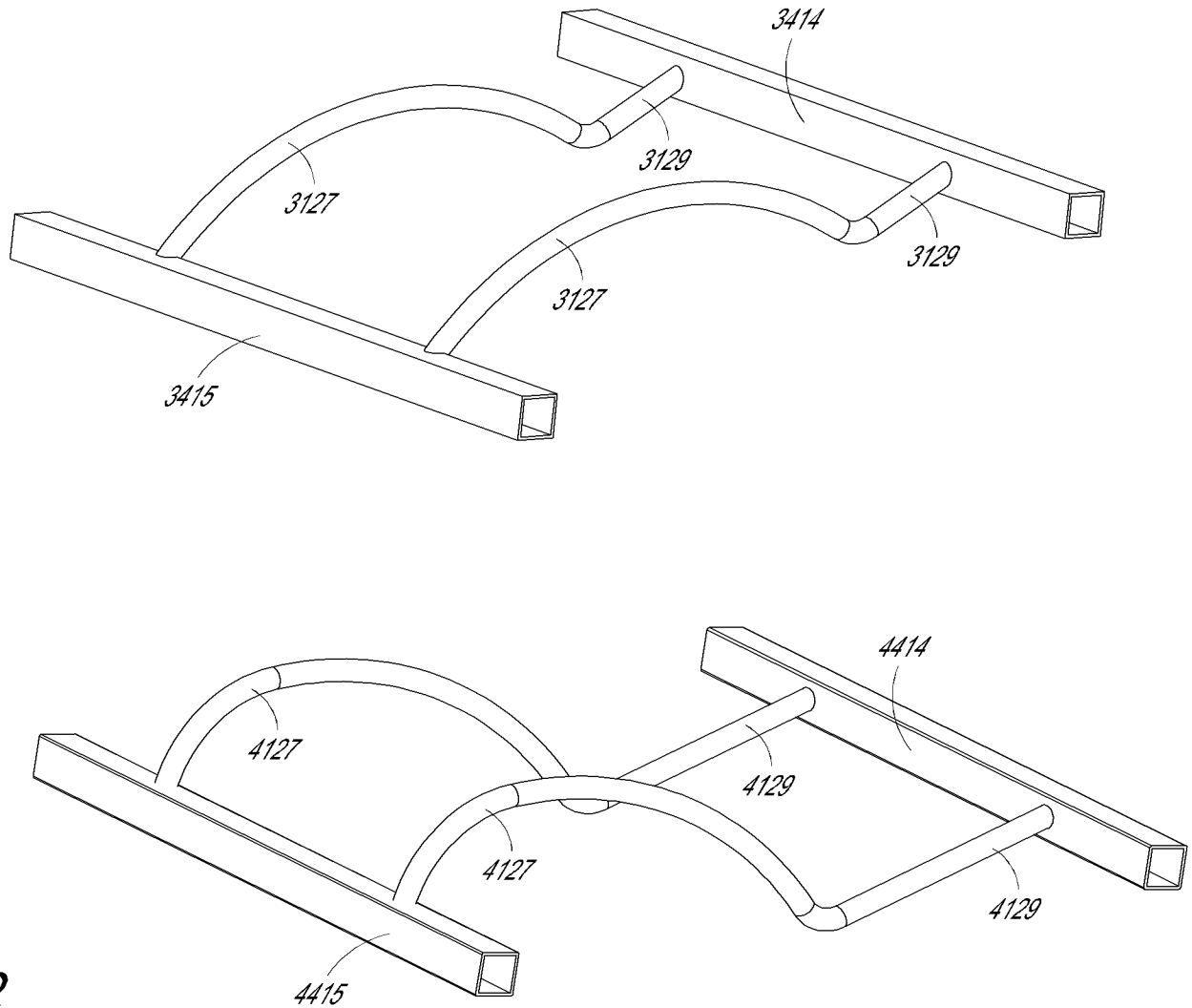
FIG. 32 illustrates side, top, perspective views of embodiments of tracks.

FIG. 32 illustrates side, top, perspective views of embodiments of tracks as discussed herein. FIG. 32 illustrates an embodiment of the arced track 3127 and hanger rail 3129 for the adjustable ottoman 3100 in comparison to an embodiment of the arced track 4127 and hanger rail 4129 for the adjustable seating 4100. As illustrated in FIG. 32, the arced track 3127 can be a substantially same curvature and/or radius through an entirety of the arced track 3127. In comparison, the arced track 4127 can change the curvature and/or radius to achieve desired inclinations and/or horizontal/vertical movements of the seat 4114 as discussed herein. For example, a rear portion of the arced track 4127 can extend from the hanger rail 4129 at a steeper initial incline upward compared to arced track 3127. The radius of rear portion of the arced track 4127 can also be larger to achiever a higher vertical height of the top of the arced track 4127. Such a higher vertical height can provide a greater upward inclination to the seat 4114 in the first resting position as discussed herein to, for example, increase the bias with which the user remains against the backrest 4112 and accordingly, the seating 4100.

With continued reference to FIG. 32, the radius of front portion of the arced rail 4127 can be smaller in comparison to the radius of the back portion of the arced rail 4127 or the overall radius of the arced rail 4127. Such a smaller radius of the front portion of the arced rail 4127 can provide a faster vertical descent of the front portion of the seat 4114 as the seat 4114 moves into the second resting position. With the front portion of the seat 4114 in a relatively lower vertical position, the seat 4114 can have a greater downward slope of the seat 4114 in the second position to, for example, comfortably and safely initially accept and position a user into the seating 4100 as discussed herein. As illustrated in FIG. 32, the front portion of the arced rail 4127 can be curved such that the arced rail 4127 is close to or substantially vertical when extending from the front rail 4415.

As also illustrated in FIG. 32, the hanger rails 4129 of the seating 4100 can have a longer extent than, for example, the hanger rails 3129 of the seating 3100. The longer hanger rails 4129 can accommodate, for example, a frame 4118 that is longer in length from the back rail 4414 to the front rail 4415. Further, the longer hanger rails 4129 can keep the seat 4114 at a greater distance from, for example, the backrest 4112 when the seat 4114 is in the second position. Increasing the distance between the backrest 4112 and a rear portion of the seat 4114 in the second resting position can accommodate taller users (e.g., having the user shift away from sitting on or near the rear portion of the seat 4112 when the seat 4112 may be too close to the backrest 4114 in the second resting position).

TERMINOLOGY

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. Reclinable seating having an upright position and a reclined position, the seating comprising:

a frame comprising a front portion, a rear portion, and members to support the reclinable seating relative to a surface on which the seating rests;

a backrest connected to the frame via a pivot member, the backrest configured to pivot about the pivot member relative to the frame;

a seat connected to the backrest via a pivot connection, the seat configured to pivot at the pivot connection relative to the backrest;

a track connected to the frame, the track comprising a support rail, a hanger rail connected to the support rail, and a guiding rail connected to the hanger rail, the support rail extending from the frame generally upwardly relative to the surface and generally toward the front portion of the frame, the hanger rail extending from the support rail generally downwardly relative to the surface and generally toward the front portion of the frame, and the guiding rail extending from the hanger rail generally upwardly and generally toward the front portion of the frame; and a guide connected to the seat and slideably engaging the track, the guide configured to move along the guiding rail up to the hanger rail, the guide configured to support the seat on the track, wherein the reclinable seating is continuously moveable between an upright position and a reclined position, the backrest pivoting about the pivot member from being more vertical to less vertical relative to the surface from the upright position to the reclined position, the seat moving with the guide along the track toward the front portion of the frame from the upright position to the reclined position.

2. The seating of claim 1, wherein the track further comprises a stay connected to the guiding rail, the stay extending from the guiding rail generally downwardly and generally toward the front portion of the frame.

3. The seating of claim 2, wherein the stay forms a discontinuous path with the guiding rail, the discontinuous path configured to inhibit movement of the guide from the guiding rail to the stay.

4. The seating of claim 3, wherein the stay comprises a generally L-shaped support, and wherein the stay is connected to the guiding rail away from a corner of the generally L-shaped support to form the discontinuous path.

5. The seating of claim 1, wherein the frame further comprises a cross member, the cross member providing a connection between the support rail and the frame, the cross member extending between sides of the frame and proximate to the surface relative to the track.

6. The seating of claim 5, wherein the cross member curves downwardly toward the surface to form a generally U-shaped member, the generally U-shaped member elevating the seating to a desired height above the surface.

7. The seating of claim 1, further comprising a bracket connected to the seat, wherein the guide is pivotally connected to the bracket to allow the guide to pivot relative to the bracket as the guide moves along the guiding rail.

8. The seating of claim 7, wherein the bracket engages the guide with a bolt and nut assembly, and wherein tension formed by tightening the bolt and nut assembly is configured to be adjusted to change friction between the guide and the track to adjust ease with which the seating moves between the upright and reclined positions.

9. The seating of claim 1, wherein friction caused by the guide engaging the track is configured to be adjusted based on a weight of a user to adjust ease with which shifting the weight of the user moves the seating between the upright and reclined positions.

10. The seating of claim 1, further comprising an other track connected to the frame, the other track comprising an other support rail, an other hanger rail connected to the other support rail, and an other guiding rail connected to the other hanger rail, the other support rail extending from the frame generally upwardly relative to the surface and generally toward the front portion of the frame, the other hanger rail extending from the other support rail generally downwardly relative to the surface and generally toward the front portion of the frame, and the other guiding rail extending from the other hanger rail generally upwardly and generally toward the front portion of the frame; and an other guide connected to the seat and slideably engaging the other track, the other guide configured to move along the other guiding rail up to the other hanger rail, the other guide configured to support the seat on the track.

11. The seating of claim 10, wherein the track further comprises a stay connected to the guiding rail, the stay extending from the guiding rail generally downwardly and generally toward the front portion of the frame, and wherein the other track further comprises an other stay connected to the other guiding rail, the other stay extending from the other guiding rail generally downwardly and generally toward the front portion of the frame.

12. The seating of claim 11, wherein the stay forms a discontinuous path with the guiding rail, the discontinuous path configured to inhibit movement of the guide from the guiding rail to the stay, and wherein the other stay forms an other discontinuous path with the other guiding rail, the other discontinuous path configured to inhibit movement of the other guide from the other guiding rail to the other stay.

13. The seating of claim 12, wherein the stay and the other stay are connected by a crossbar to form a generally U-shaped support, the guiding rail and the other guiding rail connected to the generally U-shaped support away from corners of the generally U-shaped support to form the discontinuous path and the other discontinuous path, respectively.

14. The seating of claim 13, wherein the guiding rail and the other guiding rail are connected to the crossbar of the generally U-shaped support to form the discontinuous path and the other discontinuous path, respectively.

15. The seating of claim 1, wherein the seat remains at substantially a same angle relative to the surface in the upright and reclined positions.

16. A chair comprising the seating of claim 1.

17. Reclinable seating having an upright position and a reclined position, the seating comprising:

a frame comprising a front portion and a rear portion, the frame configured to support the reclinable seating relative to a surface on which the seating rests;

a backrest connected to the frame, the backrest configured to pivot relative to the frame;

a seat connected to the backrest, the seat configured to pivot relative to the backrest;

a rail bracket comprising two arms and a crossbar, the two arms connected to the frame, the two arms extending from the frame generally upwardly relative to the surface and generally toward the rear portion of the frame, and the crossbar extending generally horizontally between the two arms to connect the two arms away from the frame;

a guiderail connected to the rail bracket, the guiderail comprising a guiding rail extending from the rail bracket generally downwardly relative to the surface; and a guide connected to the seat and engaging the guiderail, the guide configured to move along the guiding rail up to the rail bracket, the guide configured to support the seat on the guiderail, wherein the reclinable seating is continuously moveable between an upright position and a reclined position, the backrest pivoting about the frame from being more vertical to less vertical relative to the surface from the upright position to the reclined position, the seat moving with the guide along the guiderail toward the front portion of the frame from the upright position to the reclined position.

18. The seating of claim 17, wherein the guiding rail is connected to the crossbar, away from the two arms.

19. The seating of claim 17, wherein the guiderail further comprises a hanger rail connected to the guiding rail, the hanger rail extending from the guiding rail generally upwardly and generally toward the rear portion of the frame, the guide configured to stop at the hanger rail when moving along the guiding rail toward the rear portion of the rail as the seating is moved into the upright position.

20. The seating of claim 19, wherein the guiderail further comprises a support rail connected to the hanger rail, the support rail extending from the hanger rail generally downwardly and generally toward the rear portion of the frame.

21. The seating of claim 17, wherein friction caused by the guide engaging the guiderail is configured to be adjusted based on a weight of a user to adjust ease with which shifting the weight of the user moves the seating between the upright and reclined positions.

22. Reclinable seating having an upright position and a reclined position, the seating comprising:

a frame comprising a front portion and a rear portion;

a backrest connected to the frame via a pivot member, the backrest configured to pivot about the pivot member relative to the frame;

a seat connected to the backrest via a pivot connection, the seat configured to pivot at the pivot connection relative to the backrest;

a track connected to the frame, the track comprising a support rail, a hanger rail connected to the support rail, and a guiding rail connected to the hanger rail, the support rail extending from the frame in a first direction generally toward the front portion of the frame, the hanger rail extending from the support rail in a second direction toward the front portion of the frame, and the guiding rail extending from the hanger rail in the first direction toward the front portion of the frame; and a guide connected to the seat and slideably engaging the track, the guide configured to move along the guiding rail up to the hanger rail, the guide configured to support the seat on the track, wherein the reclinable seating is continuously moveable between an upright position and a reclined position, the backrest pivoting about the pivot member between the upright position and the reclined position, the seat moving with the guide along the track toward the front portion of the frame from the upright position to the reclined position.

* * * * *